US007284341B2

(12) United States Patent
Moseley

(10) Patent No.: US 7,284,341 B2
(45) Date of Patent: Oct. 23, 2007

(54) SAND WALKING SANDAL

(76) Inventor: Marshall G. Moseley, 775 Gulf Shore Dr., Unit 2017, Destin, FL (US) 32541-3150

( * ) Notice: Subject to any disclaimer, the term of this patent is extended or adjusted under 35 U.S.C. 154(b) by 154 days.

(21) Appl. No.: 11/259,153

(22) Filed: Oct. 27, 2005

(65) Prior Publication Data

US 2006/0096124 A1 May 11, 2006

Related U.S. Application Data

(60) Provisional application No. 60/660,079, filed on Mar. 9, 2005, provisional application No. 60/622,420, filed on Oct. 27, 2004.

(51) Int. Cl.
*A43B 3/12* (2006.01)

(52) U.S. Cl. ..... 36/11.5; 36/103; 36/7.5

(58) Field of Classification Search ..... 36/11.5, 36/102, 103, 31, 33, 7.5; D2/916, 947
See application file for complete search history.

(56) References Cited

U.S. PATENT DOCUMENTS

| | | | |
|---|---|---|---|
| 457,423 | A | 8/1891 | Friede |
| 683,595 | A | 10/1901 | Drouillard |
| 991,774 | A | 5/1911 | Eldred |
| 995,245 | A | 6/1911 | Futterknecht et al. |
| 1,142,854 | A | 6/1915 | Slocum |
| 1,204,796 | A | 11/1916 | Lockwood |
| 1,250,852 | A | 12/1917 | Goldstone |
| 1,266,492 | A | 5/1918 | Kurrell et al. |
| 1,341,498 | A | 5/1920 | Demarmels et al. |
| 1,350,197 | A | 8/1920 | Wood |
| 1,435,538 | A | 11/1922 | Lumbard |
| 1,528,265 | A | 3/1925 | Roa |
| 1,964,406 | A | 6/1934 | Pellkofer |
| 2,033,313 | A | 3/1936 | Wilson |
| 2,177,571 | A | 10/1939 | Kirke |
| 2,227,352 | A | 12/1940 | Krasnosky |
| 2,292,263 | A | 8/1942 | Amlaw |
| 2,340,027 | A | 1/1944 | Story |
| 2,352,532 | A | 6/1944 | Ghez |
| 2,367,219 | A | 1/1945 | Kearny |
| 2,412,474 | A | 12/1946 | Scott-Paine |
| 2,430,466 | A | 11/1947 | Hedman |

(Continued)

FOREIGN PATENT DOCUMENTS

| | | | |
|---|---|---|---|
| DE | 42 44 293 | A1 | 7/1993 |

(Continued)

*Primary Examiner*—Jila M Mohandesi
(74) *Attorney, Agent, or Firm*—Richard C. Litman

(57) ABSTRACT

The sand walking sandal is a hinged sandal for walking on sand having a forward sole section with a foot receiving portion located thereon and an extended forward sole width portion extending outward and laterally from the foot receiving portion. A rearward sole section has a foot receiving portion located thereon, an extended rearward sole width portion extending outward and laterally from the foot receiving portion, and a rearward sole section length extension projecting rearward from the foot receiving portion. A flexible hinge joins the forward and rearward sole sections together, allowing each of the sole sections to angularly rotate about the flexible hinge independent of each other. A foot retaining thong or footwear retaining straps are mounted on the foot receiving portion for securing a user's foot to the hinged sandal.

10 Claims, 26 Drawing Sheets

U.S. PATENT DOCUMENTS 2,435,668 A 2/1948 Behringer
2,450,250 A 9/1948 Napton
2,466,580 A 4/1949 Dalbey
2,478,664 A * 8/1949 Morrow et al. ..... 36/31
2,515,070 A 7/1950 Anderson
2,517,472 A 8/1950 Fathauer
2,590,648 A 3/1952 Pitz
2,669,036 A 2/1954 Israel
2,700,832 A 2/1955 Slovinski
2,711,033 A 6/1955 Dick
2,801,478 A 8/1957 Gilbert
2,825,153 A 3/1958 Fabrizio
2,826,830 A 3/1958 Nelson
3,052,045 A 9/1962 Grimaldi
3,121,962 A 2/1964 Gullo
3,290,802 A 12/1966 Fukuoka
3,609,888 A 10/1971 Rickman
3,925,914 A * 12/1975 Marcoux ..... 36/11.5
3,965,585 A 6/1976 Stewart
4,213,256 A 7/1980 Mas et al.
4,226,031 A 10/1980 Wong
4,228,601 A 10/1980 Lawton et al.
4,228,602 A 10/1980 Groves
4,309,832 A 1/1982 Hunt
4,419,836 A 12/1983 Wong
4,573,457 A 3/1986 Parks
4,706,392 A 11/1987 Yang
5,065,531 A 11/1991 Prestridge
5,184,410 A 2/1993 Hamilton
5,253,437 A 10/1993 Klebahn et al.
5,274,932 A 1/1994 Malloy
5,282,327 A 2/1994 Ogle
5,410,820 A 5/1995 Goodman
5,481,814 A 1/1996 Spencer
5,689,901 A 11/1997 Bell
RE35,708 E 1/1998 Malloy
5,794,360 A 8/1998 Bell
5,926,975 A 7/1999 Goodman et al.
6,178,666 B1 1/2001 Kiniry et al.
6,189,239 B1 2/2001 Gasparovic et al.
6,266,896 B1 7/2001 Liu
D446,633 S * 8/2001 Ferris ..... D2/917
6,594,921 B2 7/2003 Laio et al.
6,606,803 B1 * 8/2003 Ritter et al. ..... 36/11.5
6,634,121 B2 10/2003 Sordi
6,684,533 B1 2/2004 Su
6,860,038 B1 3/2005 Stucke
2003/0131501 A1 7/2003 Erickson et al.
2004/0148802 A1 8/2004 Soriano et al.
2005/0150135 A1 7/2005 Kelley
2005/0193534 A1 9/2005 Paganelli et al.

FOREIGN PATENT DOCUMENTS

DE 43 19 650 A1 1/1994
EP 89930 A1 * 9/1983

* cited by examiner

SAND WALKING SANDAL

CROSS-REFERENCE TO RELATED APPLICATION

This application claims the benefit of U.S. Provisional Patent Application Ser. No. 60/622,420, filed Oct. 27, 2004 and U.S. Provisional Patent Application Ser. No. 60/660,079, filed Mar. 9, 2005.

BACKGROUND

1. Field of the Invention

The present invention relates to footwear, specifically an improved sandal with a flexibly-hinged, three-part, extended, rigid sole system that is designed to enable normal, full-stride walking on very soft sand.

The present invention additionally relates to footwear, specifically a sandal designed for use with feet that are also clad in conventional walking shoes or jogging sneakers. The invention's objective of eliminating deep foot sinking is achieved by employing a flexibly-hinged, three-part, rigid sole system comprised of three, rigid sole sections: a forward sole section, a middle sole section, and a rear sole section.

2. Description of the Prior Art

Rigid sole sandals and clogs have long been the footwear of choice for walking on very soft sand, like that typically found at beach and desert locations. The reason for this preference is that conventional, rigid sole sandals and clogs, as opposed to conventional, flexible sole sandals, function significantly better in preventing foot sinking. But, this superior performance occurs only when the sandal-wearer is engaged in short-stride walking, not full-stride walking. Prior to the present invention there has never been a sandal, flexible sole or rigid sole, that could eliminate, or even significantly reduce, deep foot sinking during full-stride walking without also being accompanied by very serious, negative side effects such as having to walk with one's feet positioned further apart than normal. During past history some inventors must surely have attempted to solve the foot-sinking problem in the most obvious way, by designing sandals with over-sized soles, not too unlike old-fashioned snow shoes that look like tennis rackets, that indeed would eliminate deep foot sinking in soft sand during full-stride walking. Most such solutions, however, would also have been accompanied by very serious side effects such as awkwardness and discomfort when walking, which would explain why we do not see any such products on the market today. Beach goers who prefer full-stride walking to short-stride walking, have traditionally had to restrict their walking to the water's edge where the sand is firmer and where there is little foot sinking.

The conventional, rigid sole sandal or clog that is most commonly used for walking on very soft sand is comprised of a one-part, rigid sole and a thong for securing that sole to a person's foot. The size of the sole universally conforms, more or less, to the size and shape of the sandal-wearer's foot; and the foot's heel is always positioned very close to the back edge of the sole.

The foot-sinking problem can be better understood by analyzing the performance of a conventional, one-part, rigid sole sandal or clog during the various stages of a full-stride walking cycle, as explained below.

When wearing conventional, one-part, rigid sole sandals or clogs and engaged in full-stride walking, vs. short-stride walking, the sandal-wearer's upper body begins the cycle by leaning forward as a foot is thrust forward in the air, above the soft sand, toward a first step. At the same moment, the trailing foot responds to the body's forward motion by instinctively arcing its heel and instep upward, away from the back portion of the sandal sole as half of the sandal-wearer's body's weight, which had been supported by the heel, shifts forward to the ball joints of the toes, and with a small amount to the toes themselves.

As the sandal-wearer's body and outstretched leading leg continue their forward movement, the heel and instep of the trailing foot continue their arcing motion upward as the instep begins pressing firmly against the thong straps that wrap across and around it. But, because the body's full weight is pressing heavily down upon the forward portion of the sandal's one-part, rigid sole, the entire sole is held down flatly and firmly upon the soft sand, causing the tension upon the thong straps to become greater and greater. After causing considerable foot discomfort the ever-increasing tautness of the thong straps eventually overcomes the pressure of the sandal-wearer's heavy body weight pressing the forward portion of the one-part, rigid sole firmly upon the sand.

As the back portion of the sandal sole is forced up above the soft sand by the pulling thong straps, at an angle of roughly 15 to 25 degrees, the entire sole (which is constructed of one rigid piece) is forced up at that angle. When the tilting occurs, the front end of the sole immediately punches deeply down into the soft sand (approximately 1.25 to 2 inches, or more) as a result of: (1) the heavy, body weight pressure that continues to be concentrated at the forward end of the sandal sole; and (2) the 15- to 25-degree angle of the sandal sole.

When the rear portion of the sandal sole is forced up above the soft sand at an angle, it leaves the forward portion of the sandal with an insufficient number of square inches of sole surface area in contact with the soft sand to fully support the body's weight. Consequently, the forward end of the sole immediately punches down into the soft sand until enough square inches of sole surface area are once again in contact with the soft sand to support the sandal-wearer's heavy body weight.

It should be noted that when any flat plane comes in contact with soft sand while positioned at an angle, its weight-supporting capability per-square-inch of surface contact is diminished; and when the angle of the plane increases, its weight-supporting capability decreases—an inverse proportion. To be precise, the 15- to 25-degree angle of the sole reduces the sole's weight-supporting capability by 16.7% to 27.8%, respectively. Immediately after that abrupt foot sinking of the trailing foot, the sandal-wearer's full-body weight is instinctively shifted from the trailing foot, forward to the heel of the leading foot as it strikes the soft sand ahead at a 15- to 25-degree angle at the completion of its airborne stepping action forward. And, for basically the same reasons listed for the trailing foot above, the leading foot sinks down deeply (approximately 1.25 to 2 inches, or more) into the soft sand ahead because: (1) the heavy, body weight pressure is concentrated totally upon the foot's heel which is positioned at, or very near, the back edge of the sandal sole; and (2) the sandal sole is positioned at a 15- to 25-degree angle, in its relationship to the surface of the sand.

When the rear portion of the sandal sole strikes the soft sand at an angle, it has an insufficient number of square inches of sole surface area in contact with the soft sand to fully support the body's weight because the forward portion of the sandal is still positioned above the soft sand. Consequently, the back end portion of the sole punches down deeply into the soft sand until enough square inches of sole surface area come in contact with the soft sand to support the sandal-wearer's heavy body weight. Had the stepping action been a short-stride step, vs. a full-stride step, the leading leg and foot, as well as the trailing leg and foot, would have been positioned at a much lesser angle, and consequently the sandal-wearer would have experienced very little foot sinking, and very little, or no, foot discomfort due to thong pressures.

The degree of foot sinking that occurs on very soft sand is directly proportional to the angle of the sandal sole, and indirectly proportional to the square-inch area of sandal sole that is in contact with the soft sand. In further explanation, it should be noted that during full-stride walking, when the leading leg is thrust forward at a 15- to 25-degree angle, in its relationship to the vertical, the sandal-wearer's foot and sandal sole both strike the soft sand at approximately that same 15- to 25-degree angle, but in relationship to the soft sand, not the vertical, maintaining the anatomically natural and instinctive 90-degree angle relationship between the leg and the foot. In further explanation still, when a leg is thrust forward in the air toward a new step, a person's body instinctively locks the foot of that leg at an angle of approximately 90 degrees, in its relationship to the leg, in anticipation of the person's heavy body weight being totally concentrated upon the heel of the foot upon impact with the soft sand ahead.

Wearers of conventional, rigid sole sandals avoid the foot-sinking problem by simply engaging in short-stride steps only. This action results in the outstretched legs and feet being positioned at a much lesser angles, and consequently very little foot sinking.

The foot-sinking problem can also be better understood by analyzing the performance of a conventional, walking shoe during the various stages of a full-stride walking cycle.

When wearing conventional walking shoes or jogging sneakers, while engaged in full-stride walking or jogging on very soft sand, as the sandal-wearer's upper body moves forward to take a step, a foot is thrust forward in the air above the sand's surface. But, before that leading foot makes contact with the soft sand ahead, the heel of the trailing foot instinctively arcs upward, away from the surface of the soft sand, in preparation for that foot being lifted airborne off the soft sand and thrust forward toward its own next step.

As the foot's heel arcs upward, the sandal-wearer's total body weight becomes concentrated totally upon the ball joints of the toes, and with a small amount concentrated upon the toes themselves. As the sandal-wearer's upper body continues its move forward, and the leading leg is nearing completion of its airborne stepping action forward, the heel of the trailing foot arcs upward even higher, and the angle of each of the sandal-wearer's outstretched legs, in their relationship to the vertical, becomes quite pronounced—roughly 15 to 25 degrees. But, before the heel of the trailing foot completes its arcing movement upward, the sole of that shoe reaches its maximum degree of flexibility, thereby causing the front portion of the shoe sole to cease flexing and begin tilting downward into the soft sand as the heel continues its arcing movement upward.

By the time-the-heel completes its upward arc, the front portion of the foot's shoe sole has tilted downward in front at an angle of roughly 15 to 25 degrees, and there is an insufficient number of square-inches of sole surface area in contact with the soft sand to support the body's full weight. As a result, 1.25 inches to 2.5 inches, more or less, of foot sinking results before there are enough square-inches of sole surface area in contact with the soft sand to support the body's weight.

Had the trailing foot been positioned at a much lesser angle, as it is during short-stride walking, very little less foot sinking would have occurred. The amount of foot sinking that occurs on very soft sand is directly proportional to the angle of the shoe sole, in its relationship to the surface of the soft sand, and is indirectly proportional to the square-inch surface area of that portion of the shoe sole that remains in contact with the soft sand.

Wearers of the conventional, flexible-sole shoes being discussed, are forced to walk with short strides, vs. full strides, to cause the shoe sole to be positioned at a much lesser angle, and consequently cause much less foot sinking to occur before enough square-inches of sole surface area are in contact with the soft sand to support the body's weight. In this particular instance, immediately following the foot sinking that occurs with the trailing foot, the beach walker's full-body weight is instinctively shifted away from the ball joints of the toes portion of the trailing foot, forward to the heel of the leading foot, as it strikes the soft sand ahead while being positioned at a 15 to 25 degree angle, at the completion of its airborne stepping action forward, as explained more fully in the next paragraph.

When the leading foot strikes the soft sand, its angular orientation to the surface of the soft sand, causes it to sink down into the soft sand until enough square-inches of the sole's surface area come in contact with the soft sand to support the sandal-wearer's full-body weight. The amount of foot sinking that occurs depends upon the severity of the foot angle and the body weight of the individual. The less the angle, the less the foot sinking, and the less the body weight, the less the foot sinking; but the sinking normally ranges from roughly 1.25 inches to 2.5 inches.

The phenomena of the sandal-wearer's foot changing its angle of orientation, in its relationship to the sand's surface, occurs during short-stride walking cycles also, but to a much lesser extent. In explanation, when a leg is thrust forward in the air toward a new step forward, the human body instinctively locks the foot of that leg at its most natural anatomical angle (approximately 90 degrees), in its relationship to the leg, in anticipation of the body's full weight being concentrated upon the heel of the sandal-wearer's foot when the foot and sandal contact the soft sand ahead. And, during full-stride walking, because the leg is thrust forward at a 15 to 25 degree angle, in its relationship to vertical, the sandal-wearer's foot and sandal sole strike the soft sand at approximately that same 15 to 25 degree angle, in its relationship to the soft sand.

During short-stride walking the leg is thrust forward at a much lesser angle; and, consequently, the sandal-wearer's foot and sandal sole strike the soft sand at roughly that same lesser angle, thereby causing a much smaller amount of foot sinking to occur. It should be noted that the support capability of a square-inch of a shoe's sole on very soft sand is diminished by almost the same percentage as the angle of the sole, in its relationship to the sand's surface. A 15- to 25-degree angle reduces the support capability of the footwear sole by 16.7 to 27.8 percent. A 45-degree angle reducing the support capability of a sole by 50 percent. A hypothetical 90-degree angle reduces the support capability of a sole by 100 percent.

Also, when a shoe's sole makes contact with very soft sand at the completion of the airborne stage of a full-stride, stepping action forward, its 15- to 25-degree angle orientation with the sand, causes only a miniscule amount of surface contact to take place initially along the back edge of the shoe sole. The small area of surface contact results in almost no initial sand resistance. But, as the body's heavy weight forces the sandal's sole to sink down deeply into the soft sand, more and more of the shoe's sole surface area comes in contact with the soft sand, until there are enough square-inches of sole contact with the soft sand to support the body's full weight, and the sinking stops.

For example, when contact is made with the foot positioned at an 18-degree angle, the shoe's sole must sink down approximately 1.625 inches before 5 linear inches of the shoe's sole come into contact with the soft sand. When contact is made with the foot positioned at a 25-degree angle, the sandal sole must sink down approximately 2.3 inches before 5 linear inches of sole come in contact with the soft sand. The actual number of linear inches needed to support a sandal-wearer's full weight, of course, depends upon the shoe's width, the sandal's angular orientation, and the body weight of the sandal-wearer.

Although hinged, multi-section, rigid sole footwear dates back to several patents of the early 1900s (and possibly before), the idea has never been employed for any purpose other than to alleviate the foot discomfort caused by the inflexibility of rigid-sole sandals and clogs. In those early patents, the hinged, two-part (or more) rigid sole systems introduced flexibility to rigid sole footwear, making the walking process much less cumbersome and much more comfortable by making the movements of the sole conform more to the foot's movement, thereby eliminating most of the thong pressures created by one-piece, rigid sole footwear.

In the present invention, however, the flexibly-hinged, three-part, rigid sole system not only eliminates foot discomfort, but also works in tandem with the novel idea of added extra sole length behind the sandal-wearer's heel to make possible the employment of inverted mechanical leverage to greatly reduce deep foot sinking.

The present invention, with its extended sole length and extra sole width, looks like an over-sized sandal and is quite unconventional and strange-looking, but it functions exceptionally well, and allows beach- and desert-lovers to walk normally on very soft sand with almost the same degree of ease and comfort as walking on firmer surfaces. With the present invention there is no need to be confined to short-stride steps to avoid foot sinking, and there is no need to concentrate on one's walking in an effort to lessen foot sinking.

Thus, a sand walking sandal solving the aforementioned problems is desired.

SUMMARY OF THE INVENTION

A hinged sandal for walking on sand having a forward sole section with a foot receiving portion located thereon and an extended forward sole width portion extending outward and laterally from the foot receiving portion. A rearward sole section has a foot receiving portion located thereon, an extended rearward sole width portion extending outward and laterally from the foot receiving portion, and a rearward sole section length extension projecting rearward from the foot receiving portion, wherein the extended rearward sole width portion and the rearward sole section length extension are integral with the rearward sole section. A flexible hinge joins the forward and rearward sole sections together allowing each of the sole sections to angularly rotate about the flexible hinge independent of each other. A foot retaining thong or footwear retaining straps are mounted on the foot receiving portion for securing a user's foot to the hinged sandal.

The first objective of the present invention is to provide an improved sandal that will allow full-stride walking on very soft sand without the deep foot sinking and thong pressure discomforts that have forever been deficiencies of all known one-part, rigid sole sandals and clogs, which are the footwear of choice for the overwhelming majority of people when walking on soft sand. The two causes of foot sinking when walking on very soft sand are: (1) the heavy body weight of the sandal wearer, and (2) the instinctive positioning of the sandal wearer's foot at an angle, in its relationship to the soft sand, during several stages of the full-stride walking cycle. The angle occurs as the outstretched leading foot strikes the soft sand ahead during a stepping action forward, and as the outstretched trailing foot is being lifted up off the soft sand to begin its next step forward.

The present invention circumvents the angle of the foot problem by having a flexibly-hinged, three-part, rigid sole system that has extra sole length added behind the heel of the sandal-wearer's foot to employ the principles of inverted mechanical leverage to force the three sole sections to lie down flatly upon the soft sand whenever they are supporting any significant amount of body weight, thereby eliminating the problem of deep foot sinking.

The thong pressure discomfort problem is eliminated by adding flexibility to the one-part rigid sole by dividing it into three, flexibly-hinged, rigid sole sections, which are more compatible with-the flexing actions of the foot.

Additional sole width has been added to each of the three sole sections to increase the number of square inches of sole surface area for each of the three sections. This additional width reduces the amount of body weight pressure supported per-square-inch of sole surface area for each of the three sole sections, thereby reducing foot sinking even more. The present invention makes all walking on very soft sand almost as comfortable and easy as walking on firm surfaces with conventional footwear, except for the occasional tilting of the foot sometimes caused by sand surface irregularities.

Although the hinged, multi-sectioned, rigid sole idea dates back to a hand full of clog patents of the early 1900s, the idea has never been employed for any purpose other than for smoother walking and to alleviate the foot discomfort that is caused by thong pressures created during the full-stride walking cycle as a result of the rigid sole's inflexibility. In those early patents, the hinged, two-section (or more) sole systems eliminated the thong pressures by incorporating flexibility into the rigid sole of the clog by dividing the traditional one-part sole into two or more parts, each joined by some form of hinge. In the present invention, however, the flexibly-hinged, three-part, rigid sole idea is combined with the simple, but crucially important, concept of adding extra sole length behind the sandal-wearer's heel to make possible the employment of inverted mechanical leverage to solve the deep foot-sinking problem—a totally "new and unique" concept for which a patent is being sought. Adding additional sole width simply reduces the foot sinking even more.

The second objective of the present invention is to provide a sandal for use with walking shoes and jogging sneakers, that will allow full-stride walking and jogging on very soft sand without deep foot sinking. This is accomplished by designing a sandal with a flexibly-hinged, three-part, rigid-sole system that is significantly lengthened behind the heel of the sandal-wearer's foot. The design features interact to employ inverted mechanical leverage to eliminate the deep foot sinking which is a deficiency of all known conventional footwear when engaged in full-stride walking on very soft sand. The problematic foot sinking is reduced even further by designing the sandal sole system with extra sole width to reduce the amount of body weight supported per-square-inch of sole. All of the above-listed design/construction features work together to eliminate all but an insignificant amount of foot sinking.

The foot sinking that occurs with conventional footwear is primarily the result of the angle of the foot, in its relationship to the sand's surface, during two stages of the walking cycle. The angling occurs once when the walker is engaged in an airborne step forward. During this stage of the walking cycle, the angle of the out-stretched leading leg (in its relationship to the vertical) causes the foot and shoe to strike the soft sand ahead at a 15- to 25-degree angle, more or less, in its relationship to the sand's surface. When this occurs, the body's full weight is concentrated upon the heel of the leading foot and shoe, causing the back portion of the shoe to sink down deeply into the soft sand, 1.25 to 2.5 inches, or more, before enough square-inches of shoe surface area come in contact with the soft sand to support the body's full weight.

The problematic angle of the shoe occurs a second time during the walking cycle with the opposite, trailing foot as the leading foot is being thrust in the air toward its next stepping action forward. As this action is occurring, the heel of the trailing foot and the heel of the shoe instinctively arc upward together, above the surface of the soft sand, in anticipation of their own next step forward. Just before the heel of the leading foot makes contact with the surface of the soft sand ahead, the heel of the trailing foot and the heel of the shoe arc up even higher, causing the back portion of the shoe to rise high above the surface of the soft sand, which causes the front portion of the shoe to angle downward, and sink deeply into the soft sand until enough square-inches of the shoe sole's surface area once again come in contact with the soft sand to support the body's full weight. The reduced square-inch area of sole contact with the soft sand causes the sinking to occur. Also relevant is the fact that the support capability of every square-inch of a sole's bottom surface, that is in contact with soft sand, is diminished by almost the same percentage as the angle of the sole, in its relationship to the sand's surface. A 25-degree angle reduces the support capability of the footwear sole by 27.8 percent, and a 45-degree angle reducing the support capability of a sole by 50 percent, etc.

With the present invention, however, the outcome of the same two stages of the walking cycle, described above, is dramatically different. During the stage when the sandal-wearer is taking an airborne step forward, the leading foot strikes the soft sand ahead at exactly the same angle as with conventional footwear. With the present invention, however, the sandal-wearer's heel functions as a weighted fulcrum of an inverted mechanical lever, with the sandal-wearer's full-body weight forcing the sandal's rear sole section to instantly plop down firmly and flatly upon the soft sand within a split second after contact is made with the soft sand, which results in an insignificant amount of foot sinking. This action occurs even while the sandal-wearer's foot and shoe remain positioned at the angle that it was in when the plop-down action occurred.

As the walking cycle continues, the sandal-wearer's upper body continues moving forward until it passes directly over the leading foot. This movement forward causes the leading foot to arc downward from its angular orientation until it is flatly positioned upon the soft sand, and no longer at an angle. As the foot is arcing downward, it functions as a weighted fulcrum of an inverted lever, forcing the middle sole section and the forward sole section of the sandal sole to lie down flatly upon the soft sand, one after the other, in succession, where roughly ½ of the body's weight, which had been totally concentrated upon the heel, now becomes concentrated mostly upon the ball joints of the toes, and with a small amount upon the toes themselves, and distributed throughout the entire forward sole section.

During the other relevant stage of the walking cycle, when the sandal-wearer's leading foot is engaged in an airborne step forward, the heel of the trailing foot arcs upward above the sand in anticipation of that foot being lifted up off the soft sand, and thrust forward in the air toward its next step. During this arcing action of the heel, the rear sole section's elastic foot-strap assembly keeps the rear sole section pulled snugly up beneath the sole of the sandal-wearer's shoe as the heel reaches its maximum angle upward.

And, because of the flexibly-hinged, three-part, rigid-sole system, the heel's arcing action leaves the forward sole section of the sandal completely undisturbed, and positioned firmly and flatly upon the soft sand, supporting the body's full weight until that weight is removed when it shifts forward to the opposite foot. When the leading foot strikes the soft sand ahead, at the completion of its airborne step forward, the body's full weight is instinctively shifted off of the trailing foot, totally forward to the leading foot.

During the two stages of the walking cycle listed above, the three sole sections are each positioned firmly and flatly upon the soft sand for the entire time that they are supporting any significant amount of body weight, thereby nullifying the deep foot sinking that is normally caused by the angle of the sandal-wearer's foot. The body weight part of the foot-sinking problem is lessened by the entire sole system being designed with an extra width of 0.75 inch to 1.5 inches, more or less. This causes the body-weight pressure per-square-inch of sandal sole surface area to be significantly reduced, which correspondingly results in even less foot sinking. The small amount of foot sinking that remains is totally insignificant.

These and other features of the present invention will become readily apparent upon further review of the following specification and drawings.

BRIEF DESCRIPTION OF THE DRAWINGS

Similar reference characters denote corresponding features consistently throughout the attached drawings.

LIST OF REFERENCE NUMBERS UTILIZED IN THE DRAWINGS

Figure 1:
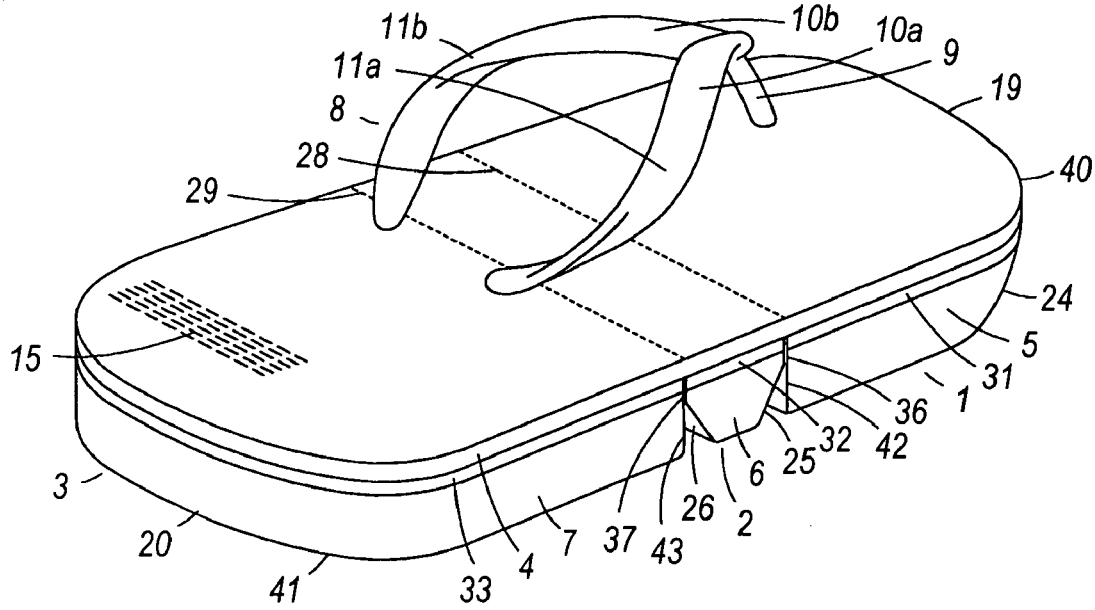
FIG. 1 is a perspective view of the right foot sandal facing to the right, as seen from the top, right rear of the sandal.
Figure 2:
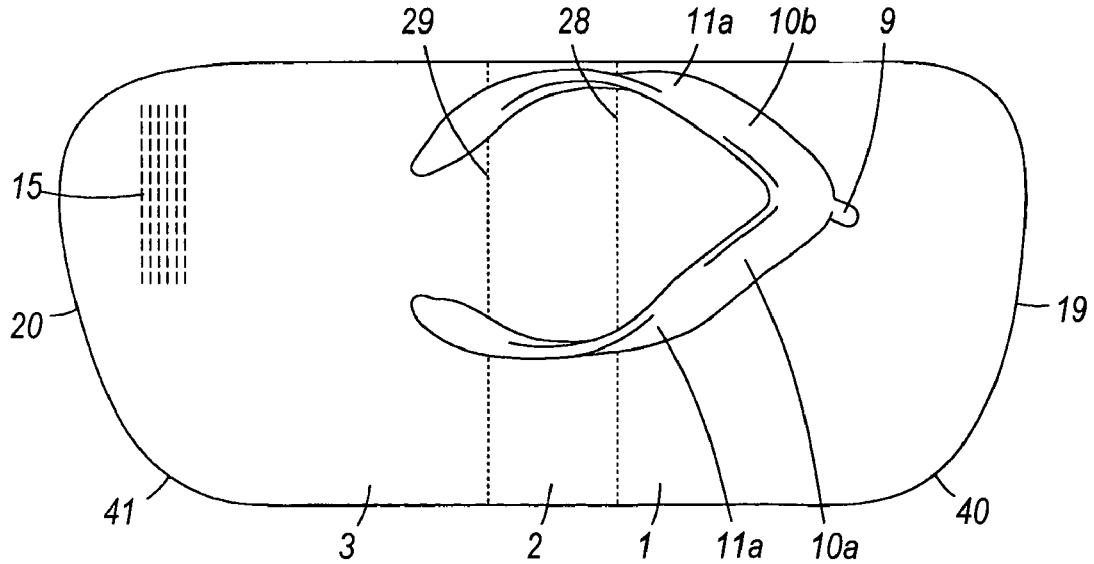
FIG. 2 is an overhead view of the right foot sandal facing to the right and showing the exterior surfaces only.

1. The forward sole section.

2. The middle sole section.

3. The rear sole section.

4. The top sole layer of all three sole sections 1, 2, 3.

5. The bottom sole layer of the forward sole section 1.

6. The bottom sole layer of the middle sole section 2.

7. The bottom sole layer of the rear sole section 3.

8. The sandal thong.

9. The portion of the thong 8 that is positioned in the crook between the largest toe and adjacent toe of the sandal-wearer's foot.

10*a*. The right side portion of the divided thong strap that extends across the top, right, front portion of the foot's instep.

10*b*. The left side portion of the divided thong strap that extends across the top, left, front portion of the foot's instep.

11*a*. The right side portion of the divided thong strap that extends around the right side portion of the foot's instep.

11*b*. The left side portion of the divided thong strap that extends around the left side portion of the foot's instep.

12*a*. The forward end of the thong 8 that anchors into the middle sole layer 31 of the forward sole section 1.

12*b*. The right rear end of the thong 8 that anchors into the middle sole layer 33 of the rear sole section 3.

12*c*. The left rear end of the thong 8 that anchors into the middle sole layer 33 of the rear sole section 3.

13. The aperture in the top sole layer 4 for allowing passage of the forward, portion 9 of the thong 8.

14*a*. The right, rear aperture in the top sole layer 4 for allowing passage of the divided, thong strap ending located on the right, rear side.

14*b*. The left, rear aperture in the top sole layer 4 for allowing passage of the divided, thong strap ending located on the left, rear side.

15. The convexly-embossed, heel position indicator.

16. The area of body weight pressure located beneath the heel of the foot.

17. The area of body weight pressure located beneath the ball joints of the toes.

18. The area of body weight pressure located beneath the toes.

19. The slightly angled, leading end of the forward sole section 1 (laterally).

20. The slightly angled, trailing end of the rear sole section 3 (laterally).

21. The flexible hinge layer (thin rubber-like material).

22. The alternate flexible hinge layer (strong, flat, fabric-like layer) (not shown)(same shape as top sole layer).

23. The cavity for containing the flexible hinge 21.

24. The tapered thickness of the leading end of the forward sole section 1.

25. The leading end, angled thickness of the middle sole section 2.

26. The trailing end, angled thickness of the middle sole section 2.

27. The cross-sectional outline indication of a sandal-wearer's leg cut just above the ankle.

28. The hidden line of separation between the forward sole section 1 and the middle sole section 2.

29. The hidden line of separation between the middle sole section 2 and the rear sole section 3.

30. The tread ribs equally spaced across the entire bottom surface of the three-part bottom sole layer 5, 6, 7.

31. The middle sole layer of the forward sole section 1.

32. The middle sole layer of the middle sole section 2.

33. The middle sole layer of the rear sole section 3.

34*a*. The weight-reducing cavities of the three-part middle sole layer 31, 32, 33.

34*b*. The weight-reducing cavities of the three-part bottom sole layer 5, 6, 7.

35*a*. The cavity in the forward section of the middle sole layer 31 for anchoring the forward end 12*a* of the thong 8.

35*b*. The cavity in the rear section 33 of the middle sole layer 31, 32, 33 for anchoring the right rear end 12*b* of the thong 8.

35*c*. The cavity in the rear section 33 of the middle sole layer 31, 32, 33 for anchoring the left rear end 12*c* of the thong 8.

36. The leading end (vertical portion) of the middle sole section 2 that butts against the trailing end 42 of the forward sole section 1.

37. The trailing end (vertical portion) of the middle sole section 2 that butts against the leading end 43 of the rear sole section 3.

38. The triangular, wedge-shaped cutouts of the middle sole section 2.

39. The triangular, wedge-shaped protrusions created in the middle sole section 2 by the wedge-shaped cutouts 38.

40. The curved, right front corner of the forward sole section 1.

41. The curved right rear corner of the rear sole section 3.

42. The rear end of the forward sole section 1.

43. The leading end of the rear sole section 3.

101. The forward sole section.

102. The middle sole section.

103. The rear sole section.

104. The forward flexible hinge.

105. The rear flexible hinge.

106. The heel back stop.

107. The forward foot-strap assembly.

108. The rear foot-strap assembly.

109. The sole tread ridges.

110*a*. The curved, forward, outer corner of the forward sole section 1, as seen from above.

110*b*. The curved, forward, inner corner of the forward sole section 1, as seen from above.

111*a*. The curved, rear, outer corner of the rear sole section 103, as seen from above.

111*b*. The curved, rear, inner corner of the rear sole section 103, as seen from above.

112. The wide elastic strap of the two foot-strap assemblies 107, 108.

113*a*. The adjustable buckle of the two foot-strap assemblies 107, 108.

113*b*. The cross-sectional thickness of the adjustable buckle 113*a* of the two foot-strap assemblies 107, 108.

114*a*. The donut-shape portion of the forward stud-mate attachments 117*a* for the forward stationary foot-strap anchors 119*a*.

114*b*. The donut-shape portion of the rear stud-mate attachments 118*a* for the rear stationary foot-strap anchors 119*b*.

115*a*. the donut-shape portion of the forward stud-mate attachments 117*b* for the forward adjustable foot-strap anchors 120*a*.

115*b*. the donut-shape portion of the rear stud-mate attachments 118*b* for the rear adjustable foot-strap anchors 120*b*.

117*a*. The forward stud-mate attachment for the forward stationary foot-strap assembly 119*a*.

117*b*. The forward stud-mate attachment for the forward adjustable foot-strap anchor 120*a*.

118*a*. The rear stud-mate attachment for the rear stationary foot-strap anchor 119*b*.

118*b*. The rear stud-mate attachment for the rear adjustable foot-strap anchor 120*b*.

119*a*. The forward stationary foot-strap anchor.

119*b*. The rear stationary foot-strap anchor.

120*a*. The forward adjustable foot-strap anchor.

120*b*. The rear adjustable foot-strap anchor.

121. The hooked stud portion of the forward stationary foot-strap anchor 119*a* and the rear stationary foot-strap anchor 119*b*.

122. The hooked stud portion of the forward adjustable foot-strap anchor 120*a* and the rear adjustable foot-strap anchor 120*b*.

123. The angled, and slightly curved, forward end of the forward sole section 101, as seen from above.

124. The angled, and slightly curved, rear end of the rear sole section 103, as seen from above.

125. The angled, and slightly curved, forward end of the forward sole section 101, as seen from a side view.

126. The angled, rear end of the forward sole section 101, as seen from a side view.

127. The angled, forward end of the middle sole section 102, as seen from a side view.

128. The angled, rear end of the middle sole section 102, as seen from a side view.

129. The angled, forward end of the rear sole section 103, as seen from a side view.

130*a*. The cavity provided to accommodate the anchoring tongue and T-arm protrusion 133 of the forward adjustable foot-strap anchor 120*a*.

130*b*. The cavity provided to accommodate the anchoring tongue and T-arm protrusion 133 of the rear adjustable foot-strap anchor 120*b*.

131*a*. The recessed shoulder provided for flushly seating the cover plug 154 of the cavity 130*a* provided to accommodate the anchoring tongue and T-arm protrusion 133 of the forward adjustable foot-strap anchor 120*a*, as seen from the bottom surface of the sole.

131 *b*. The recessed shoulder provided for flushly seating the cover plug 154 of the cavity 130*b* provided to accommodate the anchoring tongue and T-arm protrusion 133 of the rear adjustable foot-strap anchor 120*b*, as seen from the bottom surface of the sole.

132. The toe-position indicator that identifies the specified area where the toe end of the shoe needs to be positioned.

133. The side view of the anchoring tongue and T-arm protrusion of the forward adjustable foot-strap anchor 120*a*, and of the rear adjustable foot-strap anchor 120*b*, provided for securing both anchors 120*a*, 120*b* to the sole.

134*a*. The anchoring tongue protrusion provided for securing the forward stationary foot-strap anchor 119*a* to the forward sole section 101.

134*b*. The anchoring tongue protrusion provided for securing the rear stationary foot-strap anchor 119*b* to the rear sole section 103.

134*c*. The locking arm for securing the two stationary foot-strap anchors 119*a*, 119*b* to their respective cavities 135 in their respective sandal sole sections 101, 102.

135*a*. The cavity provided to accommodate the anchoring tongue protrusion and locking arm 134*a*, 134*b* of the two stationary foot-strap anchors 119*a*, 119*b*.

135*b*. The cross-sectional side view of the cavity 135*a* provided to accommodate the anchoring tongue protrusion and locking arm 134*a*, 134*b* of the two stationary foot-strap anchors 119*a*, 119*b*.

136. The recessed shoulder provided for flushly seating the cover plug 172 of the cavity designed to accommodate the anchoring tongue protrusion 134*a*, 134*b* and locking arm 134*c* of the two stationary foot-strap anchors 119*a*, 119*b*, as seen from the bottom surface of the sole.

137. The small, thin ridges that minimize the friction between the sandal sole surfaces and the two adjustable foot-strap anchors 120*a*, 120*b* and their anchoring tongue and T-arm protrusions 133.

139. The locking arm of the forward adjustable foot-strap anchor 120*a*, and of the rear adjustable foot-strap anchor 120*b* for securing the lateral positioning of the anchor.

140. The locking-arm stud of the locking arm 139 of the forward adjustable foot-strap anchor 120*a*, and of the rear adjustable foot-strap anchor 120*b*, for securing the lateral positioning of the anchor.

141. The thumb-grip flange of the locking arm 139 of the forward adjustable foot-strap anchor 120*a*, and of the rear adjustable foot-strap anchor 120*b*, utilized for engaging and disengaging the locking arm 139 and locking arm stud 140 of the two anchors 120*a*, 120*b*.

142. The snap-lock stud for securing the locking arm 139 of the forward adjustable foot-strap anchor 120*a*, and of the rear adjustable foot-strap anchor 120*b*.

143. The cylindrical hinge-pin of the locking arm 139 portion of the forward adjustable foot-strap anchor 120*a*, and of the rear adjustable foot-strap anchor 120*b*.

145. The gray silhouette of the sandal-wearer's shoe identifying its correct positioning upon the sandal, as seen from above.

146. The cylindrical cavity-sleeve for accommodating the cylindrical hinge 143 of the locking arm 139 of the forward adjustable foot-strap anchor 120*a*, and of the rear adjustable foot-strap anchor 120*b*.

147. The locking-arm shoulder of the locking arm 139 of the forward adjustable foot-strap anchor 120*a*, and of the rear adjustable foot-strap anchor 120*b*.

148. The pressure-activated, snap-lock flange of the two stationary foot-strap anchors 119*a*, 119*b* for use in preventing the accidental disengagement of the stud-mate attachments when the sandal is not in use.

149. The serrated edges of the adjustable buckle 113*a* where the wide, elastic strap 112 loops around 90-degree plus angled edges.

150. The cross-sectional thickness of the sandal sole.

151*a*. The cross-sectional thickness of the donut-shape portion 114*a*, 114*b* of the inner forward stud-mate attachment 117*a*, and of the inner rear stud-mate attachment 118*a*, shown in their pressure-locked position beneath the hooked studs 121 of the two stationary foot-strap anchors 119*a*, 119*b*.

151*b*. The cross-sectional thickness of the donut-shape portion 115*a*, 115*b* of the outer forward stud-mate attachment 117*b*, and of the outer rear stud-mate attachment 118*b*, shown in their pressure-locked position beneath the hooked studs 122 of the two adjustable foot-strap anchors 120*a*, 120*b*.

152*a*. The cavity provided to accommodate the locking-arm stud protrusion 140 of the locking arm 139 of the forward adjustable foot-strap anchor 120*a*.

152*b*. The cavity provided to accommodate the locking-arm stud protrusion 140 of the locking arm 139 of the rear adjustable foot-strap anchor 120*b*.

153*a*. The vertical cross-sectional thickness of the forward stud-mate attachment 117*a* of the forward stationary foot-strap anchor 119*a*, as identified by line B-B of FIG. 20C.

153*b*. The horizontal cross-sectional thickness of the forward stud-mate attachment 117*a* of the forward stationary foot-strap anchor 119*a*, as identified by line A-A of FIG. 20C.

153*c*. The vertical cross-sectional thickness of the rear stud-mate attachment 118*a* of the rear stationary foot-strap anchor 119*b*, as identified by line B-B of FIG. 20D.

153*d*. The horizontal cross-sectional thickness of the rear stud-mate attachment 118*a* of the rear stationary foot-strap anchor 119*b*, as identified by line A-A of FIG. 20D.

153*e*. The vertical cross-sectional thickness of the forward stud-mate attachment 117*b* of the forward adjustable foot-strap anchor 120*a*, as identified by line B-B of FIG. 20A.

153*f*. The horizontal cross-sectional thickness of the forward stud-mate attachment 117*b* of the forward adjustable foot-strap anchor 120*a*, as identified by line A-A of FIG. 20A.

153*g*. The vertical cross-sectional thickness of the rear stud-mate attachment 118*b* of the rear adjustable foot-strap anchor 120*b*, as identified by line B-B of FIG. 20B.

153*h*. The horizontal cross-sectional thickness of the rear stud-mate attachment 118*b* of the rear adjustable foot-strap anchor 120*b*, as identified by line A-A of FIG. 20B.

154. The cross-sectional side view of the flushly recessed cover plug that is bonded over each of the two cavities 161 that are provided to accommodate the anchoring tongue and T-arm protrusion 133 of the forward adjustable foot-strap anchor 120*a*, and of the rear adjustable foot-strap anchor 120*b*, respectively.

155. The foam rubber padding for the heel back stop 106.

156. The main-body portion of the heel back stop 106.

157. The anchoring tongue protrusion of the heel back stop 106.

158. The cross-sectional side view of the underneath side of the top lip of the cavity 130*a*, 130*b*, 161 provided for securing the anchoring tongue and T-arm protrusion 133 of the forward adjustable foot-strap anchor 120*a*, and the rear adjustable foot-strap anchor 120*b* within the cavity.

159. The locking arm for securing the heel back stop mechanism 106 within the cavity 160*a* provided in the rear sole section 3.

160*a*. The cross-sectional view of the cavity in the rear sole section 3 designed to accommodate the anchoring tongue protrusion 157 and locking arm 159 of the heel back stop 106, as identified by line A-A of FIG. 18D.

160*b*. The cavity in the rear sole section 3 designed to accommodate the anchoring tongue protrusion 157 and locking arm 159 of the heel back stop 106.

161. The cross-sectional side view of the cavity provided to accommodate the anchoring tongue and T-arm protrusion 133 of the forward adjustable foot-strap anchor 120*a*, and of the rear adjustable foot-strap anchor 120*b*.

162. The cross-sectional side view of the cavity provided to accommodate the locking-arm stud protrusion 140 of the locking arm 139 of the forward adjustable foot-strap anchor 120*a*, and of the rear adjustable foot-strap anchor 120*b*.

165. The cavity provided to allow a screwdriver to forcibly extract the heel back stop mechanism 106, if replacement becomes necessary.

166. The cavity provided to allow a screwdriver to forcibly extract the stationary foot-strap anchors 119*a*, 119*b*, if replacement becomes necessary.

167. The walking/jogging sneaker of the sandal wearer.

168. The space separating each of the three sole sections 101, 102, 103 when connected end-to-end by the two, flexible hinges 104, 105, as it exists along the top surface of the three sole sections 101, 102, 103.

169. The clasp provided to hold the wide, elastic strap loosely and flatly together.

170. The clips provided to secure the long and wide foam rubber pad 171 in its proper position beneath the rear foot-strap assembly 108 where it extends across the top of the foot's instep.

171. The foam rubber strip that provides padding beneath the rear foot-strap assembly 108 where it extends across the top portions of the foot's instep and shoe.

172. The cross-sectional view of the flushly recessed cover plug that is bonded over the cavity 135 provided to accommodate the anchoring tongue protrusion 134*a*, 134*b* of the forward stationary foot-strap anchor 119*a*, and the rear stationary foot-strap anchor 119*b*.

173. The sub-surface, pressure-activated arm for pushing the anchoring tongue and T-arm protrusion 133 of the forward adjustable foot-strap anchor 120*a* and the rear adjustable foot-strap anchor 120*b* forward beneath the lip of the cavity 130*a* & 130*b*, 161 to keep the anchors engaged within the cavity.

174. The cross-sectional side view of the flushly recessed cover plug that is bonded over the cavity 160*a*, 160*b* provided to accommodate the anchoring tongue protrusions 157 and locking arm 159 of the heel back stop 106.

175. The recessed shoulder provided for flushly seating the cover plug 74 of the cavity 160*b* provided to accommodate the anchoring tongue protrusion 157 and locking arm 159 of the heel back stop 106.

DETAILED DESCRIPTION OF THE PREFERRED EMBODIMENTS

The first embodiment of the present invention, as shown in FIGS. 1 through 8F, is comprised of a conventional thong 8 and a flexibly-hinged, three-part, rigid sole system 1, 2, 3, which has extra sole length added behind the sandal-wearer's heel. These features interact to enable the employment of inverted mechanical leverage to eliminate deep foot sinking and thong pressure discomfort, both of which are long-time deficiencies of conventional rigid sole sandals and clogs when engaging in full-stride walking on very soft sand. The three-part sole 1, 2, 3 is also designed extra-wide to reduce foot sinking even more, by lowering the amount of body weight supported per-square-inch of sole. A combination of the inverted mechanical leverage action and the extra sole width virtually eliminates the deep foot sinking problem; and the flexibly-hinged, three-part sole 1, 2, 3 virtually eliminates the thong pressure discomfort problem.

The inverted mechanical leverage principles being employed in the present invention relate to the commonly understood use of a long, rigid beam to lift a very heavy object by placing one end of the rigid beam under the object, and placing a rock, or other supporting fulcrum, beneath the beam at a point less than half the length of the beam away from the object. The mechanical leverage action created causes the heavy object to be lifted when downward pressure is applied at the opposite end of the beam. The mechanical leverage action causes the energy expended to lift the heavy object to be less than the energy required to lift the heavy object without the assistance of mechanical leverage. The energy advantage of this leverage example is not particularly significant to the present invention, but the basic mechanical leverage action is. With the present invention, the leverage action being employed is inverted mechanical leverage, with the forward sole section 1 and the rear sole section 3 of the sandal acting as two independent, flat levers joined lengthwise by a flexible hinge 21 and a middle sole section 2. The sandal-wearer's heel and ball joints of the toes (and the toes themselves) each act as weighted fulcrums for their respective sole sections 1 & 3—see FIGS. 8A-8F. The pressure from the sandal-wearer's body weight, when applied as a weighted fulcrum by the ball joints of the toes, and the toes themselves, to the forward sole section 1, and when applied by the sandal-wearer's heel to the rear sole section 3 forces each sole section 1, 3 to lie down firmly and flatly upon the soft sand. The pressure of the sandal-wearer's body weight then holds the affected sole section 1, 3 firmly and flatly upon the soft sand until the body weight pressure is removed. The use of inverted mechanical leverage in the functioning of the present invention is the primary intellectual property for which a patent is being sought.

The functioning of the present invention and a detailed description of the various component parts that make it possible are explained in the paragraphs below, and are accompanied by detailed mechanical drawings for reference.

The flexibly-hinged, three-part, rigid sole system 1, 2, 3 is comprised of three, flexibly-hinged, rigid sole sections 1, 2, 3, hereafter referred to as the forward sole section 1, the middle sole section 2, and the rear sole section 3. The three sole sections 1, 2, 3 are aligned one after the other in a linear fashion from front to rear. The flexible hinge 21 that joins the three sole sections 1, 2, 3 is designed to allow the sections to arc upward, in their relationship to one another, much like the stiff cardboard pages of a baby's picture book when it is lying open on a flat surface FIG. 8E, but does not allow downward movement when any two or three of the sole sections are positioned in a common plane FIG. 8F.

Figure 8A:
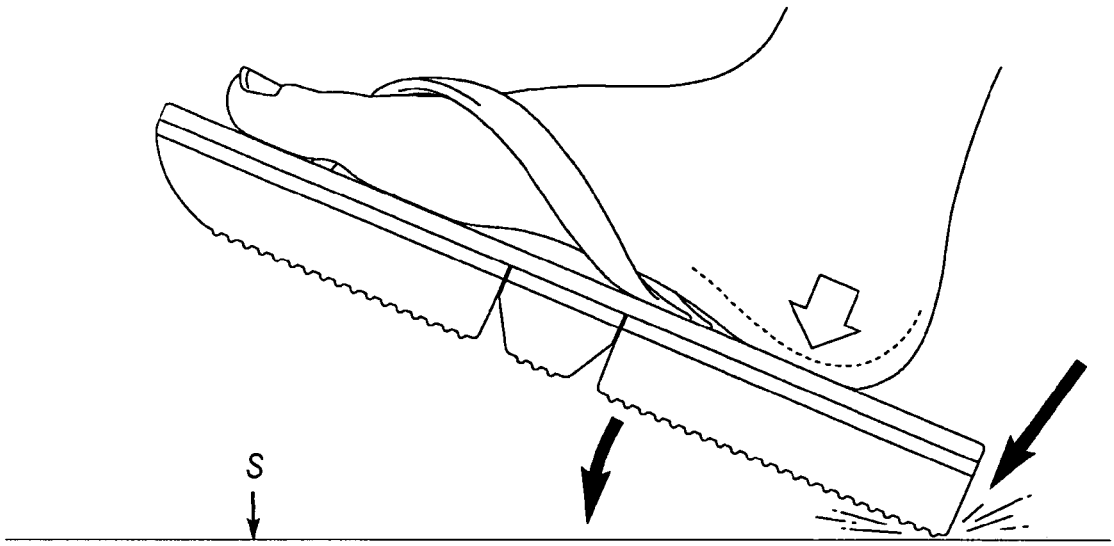
FIG. 8A is the first drawing of a 6-part sequence FIGS. 8A, 8B, 8C, 8D, 8E and 8F depicting the various stages of a full-stride walking cycle. This drawing depicts the right foot sandal configuration at the moment that it first touches the surface of the soft sand after having been thrust forward in the air toward a new step.
Figure 8B:
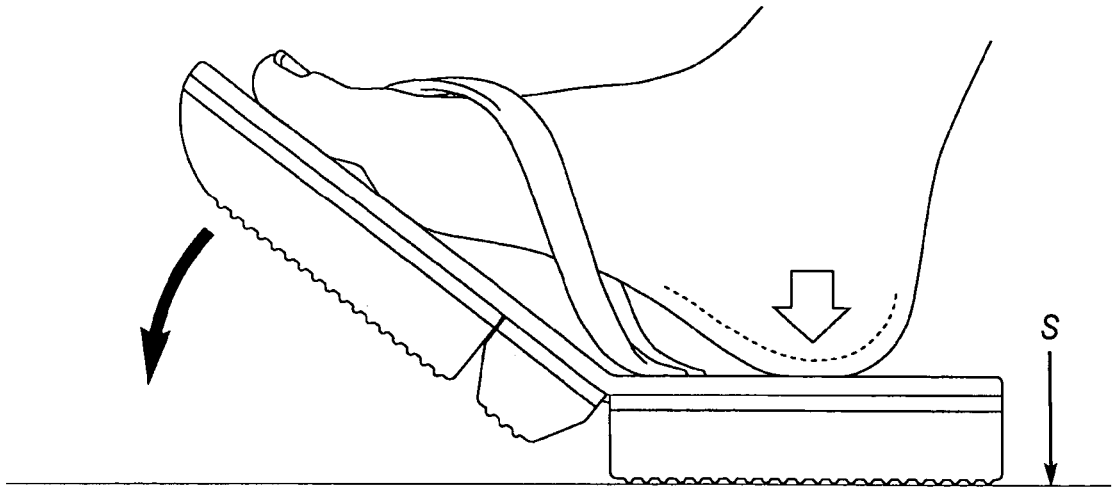
FIG. 8B is the second drawing of a 6-part sequence FIGS. 8A, 8B, 8C, 8D, 8E and 8F depicting the various stages of a full-stride walking cycle. This drawing depicts the right foot sandal configuration a split second after the back end of the rear sole section strikes the surface of the soft sand.
Figure 8C:
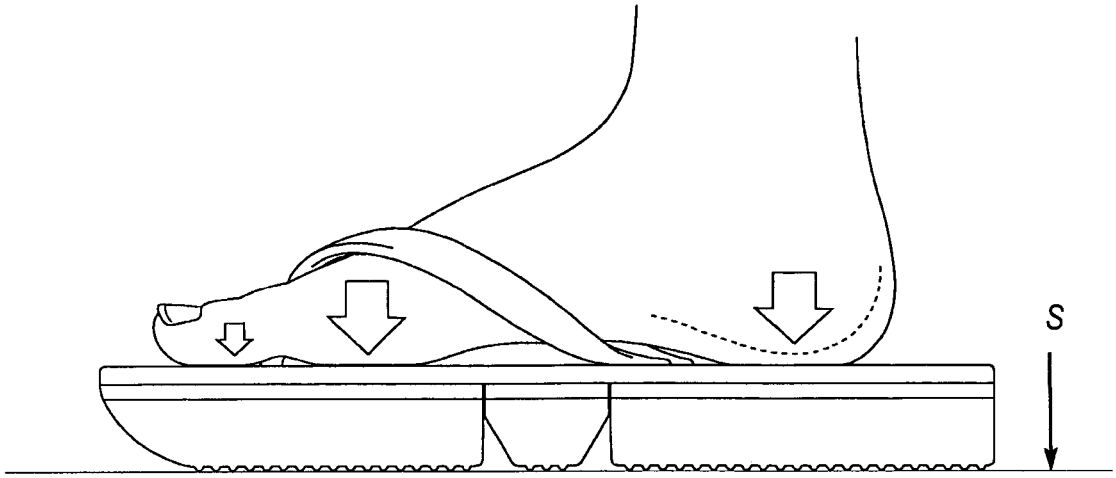
FIG. 8C is the third drawing of a 6-part sequence FIGS. 8A, 8B, 8C, 8D, 8E and 8F depicting the various stages of a full-stride walking cycle. This drawing depicts the right foot sandal configuration the moment after roughly half, of the sandal-wearer's body weight has shifted from the heel of the foot, forward to the ball joints of the toes, and a small amount to the toes themselves.
Figure 8D:
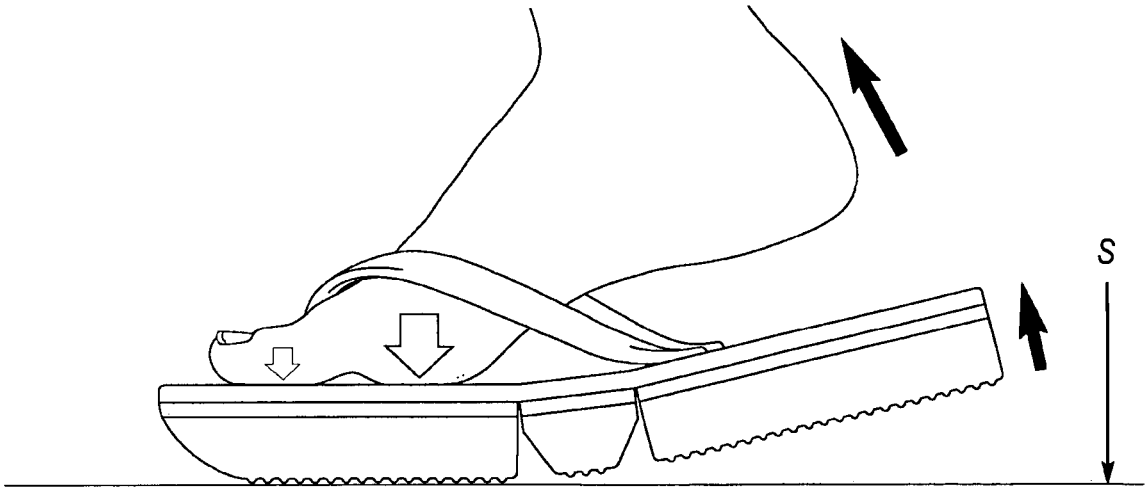
FIG. 8D is the fourth drawing of a 6-part sequence FIGS. 8A, 8B, 8C, 8D, 8E and 8F depicting the various stages of a full-stride walking cycle. This drawing depicts the right foot sandal configuration just after the foot's heel has begun its arc upward, away from the back portion of the sandal's rear sole section.
Figure 8E:
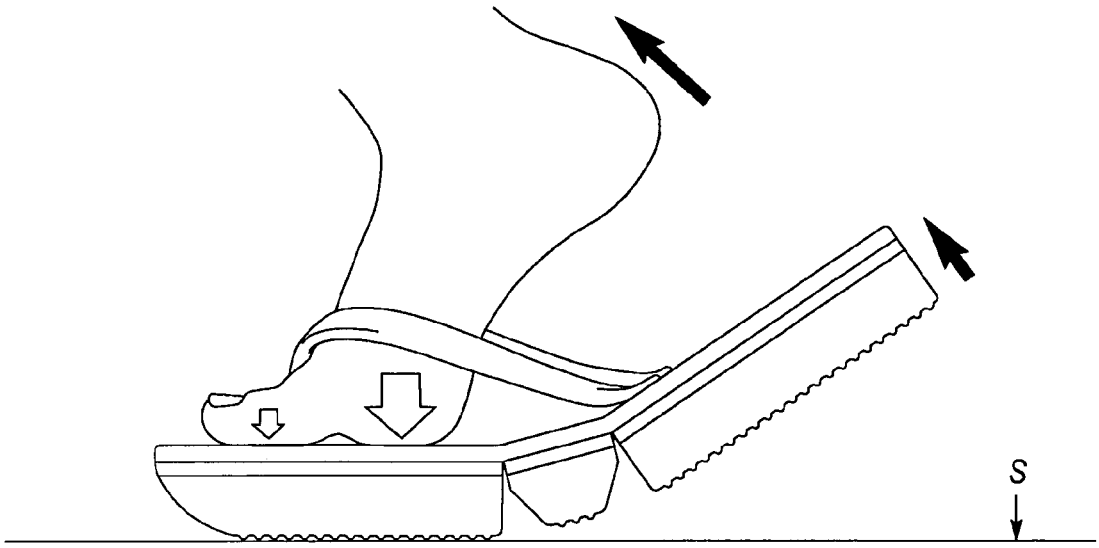
FIG. 8E is the fifth drawing of a 6-part sequence FIGS. 8A, 8B, 8C, 8D, 8E and 8F depicting the various stages of a full-stride walking cycle. This drawing depicts the right foot sandal configuration as the foot's heel is reaching the highest point of its arc upward as the sandal-wearer's upper body continues its move forward toward the next step being taken by the opposite foot.
Figure 8F:
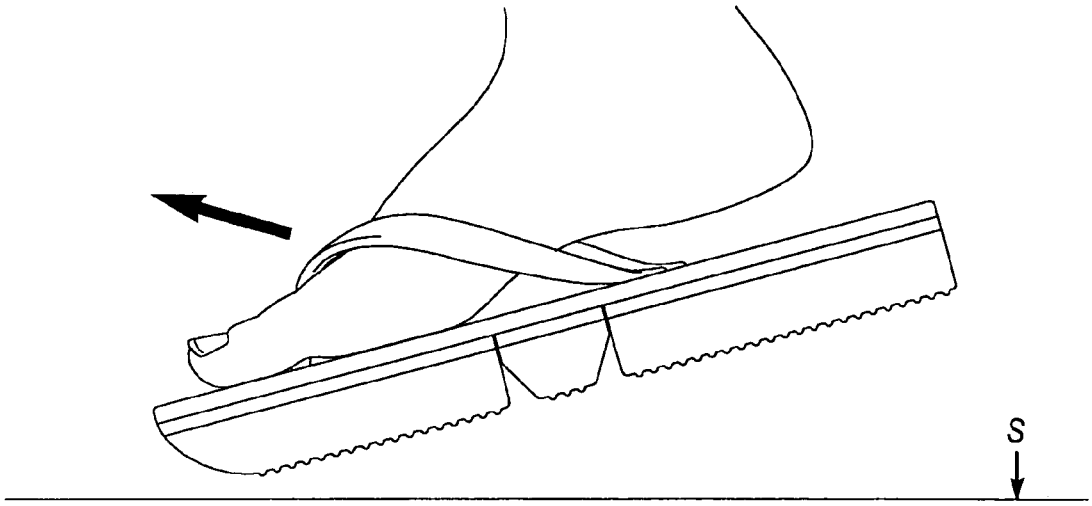
FIG. 8F is the sixth drawing of a 6-part sequence FIGS. 8A, 8B, 8C, 8D, 8E and 8F depicting the various stages of a full-stride walking cycle. This drawing depicts the right foot sandal configuration just after all of the body's weight has instinctively shifted forward to the opposite foot, as it is lifted up into the air, above the soft sand, during the initial phase of its thrust forward toward a new step.
Figure 9:
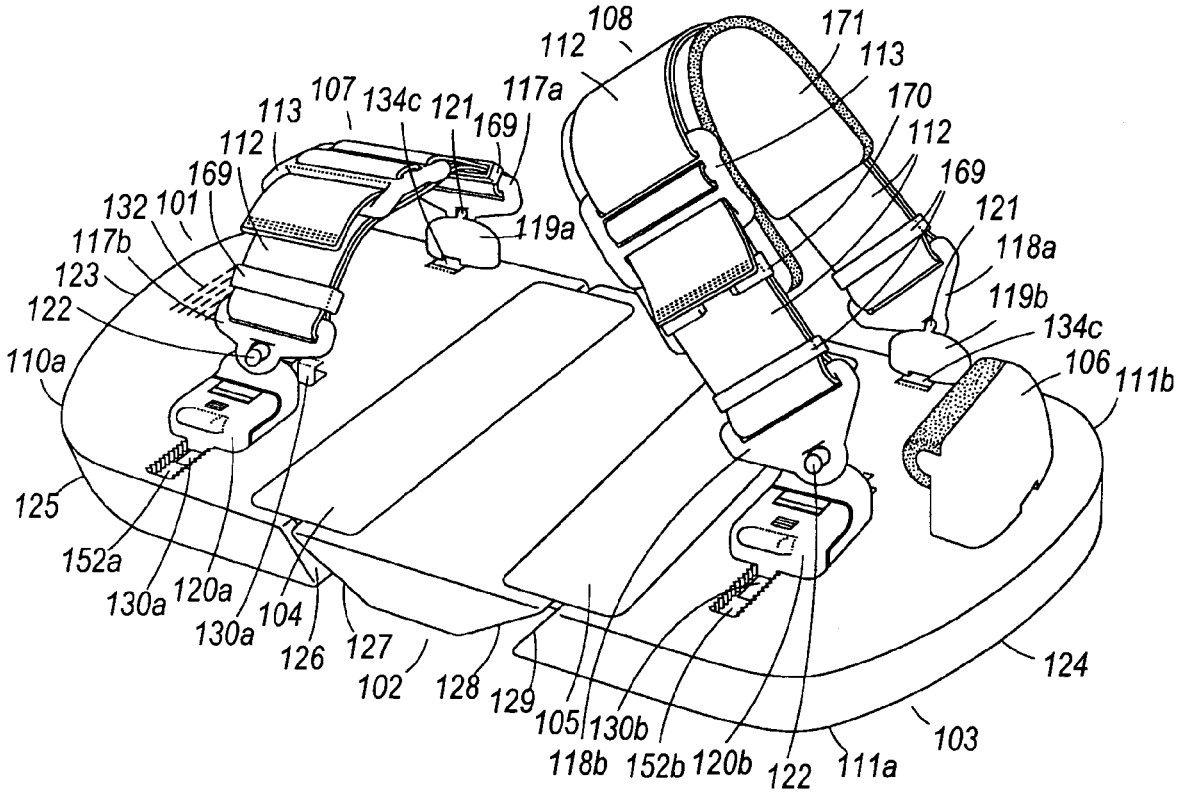
FIG. 9 is a perspective rear view of an alternative embodiment of a left foot sandal facing to the left, as seen from the top, left, rear of the sandal.
Figure 10:
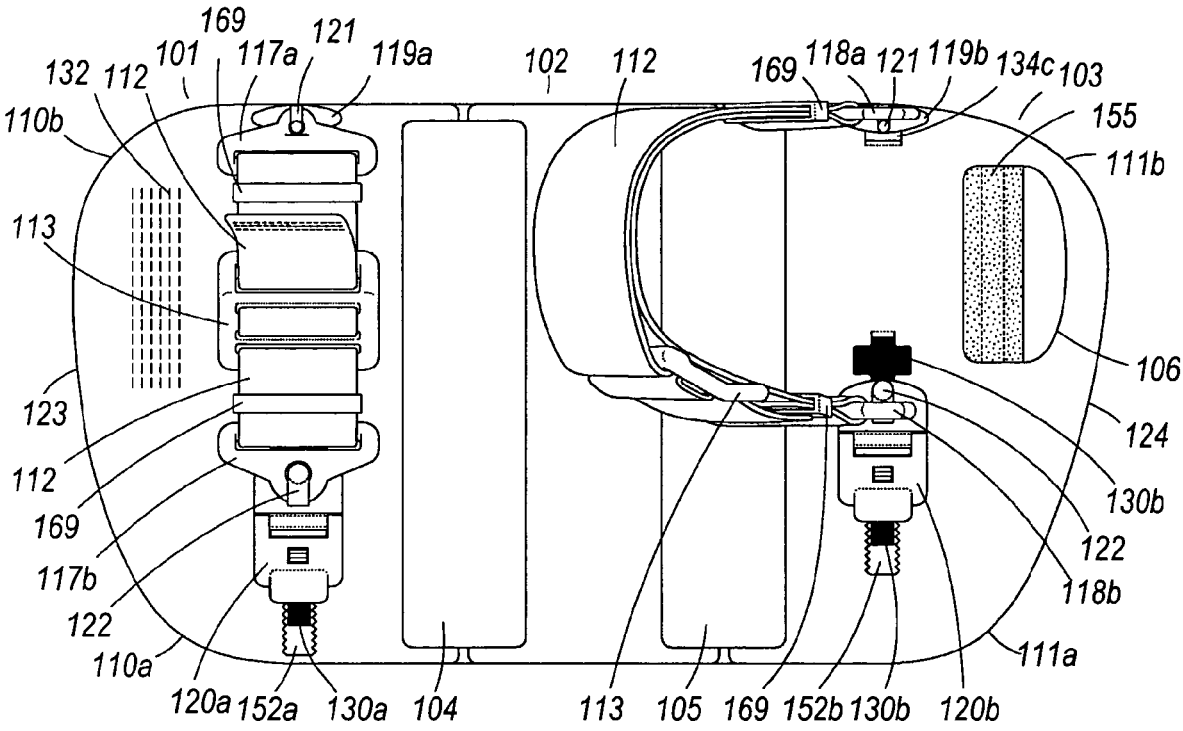
FIG. 10 is an overhead view of the left foot sandal facing to the left and showing the exterior surfaces and dashed-line indications of some non-surface portions.
Figure 11:
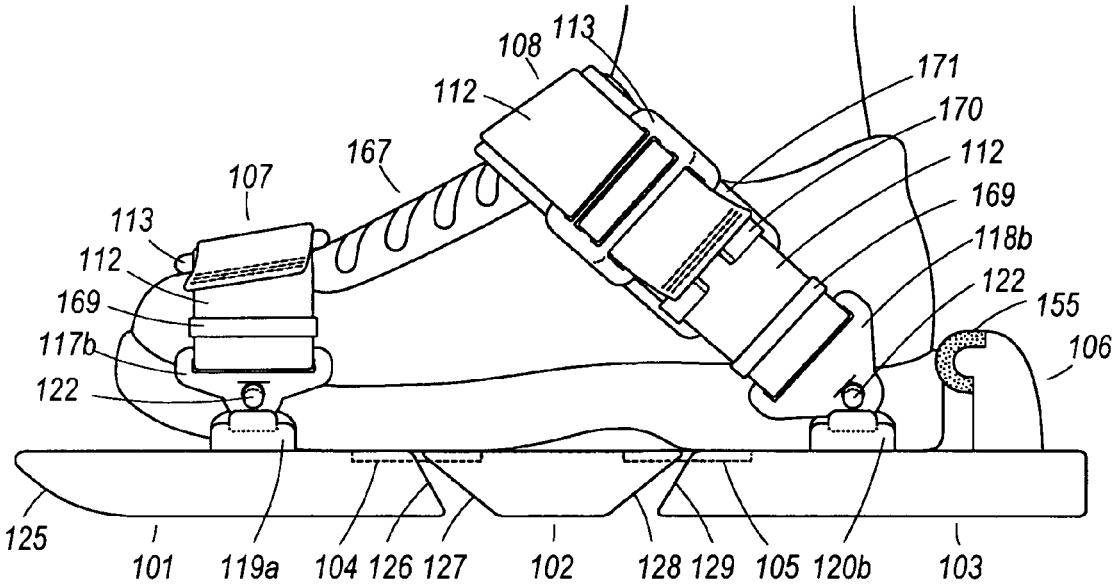
FIG. 11 is a side elevation view of the left foot sandal showing the sandal-wearer's shoe, strapped into position upon the sandal.

When the three sole sections 1, 2, 3 are positioned in the same plane FIG. 8F, downward movement is restricted by the butting together 42, 36, 37, 43 of the thicknesses of the three sole sections 1, 2, 3 that occur beneath the flexible hinge 21. The butting is needed to keep the three sole sections 1, 2, 3 within the same plane when the sandal-wearer's foot and sandal are airborne, to prevent the rear sole section 3 and middle sole section 2 from hanging down below the plane of the forward sole section 1 due to gravitational forces. The three sole sections 1, 2, 3 are designed with extra width FIG. 3 (roughly 0.75 to 1.5 inches) added to the outer side of the each sandal to increase their overall square-inch sole surface areas in an effort to reduce the amount of body weight supported per square inch of sole. The additional sole width is asymmetrically added to the right side of the right foot sandal, and to the left side of the left foot sandal, as opposed to equal amounts being added to both sides of each foot. By not adding any extra sole width to the inner sides of the feet, it allows the sandal-wearer's feet, when walking, to operate just as closely together as they normally do when wearing conventional shoes and sandals, which is crucial for carefree and comfortable walking.

The amount of extra sole width that can be added is restricted by the amount of extra weight that the additional width creates, and also by the amount of extra sole width that market research determines is likely to be acceptable to prospective buyers. The middle sole layers 31, 32, 33 and the bottom sole layers 5, 6, 7 will have an extensive array of weight-reducing cavities 34*a*, 34*b* throughout, to help reduce the weight of the three sole sections 1, 2, 3 as much as possible, without jeopardizing the strength required of the sole system to support the weight of the heaviest sandal-wearer anticipated without any significant flexing of the sole sections 1, 2, 3.

Figure 4:
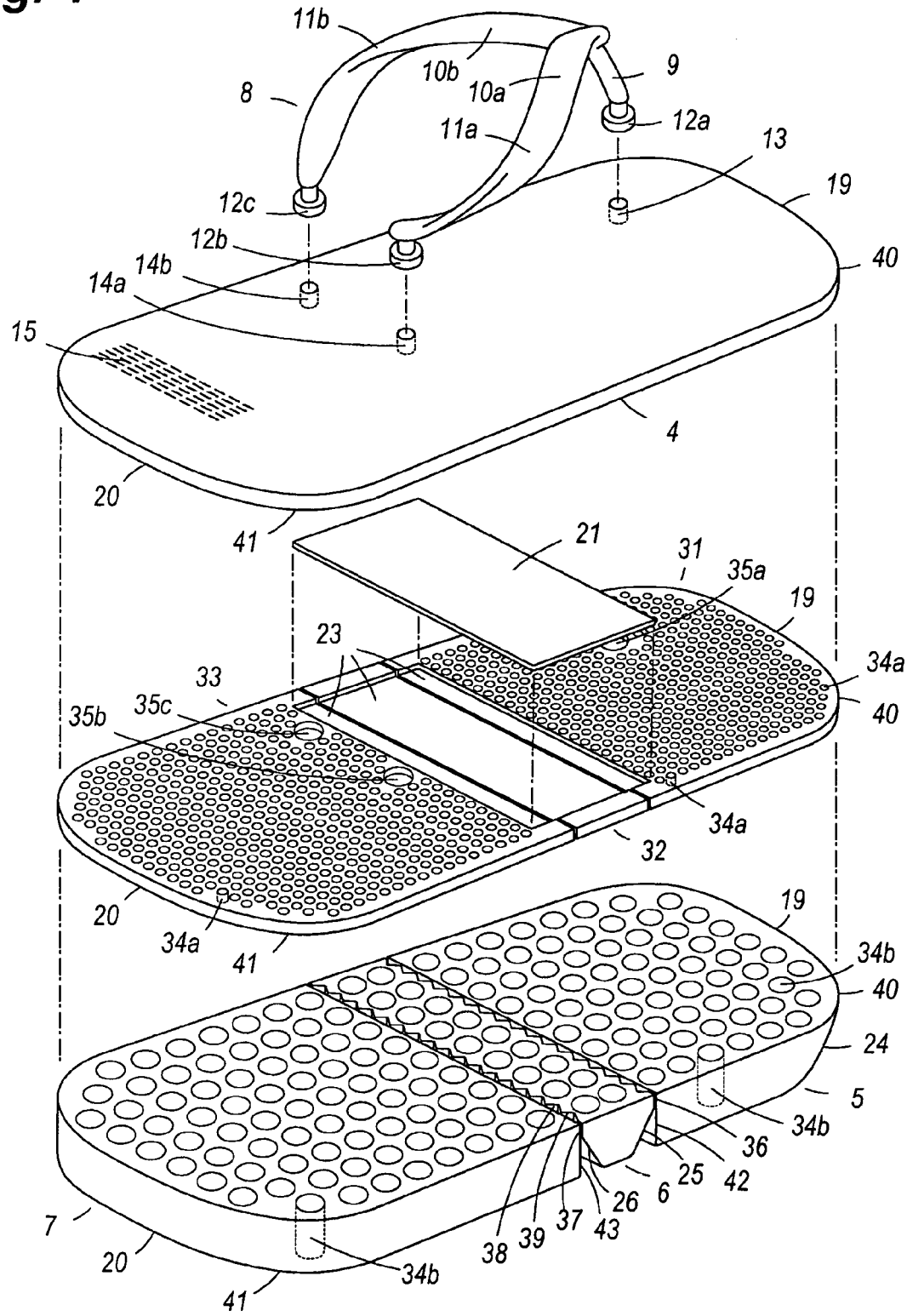
FIG. 4 is an exploded view of the right foot sandal facing to the right, as seen from the top, right, rear of the sandal, and showing the various layers of the sandal sole.
Figure 5:
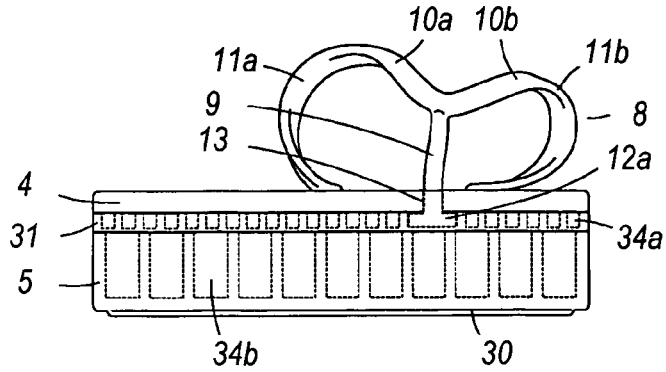
FIG. 5 is a front elevation view of the right foot sandal showing a cross-sectional view of the forward sole section, as identified by line A-A of FIG. 6.
Figure 6:
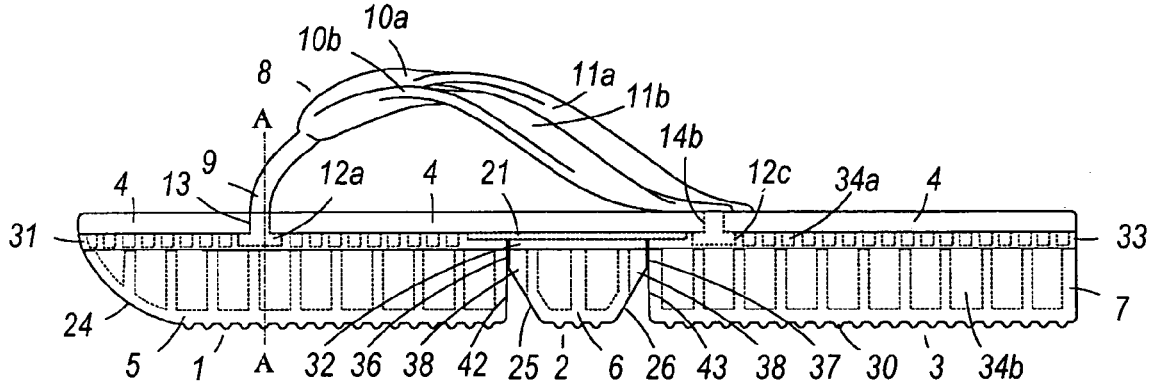
FIG. 6 is a side elevation view of the right foot sandal facing to the left that includes a cross-sectional view as identified by line B-B of FIG. 7.
Figure 7:
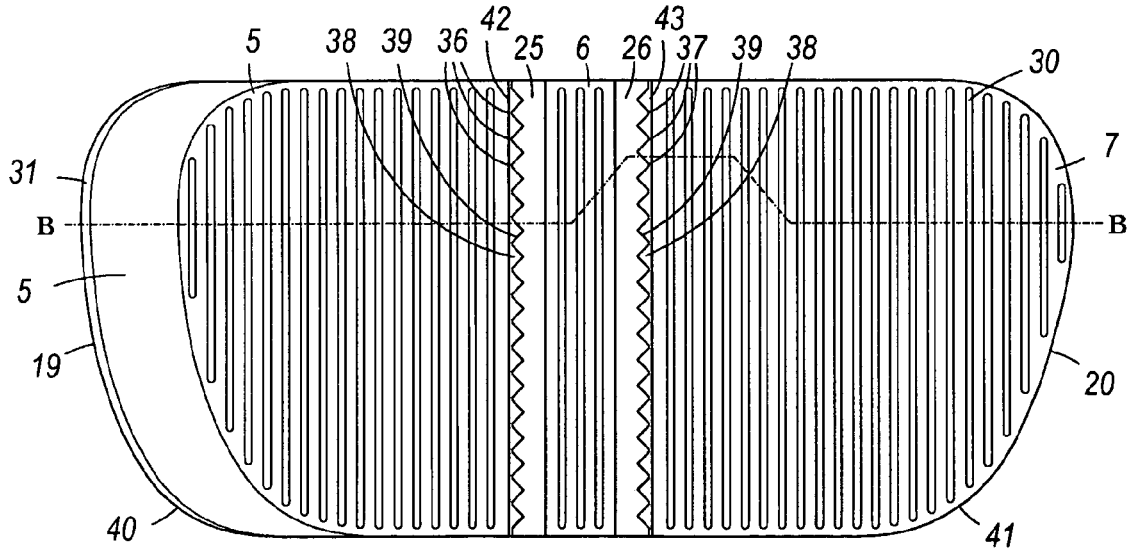
FIG. 7 is a bottom view of the right foot sandal facing to the left, showing the exterior surfaces of the sandal.

Working models of the present invention indicate that the sandal, with its extra width and increased weight, functions exactly as intended, but only when weight-reducing cavities 34*a*, 34*b* are distributed throughout the middle sole layers 31, 32, 33 and the bottom sole layers 5, 6, 7, in a similar fashion to those shown in FIGS. 4, 5, 6. It should be noted that the extra width of the sandal sole is not required for the inverted mechanical leverage action to function successful in eliminating most of the deep foot sinking that occurs during full-stride walking, but it should also be noted that any amount of additional sole width reduces the foot sinking significantly more than without it, by lowering the amount of body weight supported per-square-inch of sole. A combination of the inverted mechanical leverage action and the additional sole width (approximately 0.75 inch to 1.5 inches), causes the amount of foot sinking to be greatly reduced to the point of being totally insignificant and unnoticeable by the sandal-wearer when walking.

When the present invention is viewed from above, the leading end 19 of the forward sole section 1 of a right foot sandal is designed to angle slightly backward, from the left side of the sandal to the right side; whereas the trailing end 20 of the rear sole section 3 is designed to angle slightly forward, from the left side of the sandal to the right side. Both angles enable the sandal-wearer to make arced changes in direction, while walking, that are either large diameter arcs or moderate diameter arcs, but not small diameter arcs, which are problematic.

During small-diameter changes in direction, the front and rear outer corners 40, 41 of the sandal sole cause stability problems. With the present invention, during airborne steps forward stability is jeopardized if the outer portion of the back end 41 of the rear sole section 3 strikes the sand prior to that portion of the sole that is located directly behind the sandal-wearer's heel. No problem is created, however, if they both strike the sand simultaneously.

Conversely, when a sandal-wearer's foot is lifted up off the soft sand as it is being thrust forward toward a new step, stability is jeopardized if the outer portion 40 of the front end 19 of the forward sole section 3 lifts off the soft sand later than the portion that is located directly in front of the sandal-wearer's toes. No problem is created, however, if they both lift off the soft sand simultaneously.

The angle of the back end 20 of the rear sole section 3 has the additional function of accommodating the slight amount of flay-footedness of most people, as opposed to people with feet that are positioned precisely straight forward when walking. People with very pronounced flay-footedness, can expect to experience stability problems with the present invention, unless they take care to engage in only large-diameter directional changes, or have the angle at the rear end 20 of the rear sole section 3 increased.

The stability problem caused by small-diameter changes in direction when engaged in full-stride walking, and the sandal-wearer's inability to descend boardwalk stairways easily are the only known deficiencies of the present invention, but they are not considered serious, considering the invention's enormous advantage in eliminating deep foot sinking in very soft sand during full-stride walking.

The forward sole section 1, when viewed from the side, is designed with its front end thickness tapered 24, top to bottom, not too unlike the curve at the forward end of most conventional snow skis, to greatly reduce the fine sand spray that is flipped up into the air during each step of the walking cycle.

The middle sole section 2 is unnecessary for the sandal to function as intended, but was added primarily for marketing appeal purposes to make the sandal's mechanical action appear less extreme and, consequently, less strange looking to outside observers, by providing more flexibility to the sole system 1, 2, 3. The angular surface portion 25 of the forward end thickness of the middle sole section 2, is connected to the trailing end 42 of the forward sole section 1 by a highly-flexible hinge 21, forming a long, narrow, triangular notch between the thicknesses of the two surfaces 42, 25. The inverted, v-shaped notch 42, 25 that is formed, angles downward and backward in the direction of the rear of the sandal, starting from a point roughly midway down the thickness of the middle sole section 2, and extends down to the bottom surface of the section 2. Its function is to provide a space to accommodate the sand that squeezes out from beneath the two sole sections 1, 2 during the walking cycle. Its purpose is to prevent that sand from interfering with the clean butting of the two sole sections 1, 2 when they are positioned within the same plane.

A second inverted, v-shaped notch 26, 43 (a mirror image of the one just described) is formed between the rear end of the middle sole section 2 and the forward end of the rear sole section 3, and has the same function as the front-end notch just described. The purpose of the two points of butting between the three sole sections 1, 2, 3 is to prevent the middle sole section 2 and the rear sole section 3 from hanging down below the plane of the forward sole section 1 when the foot is lifted airborne during its thrust forward toward another step in the walking cycle FIG. 8F. The area of the butting 36, 42, 37, 43 between the three sole sections 1, 2, 3 is designed with a row of relatively small, triangular, wedge-shaped, cutout notches 38, FIGS. 7 & 8 that are located directly above the two large, inverted, v-shaped notches 36, 42, 37, 43 that are directly below the flexible hinge 21, along the front end 36 and back end 37 of the middle sole section 2.

The row of cutout notches 38 are similar in shape to the large, jagged, zigzag teeth of fabric scissors used by the clothing industry, however, these notches 38 are much thicker than the notches of fabric scissors, and each pointy tooth 39, that is created between each cutout notch 38 is similar in shape to a thick, wedge-shaped slice cut out of a birthday cake. The purpose of the notches 38 is to prevent any sand that may occasionally find its way into the butting area 36, 42, 37, 43, such as sticky wet sand during a surprise thunderstorm, from preventing the three sole sections 1, 2, 3 from butting together cleanly as intended. Because of the notches 38, most of the invading sand is squeezed out by the pointy, wedge-shaped teeth 39 that are formed between the triangular, wedge-shaped notches 38.

The rear sole section 3 is designed with extra sole length added behind the sandal-wearer's heel (approximately 1.125 to 1.5 inches). During a full-stride walking cycle, when the leading foot is completing an airborne stepping action forward FIGS. 8A & 8B, the interaction of the extra-long rear sole section 3 with the flexibly-hinged, three-part, rigid sole system, triggers an inverted mechanical leverage action that occurs within a split second, forcing the entire rear sole section 3 to plop down flatly and firmly upon the soft sand. This initial plop-down action is followed by an arcing downward motion upon the soft sand by the forward, toes portion of the foot, forcing the forward sole section 1, and the middle sole section 2 also, to lie down flatly and firmly upon the soft sand, as a result of inverted mechanical leverage action. A more detailed description of the inverted mechanical leverage action is included further along in this section.

The three sole sections 1, 2, 3 are comprised of three major layers 4, 31, 32, 33, 5, 6, 7 and one inset, flexible hinge layer 21. They are: (1) a top sole layer 4 which is a one-part layer common to all three sole sections 1, 2, 3; (2) a middle sole layer 31, 32, 33 which is divided between the three sole sections 1, 2, 3; (3) a bottom sole layer 5, 6, 7-which is divided between the three sole sections 1, 2, 3; and (4) a one-part, inset, highly-flexible hinge layer 21 which is inset flush into the three-part, middle sole layer 31, 32, 33.

Each of the layers 4, 31, 32, 33, 5, 6, and 7 are explained in detail below.

The top sole layer 4 is a relatively thin, flat, single-piece layer of foam rubber, or other material with similar properties, which has the purpose of providing a firm cushioning for the sandal-wearer's foot; and to possibly serve as a highly-flexible hinge (to hopefully eliminate the highly-flexible hinge 21 shown in the drawings FIGS. 4 & 6) that is needed to connect the three sole sections 1, 2, 3, if a material with the necessary characteristics can be found. To function as the hinge, the top sole layer must allow each of the sole sections 1, 2, 3 to flex freely and easily, in relationship to one another, for tens of thousands of flexes without cracking, tearing or stretching excessively. The top sole layer 4 is not too unlike some of the thicker (verses thinner) present-day computer mouse pads (approximately ¼-inch thick, more or less) and has roughly the same moderate firmness that will provide sufficient cushioning for the sandal-wearer's foot without compressing more than ⅔ to ¾ of its thickness under the weight of the heaviest sandal-wearer anticipated. The layer 4 will be glued, or otherwise bonded, to the layer, or layers, beneath it.

A very shallow, thin, convexly-embossed (or imprinted) heel position indicator 15 will be molded into the top surface of the top sole layer 4 with the center, back portion of the heel position indicator 15 positioned significantly forward (approximately 1.125 inches) from the back edge of the rear sole section 3. The center, forward portion of the heel position indicator 15 is positioned even further away (approximately 1.5 inches) from the back edge of the rear sole section 3. The purpose of this indicator 15 is to strongly communicate to prospective buyers that this sandal is not meant to be fitted to a person's foot in the traditional manner with the foot's heel positioned almost to the end of the sandal sole.

The correct positioning of the foot's heel upon the three-part sole system 1, 2, 3, as indicated by the heel position indicator 15, is well forward of the back edge (approximately 1.125 to 1.5 inches) of the rear sole section 3. This distance is crucial for the success of the inverted mechanical leverage action in eliminating the deep foot-sinking problem. The heel position indicator 15 performs no other function than to be a prominently-displayed visual indicator to prospective buyers of the correct positioning of the foot's heel upon the sandal to prevent any person from instinctively assuming that the proper sandal size for their foot is one in which the heel is conventionally positioned very near the back edge of the sandal sole.

The hinge sole layer 21 is a thin, wide strip of highly flexible rubber, or other material with similar properties, that is very strong and durable, and which has non-stretching and non-cracking characteristics. Its final thickness is expected to be not too unlike the thickness of an old-fashioned, car tire inner tube (approximately ⅛ inch). The layer is designed to be inset into the top surface 23, FIG. 4 of the three-part, middle sole layer 31, 32, 33. An alternate hinge may be used to replace the inset hinge 21. It is the top sole layer 4, if a foam rubber material can be found that will allow it to function not only as a cushion for the foot, but also as a highly-flexible, strong and durable hinge with non-stretch and non-cracking characteristics.

A second alternate hinge may be a thin, contiguous layer of a highly-flexible, strong and durable cloth, or rubber, or polyester, or other material with similar properties, which has non-stretch and non-cracking characteristics, If chosen as the hinge, it would be glued, or otherwise bonded, between the top sole layer 4 and the middle sole layer 31, 32, 33, and likely have the same contour shape as the top sole layer 4.

The middle sole layer 31, 32, 33 is a relatively thin layer (approximately ¼ inch, more or less) of very strong, rigid plastic, or other material with similar properties. The layer is divided into three parts 31, 32, 33—one part for the forward sole section 1, one part for the middle sole section 2, and one part for the rear sole section 3. The thickness of the material ultimately selected will be determined by the strength needed to maintain 90%, more or less, of its rigidity when supporting the weight of the heaviest sandal-wearer anticipated. A very small amount of flexing is allowable without any serious loss of support capability upon very soft sand. The layer also has numerous, closely spaced, cylinder-like, weight-reducing cavities 34*a* that are arranged throughout the layer in a geometrically organized fashion.

The bottom sole layer 5, 6, 7 is a very thick, flat layer of firm and tough foam rubber, or other material with similar properties. The layer is divided into three separate parts 5, 6, 7 which together make up the bottom portion of the three sole sections 1, 2, 3—the forward sole section 1, the middle sole section 2, and the rear sole section 3. Its final thickness will be approximately as shown in the drawings (¾ inch, more or less), but will ultimately be decided by additional testing of the specific material chosen and by market appeal considerations. The material ultimately chosen for this layer must also function to muffle the harsh, clacking sound that often emanates from rigid, clog-like footwear when walking on very hard surfaces. The unusually high thickness of this layer 5, 6, 7 is needed for walking on very rough and deeply-cratered, soft-sand terrain to prevent the sand's peaks from spilling over the top edges of the sandal, except in extreme circumstances. The bottom surface of the layer 5, 6, 7 will have multiple rows of thin, rib-like protrusions 30 molded into the layer to function as the sandal's tread 30.

The tread 30 is intended to enhance market appeal and to provide traction on hard surfaces such as parking lots, beach boardwalks, boardwalk stairways, etc. The tread ribs 30 are similar in looks to the ribs of an old-fashioned washboard, but much smaller and positioned laterally across the width of the three sole sections 1, 2, 3, from front to rear, with extra space between them (approximately 3/32 inch, more or less). The treads 30 have very little perceivable traction value on very soft sand. The layer also has numerous, closely spaced, cylinder-like, weight-reducing cavities 34*b* that are arranged throughout the layer in a geometrically organized fashion.

A thong 8 made of rubber, or other material with similar properties is employed to secure the sandal sole system 1, 2, 3 to a person's foot. The particular thong that is employed for this invention is one that for decades has been used in the manufacture of a ubiquitous conventional sandal, commonly referred to as flip-flops, and which is in the public domain. U.S. Pat. No. 3,290,802, filing date Dec. 13, 1966, is an example of the type of thong to be utilized; however, the extra strap portion shown crossing horizontally over the instep of the sandal-wearer's foot is not expected to be needed, pending prototype testing on sandal-wearers with very thin and narrow feet.

The forward end 12*a* of the thong 8 is secured to the middle sole layer 31 of the forward sole section 1 in the cavity provided 35*a*. From there it passing upward through an aperture 13 in the top sole layer 4 where it continues upward, passing through the crook located between the sandal-wearer's largest toe and adjacent toe. At the top of the crook the thong divides into two separate thong straps 10*a*, 10*b* before traversing the right and left sides, respectively, of the top, forward portion of the foot's instep, before continuing on to wrap around the right and left sides 11*a*, 11*b*, respectively, of the instep. The two straps then pass through their respective right and left side apertures 14*a*, 14*b* in the top sole layer 4 before anchoring themselves into their respective right and left side cavities 35*a*, 35*b* of the middle sole layer 33 of the rear sole section 3, below the right and left sides of the back portion of the sandal-wearer's instep at points located near the forward end of the rear sole section 3.

All three thong endings 12*a*, 12*b*, 12*c* are anchored into their respective cavities by gluing, or other bonding, or by making the thong strap endings 12*a*, 12*b*, 12*c* with a flange that is larger in size than the apertures 13, 14*a*, 14*b* that it must pass through in the sandal sole, as is done with conventional flip-flops, if the material of the top sole layer is strong enough to prevent the thong strap endings 12*a*, 12*b*, 12*c* from pulling out.

The functioning of the present invention is more clearly understood by viewing the accompanying six sequential drawings FIGS. 8A through 8F which portray the various stages of a full-stride walking cycle, with step-by-step descriptive wording as follows:

During the 1st and 2nd stages of a full-stride walking cycle FIGS. 8A & 8B, the upper body of the sandal-wearer moves forward as it thrusts a leg and foot forward in the air during a stepping action. When contact is made with the soft sand S ahead FIG. 8A the outstretched leg is positioned at a 15- to 25-degree angle, in relationship to the vertical, which causes the foot and sandal to also strike the soft sand S ahead at roughly the same 15- to 25-degree angle FIG. 8A, but in their relationship to the sand's surface S.

At the moment of initial contact with the soft sand S, the pressure of the sandal-wearer's full-body weight is concentrated by the heel of the foot upon the rear sole section 3, not at the back edge of the heel as is commonly thought, but forward of it at a point located directly beneath the center of the foot's curved heel bone (as identified by the large hollow arrows in FIGS. 8A & 8B), a point that is significantly forward, away from the back edge of the foot's heel (approximately 1.125 inches forward), and well forward of the back edge of the rear sole section 3 (approximately 2.25 to 2.625 inches forward). The center point of the heel bone functions as a weighted fulcrum, creating an inverted mechanical leverage action which forces the entire rear sole section 3 to plop down flatly and firmly upon the soft sand FIG. 8B a fraction of a second after the back edge of the rear sole section 3 strikes the surface of the soft sand, and the body's full weight is applied to that rear sole section 3.

Figure 3:
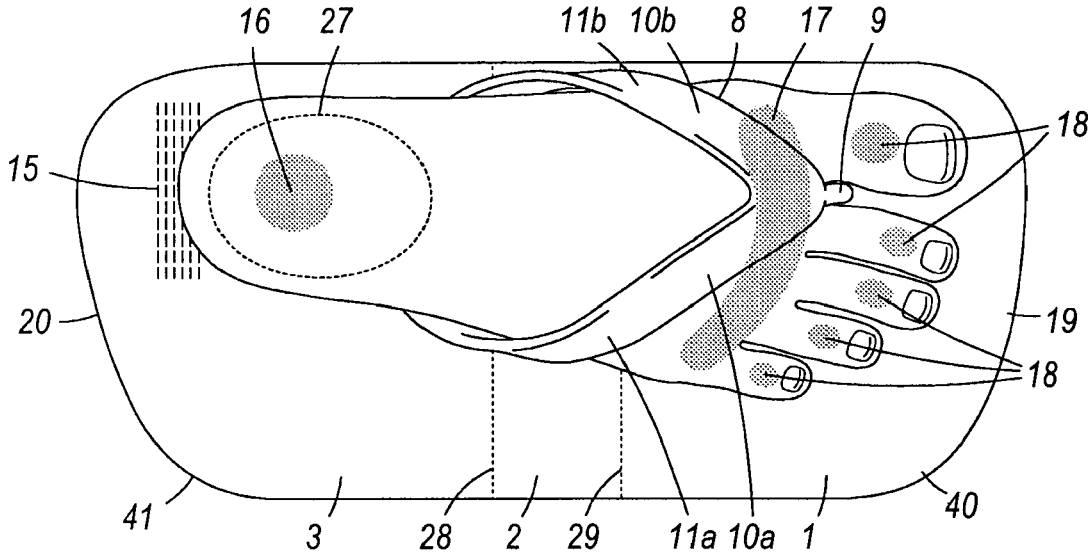
FIG. 3 is an overhead view of the right foot sandal facing to the right, showing the exterior surfaces and a silhouette of a sandal-wearer's foot correctly positioned on the sandal.

And, because the body's weight 16, FIG. 3 upon the rear sole section 3 is concentrated sufficiently far away from all the edges of the rear sole section 3, it causes the weight to be distributed throughout the full dimensions of the section 3, holding it firmly and flatly upon the soft sand S without any perceivable tilting (except on very irregular sand surfaces), and without any significant foot sinking (approximately 0.25 inch). The "plop down" phenomenon of the present invention occurs even though the sandal-wearer's foot angle remains instinctively locked at the 15- to 25-degree angle, more or less, during those first moments of the sandal's initial contact with the soft sand FIG. 8B when the body's full weight comes to bear upon the soft sand S.

Under the same circumstances, however, when conventional, one-part, rigid sole sandals are worn, the foot sinking that occurs is much greater (roughly 1.25 to 2 inches, or more) because both the sandal-wearer's foot and sandal sole remain positioned at the 15- to 25-degree angle during those first moments of initial sand impact when the body's full weight comes to bare upon the soft sand S. The inverted mechanical leverage actions that occur during this 1st and 2nd stage of the full-stride walking cycle 8A & 8B, and during the 3rd stage of the full-stride walking cycle FIG. 8B & 8C (explained further below), and during the 5th stage of the full-stride walking cycle FIG. 8D & 8E (explained further below) are this invention's primary intellectual property.

During the 3rd stage of a full-stride walking cycle FIGS. 8C the sandal-wearer's upper body continues its move forward, and passes directly over the leading foot (shown in this drawing) as the trailing foot (unseen in this drawing) begins its airborne movement forward toward the next step. During that trailing foot's initial movement forward, the toes portion of the sandal-wearer's leading foot (shown in this drawing) arcs downward from its 15- to 25-degree angular position FIG. 8B, causing the ball joints of the toes, and the toes themselves to function in unison as a weighted fulcrum of an inverted mechanical lever, forcing the forward sole section 1, and consequently the middle sole section 2 also, to lie down flatly and firmly upon the soft sand FIG. 8C, causing all three sandal sole sections 1, 2, 3 of the leading foot to be positioned flatly and firmly upon the soft sand FIG. 8C, where roughly half of the sandal-wearer's body weight shifts instinctively away from the foot's heel 16, FIG. 3 forward to the ball joints of the toes 17, FIG. 3, and with a small portion applied to the toes themselves 18, FIG. 3. The large hollow arrows in the drawings FIGS. 8A-8E identify the center points of the major body weight concentrations upon the forward sole section 1 and the rear sole section 3. The small hollow arrows in the drawings FIGS. 8C-8E identify the center points of the minor body weight concentrations emanating from the toes. NOTE: The major points of body weight concentration 16, 17, FIG. 3 are located sufficiently far away from the edges of the forward sole section 1 and from the rear sole section 3 to cause the sandal-wearer's body weight to be distributed throughout the full dimensions of those two sole sections 1, 3, holding them firmly and flatly upon the sand's surface without tilting towards the inside edge.

During the 4th stage of a full-stride walking cycle FIG. 8D the sandal-wearer's upper body continues its move forward as the now-leading opposite foot, (unseen in this drawing) continues moving forward in the air toward its next step. The forward movement of the sandal-wearer's body and leading foot causes the heel of the sandal-wearer's now-trailing foot (shown in this drawing) to instinctively arc upward, lifting away from the rear sole section 3. This lifting up of the foot's heel causes that portion of the sandal-wearer's body weight, that had been concentrated upon the foot's heel (roughly half), to shift totally forward where it is added to the weight already being borne by the ball joints of the toes, and a small portion by the toes themselves. The bulk of the body's weight is concentrated sufficiently far away from the edges of the sole 17, 18, FIG. 3 to cause the body weight to be distributed throughout the entire dimensions of the forward sole section 1, holding it flatly and firmly upon the soft sand without tilting towards the inside edge.

As the foot's heel is engaged in its arcing motion upward FIG. 8D, the forward, top portion of the foot's instep presses against the thong straps 10*a*, 10*b*, causing them to begin tightening. But, because the sole is comprised of a flexibly-hinged, three-part, rigid sole system 1, 2, 3, as opposed to a one-part rigid sole system, and because there is no body weight pressure holding the rear sole section 3 down against the sand, the rear sole section 3 easily lifts up and away from the soft sand when the two divided thong straps 10*a*, 10*b*, 11*a*, 11*b* begin to tighten. The lack of resistance, other than the light weight of the rear sole section itself 3, prevents any significant thong pressures from building up upon the sandal-wearer's foot, as it does with conventional, one-part, rigid sole sandals during this same stage of the full-stride walking cycle, as explained more fully elsewhere in this application.

During the 5th stage of a full-stride walking cycle FIG. 8E the sandal-wearer's upper body continues its move forward as the opposite foot (unseen in this drawing) nears completion of its airborne stepping action forward, causing the sandal-wearer's now-trailing foot (shown in this drawing) to continue lifting the foot's heel upward and forward even higher than in the previous drawing FIG. 8E, and up even further away from the soft sand and the rear sole section 3 in anticipation of its own next step forward. As the heel continues its movement upward and forward, the forward portion of the foot's instep continuing its arc upward also. As it does, it continues applying pressure against the two divided thong straps 10*a*, 10*b*, 11*a*, 11*b*. The thong 8 pressure again causes the two divided thong straps 10*a*, 10*b*, 11*a*, 11*b* to easily pull the flexibly-hinged, rear sole section 3 even further up in its arc away from the soft sand during this stage of the full-stride walking cycle.

And, because of the flexible hinge 21 connecting the three-part sole system 1, 2, 3, the rear sole section 3 continues to offer almost no resistance to the pulling thong straps 10*a*, 10*b*, 11*a*, 11*b*, preventing thong 8 pressures from building up uncomfortably upon the foot. As the sandal-wearer's full-body weight continues to be concentrated mostly upon the ball joints of the toes 17, FIG. 3, well away from the edges of the forward sole section 1, FIG. 3, the weight continues to be distributed throughout the full dimensions of the forward sole section 1, holding it flatly and firmly upon the sand's surface. As the sandal-wearer's body continues its move forward, the body's full weight instinctively shifts away from the trailing foot (shown in this drawing), forward to the opposite foot (not shown in this drawing), as that foot's heel strikes the soft sand ahead at the completion of its airborne stepping action forward.

The trailing foot (shown in this drawing) is then lifted up off the soft sand as it is thrust forward in the air FIG. 8F toward its next step. In contrast, when conventional, one-part, rigid sole sandals are in this stage of the full-stride walking cycle the thong straps tightening up uncomfortably across the top, forward portion of the sandal-wearer's instep as the foot's instep approaches the highest points of its arcing motion upward. This tightening of the thong straps occurs because of the resistance emanating from the back portion of the one-part, rigid sole system which is being held down firmly upon the soft sand by the forward ⅓ portion of the sandal sole where the ball joints of the toes and the toes themselves are applying their heavy body weight pressure. The strong and uncomfortable thong pressures eventually become so great that they overcome the heavy, body weight pressures that are holding the rigid sole down upon the sand, and pull the back portion of the sole up above the soft sand at an angle of roughly 15 to 20 degrees, in its relationship with the sand's surface.

This action forces the front end portion of the sandal sole to punch down deeply into the soft sand because of: (1) the body weight pressure being exerted by the toes portion of the sandal sole; (2) the sole's reduced square-inch surface area contact with the soft sand; and (3) the sole's angular orientation, which reduces the sole's support capabilities. The front end of the sandal continues to sink deeper into the soft sand (roughly 1.25 to 2 inches, or more) until there are enough square inches of sole surface contact with the soft sand to once again support the body's heavy weight and terminate the sinking.

During the 6th and final stage of a full-stride walking cycle FIG. 8F the sandal-wearer's upper body continues its move forward as the body's total weight instinctively shifts away from the trailing foot (shown in this drawing) to the leading foot (not shown in this drawing) as it contacts the soft sand ahead at the completion of its airborne stepping action forward. As this action is occurring, the trailing foot (shown in this drawing) is instinctively lifted airborne above the soft sand as it begins its movement forward toward its next step.

During this stage of the walking cycle the forward portion of the divided thong straps 10*a*, 10*b* functions as a slightly off-center (right to left) supporting fulcrum of an inverted mechanical lever which is composed of the three sole sections 1, 2, 3 functioning as a single, rigid element (because of the butting of the three sole sections 1, 2, 3). While airborne, gravitational forces cause the longer, back portion 2, 3 of the sole/lever 1, 2, 3 to hang down slightly below the heel (as shown in the drawing).

During this stage, gravitational forces and the butting that occurs 42, 36, 37, 43 between the three sole sections 1, 2, 3, causes the three sole sections 1, 2, 3 to stay positioned within the same plane, and prevents the middle sole section 2 and the rear sole section 3 from hanging down below the plane of the forward sole section 1. With gravitational forces applying downward pressure upon the longer, rear end portion 2, 3 of the sole/lever 1, 2, 3, the supporting fulcrum which is located just above the ball joints of the toes causes levered pressure to be exerted upward beneath the toes by the shorter, forward portion of the sole/lever 1, 2, 3. The small amount of upward pressure being exerted beneath the toes is unconsciously felt by the toes, which instinctively lock themselves in their normal, straight-forward position, and sometimes in a slightly downward position, resisting the upward pressure; and consequently preventing the sandal sole from hanging down more than a slight amount beneath the heel (as seen in the drawing).

And, because of the extra width of the sandal sole located on the right side of the right foot and on the left side of the left foot, the largest and strongest toe of each foot bears the bulk of the weak leveraged pressure being exerted. The sandal's overall weight is relatively light, because of the large number of weight-reducing cavities designed into the sole system, which causes the upward pressures being exerted against the toes to be weak enough not to be objectionable, and only barely noticeable, just as they are with conventional "flip-flops". The buying public has become quite accustomed to this slight, instinctive, downward toe pressure when wearing conventional "flip-flops" and other rigid sole sandals and clogs that are secured to the foot with a thong.

The light weight raw materials chosen for the present invention, and the inclusion of the large number of weight-reducing cavities 34*a,* 34*b* throughout the three sole sections 1, 2, 3 causes the weight of the sandal sole to be exceptionally light. And, because the sole system 1, 2, 3 is exceptionally light weight, the height of the butting areas 42, 36, 37, 43 between the three sole sections 1, 2, 3 are small and yet still function satisfactorily in keeping the three sole sections 1, 2, 3 within the same plane when airborne. This is the stage of the walking cycle in which it should be obvious to the viewer of the drawings why extreme measures have been taken in the design of the sandal to restrict the weight to prevent the sandal from hanging heavily from the foot during the airborne stage FIG. 8F of the walking cycle. Without the cavities 34*a,* 34*b,* the sandal sole would be far too heavy to function properly.

An alternative embodiment to the present invention as shown in FIGS. 9 through 20D, is comprised of; (1) a flexibly hinged, three-part, sandal sole system 101, 102, 103 for receiving footwear of a user; (2) a forward foot-strap assembly 107; (3) a rear foot-strap assembly 108; and (4) a heel back stop 106. Additional design characteristic include: (5) extra sole length added to the rear sole section 3, behind the sandal-wearer's heel; and (6) additional sole width added to the entire sole system 101, 102, 103. The three, flexibly-hinged, rigid-sole sections 101, 102, 103 and the extra sole length of the rear sole section 3 interact to enable the employment of inverted mechanical leverage to eliminate the deep foot sinking that is a known deficiency of all known conventional footwear when engaged in full-stride walking on very soft sand. The extra sole width of the three-part sole system 101, 102, 103 is of secondary importance, but it reduces the foot sinking even more by increasing the square-inch surface area of the sole system 101, 102, 103, thereby lessening the over-all body weight supported per-square-inch of sole. A combination of the inverted mechanical leverage action and the extra sole width, reduces the foot sinking down to an insignificant level.

The inverted mechanical leverage principle that is the primary ingredient of the present invention relates to the commonly understood use of a long, rigid beam to lift a heavy object by placing one end of the rigid beam under the object, and placing a rock, or other supporting fulcrum, beneath the beam at a point located less than half the over-all length of the beam away from the object. The leverage action created causes the heavy object to be lifted up by applying downward pressure to the opposite end of the beam. With the assistance of the mechanical leverage advantage, the energy expended to lift the heavy object is less than the energy required to pick up the heavy object without the use of leverage. The energy advantage of this leverage example is not particularly significant to the present invention, but the basic mechanical action is, when inverted.

With the present invention, the leverage action being utilized is inverted, with the forward sole section 101, and the rear sole section 103 of the sandal, each acting as independent, flat-surface, inverted levers, and the middle sole section 102, simply functioning as a spacer between the forward sole section 101 and the rear sole section 103. The shoe's heel acts as a weighted fulcrum for the rear sole section 103, and the forward portion of the shoe's sole that is located directly beneath the ball joints of the toes and the toes themselves, acts as a weighted fulcrum for the forward sole section 101—see FIGS. 19B, 19C and 19D.

During a full-stride stepping action forward, when the airborne foot is completing its step, the pressure from the sandal-wearer's falling foot, when applied by the sandal-wearer's shoe heel upon contact with the soft sand, causes the rear sole section 103 to almost instantly plop down firmly and flatly upon the very soft sand, where the body's full-weight is supported by the entire square-inch bottom surface area of the flatly-positioned rear sole section 3, resulting in an insignificant amount of foot sinking.

As the walking action continues, and the angled foot arcs down flatly upon the soft sand, the pressure being applied by the front portion of the sandal-wearer's shoe as it is arcing downward, causes the middle sole section 102 and the forward sole section 1 of the sandal sole system 101, 102, 103 to be pressed down firmly and flatly upon the soft sand, one after the other, in succession. The body-weight pressure holds the affected sole sections 101, 102, 103 firmly- and flatly-positioned upon the soft sand until that pressure is removed.

With the present invention, whenever any of the three sole sections are supporting any significant amount of body weight, it remains positioned firmly and flatly upon the soft sand until that weight is removed. These inverted mechanical leverage actions eliminate most of the foot sinking that is caused by two primary factors when engaged in full-stride walking on very soft sand: (1) the 18 to 25 degree angle of the sandal-wearer's foot when the back end of the sandal strikes the soft sand at the completion of every full-stride, airborne step forward; and (2) the sandal-wearer's heavy body weight per-square-inch of sole. Those two factors are the root causes of the foot sinking that occurs during full-stride walking on very soft sand, whether walking barefooted or wearing footwear. The present invention's use of inverted mechanical leverage, combined with the obvious use of extra sole width to reduce foot sinking, are the key intellectual properties for which a patent is being sought.

The functioning of the present invention and a detailed description of the various component parts that make it possible are explained in the paragraphs that follow, accompanied by mechanical drawings for visual reference. Except for the metal fittings, 119*a,* 119*b,* 117*a,* 118*a,* the elastic strap portions 112 of the two foot-strap assemblies 107, 108, and the foam rubber and rubber parts 171, 155, 104, 105, most parts of the sandal are designed to be constructed of a very strong, non-brittle plastic which will likely have a satin-surface finish that is very finely textured. The look and feel of the plastic will likely be similar to that found in some, mostly rigid, but not brittle, power hand tool exterior housings and some newly marketed, sturdy, and tough, plastic kitchen tongs, spatulas, ladles, etc.

The flexibly hinged, three-part, sandal-sole system is comprised of three, rigid-sole sections 101, 102, 103, hereafter referred to as the forward sole section 101, the middle sole section 102, and the rear sole section 103. The three sole sections 101, 102, 103 are each aligned flatly and end-to-end, one after the other, in a linear fashion from the sandal's toe end to the sandal's heel end 103, with the middle sole section 102 designed shorter than the other two, and with the separation space between the three sole sections being ⅛ inch, more or less. The two, flexibly-hinged joints that link the three sections together are designed to allow the sole sections 101, 102, 103 to arc upward and downward, independently in relationship to one another FIGS. 19C & 19E.

Figure 12:
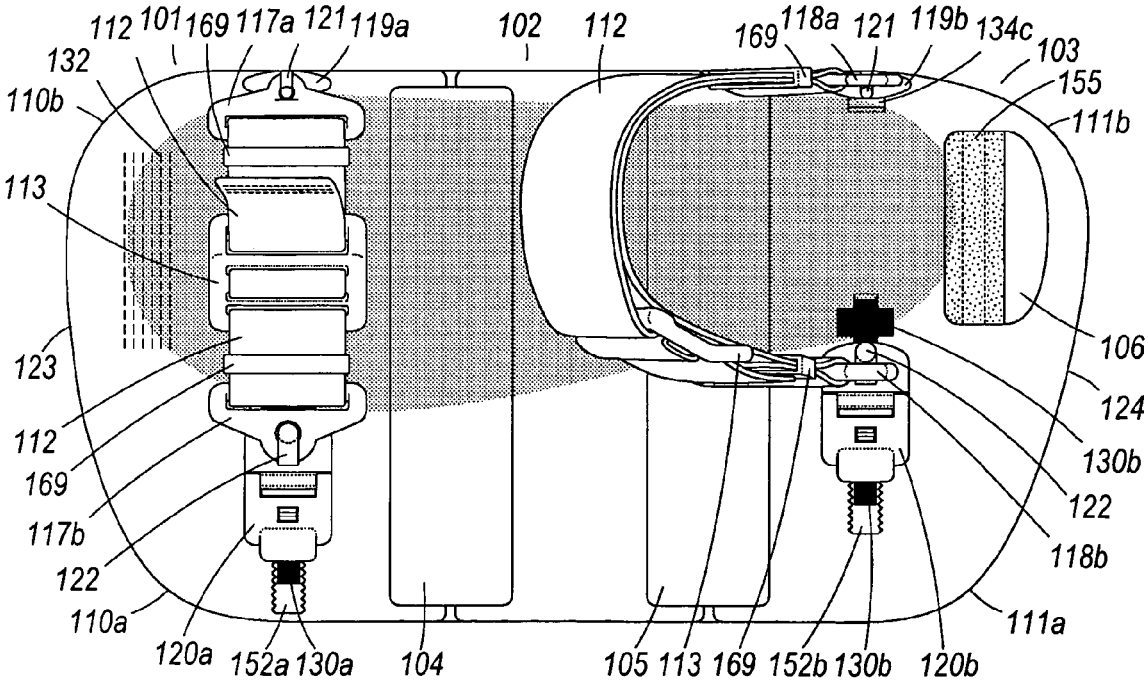
FIG. 12 is an overhead view of the left foot sandal facing to the left and showing the exterior surfaces and dashed-line indications of some non-surface portions.

The three sole sections 101, 102, 103 are designed extra-wide FIG. 12 with 0.75 inch to 1.5 inches, more or less, added to the sole's width. The extra sole width is asymmetrically added to the right side of the right foot sandal, and to the left side of the left foot sandal, as opposed to equal amounts being added to both the right and left sides of each foot. By having no extra width added on the inside of the feet, this asymmetrical feature allows the sandal-wearer's feet to operate as closely together while walking, or jogging, as they normally do with conventional shoes and sandals. The precise amount of extra sole width will ultimately be decided by the amount of extra sole width that market research determines is likely to be acceptable to prospective buyers.

The amount of foot-sinking that the extra sole width prevents is not required for the success of the sandal, but when combined with the leverage action, it does further reduce the foot-sinking down to an insignificant level, whereas the mechanical leverage action alone reduces it by only ⅔ to ¾, but not totally down to an insignificant level. The added weight and cost of materials required by the extra sole width will likely lead to the addition of hidden weight-reducing cavities, not shown in any of the drawings, although they are not required for the alternative embodiment to function as intended.

Partial working models of the present invention, made without weight-reducing cavities, function exceptionally well and are not excessively heavy. Also, extra sole width, less than the 1.5 inches shown in these drawings, or no extra width at all, would result in less of a reduction in foot sinking, but the overall foot sinking would still be greatly reduced, and likely be considered "good enough" by prospective buyers consulted during market research.

The forward sole section 101 is one of the three, rigid-sole sections that comprise the sandal sole system 101, 102, 103. When viewed from the side, it is designed with the forward edge tapered 125, top to bottom, like the curve at the front end of a snow ski, to reduce the amount of sand spray that is flipped up into the air any time footwear, is lifted up off very soft sand into the air when engaging in a step forward in the walking cycle. The forward sole section 101 is also designed with a very slight curve and a slight angle 123, left to right, along its forward edge when viewed from above. The angle enables the sandal-wearer to make arced changes in direction while walking or jogging. The extra width of the sandal sole causes large-diameter arcs and moderate-diameter arcs to be acceptable, but small diameter arcs are not.

Small-diameter arcs cause stability problems when the sandal-wearer's foot is being lifted up off the soft sand as it is being thrust forward toward its next airborne step. The problem occurs when the front inner corner of the sandal sole, which is located directly in front of the sandal-wearer's longest toes, lifts off the soft sand before the front outer corner 110*a* lifts off. It is acceptable, however, if the reverse order occurs, or if the inner and outer corners 110*a*, 110*b* both lift off simultaneously.

If the present invention is eventually marketed, a strong caution to prospective buyers of the product will have to accompany the sandal, warning against engaging in small diameter directional changes while walking or jogging, to avoid instability and the possibility of falling.

The forward sole section 101 is designed with a forward foot-strap assembly 107 that is stretched snugly, but not tightly, across the toes portion of the sandal-wearer's shoe, and is attached to the hooked stud 122 of the forward adjustable foot-strap anchor 120*a* on the opposite side of the shoe, securing the forward ⅓ of the shoe in constant contact with the forward sole section 1. The strap's snug, but not tight, adjustment allows the shoe to shift a small amount forward and backward along the top surface of the sandal sole as the three sandal sole sections 101, 102, 103 flex in relationship to one another during the walking cycle. This shifting occurs between the narrow confines of the two foot-strap anchors 119*a* 119*b*, 120*a*, 120*b* located on each side of the foot. The shifting occurs only when there is flexing of the three sole sections 101, 102, 103, and when there is little, or no, body-weight pressure being concentrated heavily upon the particular sole sections. When any significant amount of body weight pressure is being applied to any of the three sole sections 101, 102, 103, that weight locks the shoe into whatever position that it is in on that sole section, for the entire time that the pressure is being applied.

The thickness of the back end edge 126 of the forward sole section 101 is designed to be angled backwards from the top surface to the bottom surface, at approximately 145 degrees, more or less, down from an imaginary vertical line above. Its purpose is to extend the bottom surface area as far backwards as possible, in an effort to maximize the square-inch surface area available to support the sandal-wearer's body weight. The forward sole section 101 is designed with three cavities 130*a*, 135, 152*a* in the top surface—one for the forward stationary foot-strap anchor 119*a*, and the other two for the forward adjustable foot-strap anchor 120*a*. These two foot-strap anchors 119*a*, 120*a* secure each end of the forward foot-strap assembly 107, which includes a long and wide elastic strap 112, which allows it to stretch snugly, but not tightly, across the toes portion of the sandal-wearer's shoe, snugly holding the forward ⅓ of the shoe in constant contact with the forward sole section 1.

A toe position indicator 132 for the shoes will be embossed, or otherwise imprinted, or affixed, onto the top surface of the forward sole section 1. The purpose of this indicator 132 is to unmistakably communicate to salespersons and prospective buyers of the sandal exactly what size shoes are required for proper functioning for that particular size sandal.

The middle sole section 102 is one of the three, rigid-sole sections that comprise the sandal sole system 101, 102, 103. It is designed primarily as a spacer between the forward sole section 101 and the rear sole section 3, and the number of square inches of its bottom sole surface assists in the sandal's overall resistance to foot sinking when the foot is positioned flatly upon the soft sand. Although this middle sole section 102 is shown in the drawings as a single-element section, it functions equally as well in its job as a spacer when divided into two or more shorter segments, connected end to end.

The sole thickness 127 of the forward end of the middle sole section 102 angles backwards from the top surface to the bottom surface, at an angle of approximately 130 degrees, more or less, down from an imaginary vertical line, to allow a notch of space to exist between the forward end 127 of the middle sole section 102 and the back end 126 of the forward sole section 101 when both sections are positioned in the same plane. This space is needed to allow the two sole sections 1, 102 to flex downward, in relationship to each other, below the horizontal plane, to facilitate walking over mounds of sand and also when engaged in one stage of the walking cycle FIG. 11C. The downward flexing is also needed when non-cautious sandal-wearers attempt to walk up or down stairway steps at beach boardwalks, etc., against the recommendation of the sandal manufacturer.

The space is also needed to accommodate the small amounts of soft sand that squeeze out from beneath the sole sections with each step in the walking cycle. A mirror image of the angular edges just described also exist between the back end 128 of the middle sole section 102 and the forward end 129 of the rear sole section 3.

The rear sole section 103 is one of the three, rigid-sole sections 101, 102, 103 that comprise the sandal sole system 101, 102, 103. It is designed with extra length added behind the planned positioning of the sandal-wearer's shoe heel—approximately 1.25 to 1.75 inches, more or less. This extra sole length interacts with the flexibly-hinged, three-part, sandal sole system 101, 102, 103 to employ inverted mechanical leverage to force the rear sole section 103 to plop down flatly upon the soft sand at the completion of the foot's airborne stage of a full-stride, stepping action forward when the back end of the rear sole section 103 strikes the soft sand ahead. The inverted mechanical leverage action is explained in more detail elsewhere in this section.

The rear sole section is also designed with a very slight curve and a slight angle 124, left to right, along its rear edge when viewed from above. The angle enables the sandal-wearer to make arced changes in direction while walking, or jogging. The extra width of the sandal sole causes large diameter arcs and moderate diameter arcs to be acceptable, but small diameter arcs are not. Small-diameter arcs cause stability problems when the sandal-wearer's foot strikes the soft sand as it is completing its airborne steps forward during the full-stride walking cycle. The problem occurs when the rear inner corner of the sandal sole, which is located directly behind of the sandal-wearer's heel, strikes the soft sand after the rear outer corner 111 does. It is acceptable, however, if the reverse order occurs, or if the inner and outer corners both strike the soft sand simultaneously.

As explained above, if the present invention is eventually marketed, a strong caution to prospective buyers of the product will have to accompany the sandal, warning against engaging in small diameter directional changes while walking or jogging, to avoid instability and the possibility of falling.

The angle of the rear edge 124 of the rear sole section 103 has the additional function of accommodating the small amount of flay-footedness of most people, as opposed to people with feet that are positioned precisely straight forward, or are more flay-footed than is normal. People with very exaggerated flay-footedness, can expect to experience stability problems with the present invention, unless they take care to engage in only large diameter directional changes, or have the angle of the rear edge 124 of the sandal increased by cutting or filing. The thickness of the forward edge 129 of the rear sole section 103 is designed to be angled forward from the top surface to the bottom surface, at approximately 145 degrees, more or less, from an imaginary vertical line upward. Its purpose is to extend as far forward as possible, the bottom surface area of the rear sole section 103 in an effort to maximize the square-inch surface area available to support the sandal-wearer's heavy body weight.

The rear sole section 103 is designed with four cavities 130*b*, 152*b*, 135, 160*b* in the top surface—one cavity 135 for the rear stationary foot-strap anchor 119*b*; and two cavities 130*b*, 152*b* for the rear adjustable foot-strap anchor 120*b*. The last cavity 160*b* of the four cavities is for the heel back stop 106. The two foot-strap anchors 119*b*, 120*b* of the rear sole section 103 each secure one of the two ends of the rear foot-strap assembly 108 which includes a long, wide elastic strap 112 which allows it to snugly stretch across the instep of the sandal-wearer's foot and shoe.

The restraining pressure created by the elastic strap portion of the rear foot-strap assembly 108 keeps the rear sole section 103 pulled up snugly and in constant contact with the heel of the shoe, even during the plop-down stage of the walking cycle when the rear edge of the shoe's heel shifts forward along the surface of the rear sole section 3, as explained in the detailed description of FIGS. 11C and 11E later in this section. The strap's moderate, but not tight, snugness allows the shoe to shift a small amount forward and backward along the top surface of the sandal sole 101, 102, 103 as the three sole sections 101, 102, 103 flex in relationship to one another during the walking cycle. This shifting, forward and backward, occurs with the shoe positioned between the narrow lateral confines of the four foot-strap anchors 119*a*, 119*b*, 120*a*, 120*b*—one located on each side of the toes portion of the shoe, and one located on each side of the heel portion of the foot. The shoe's shifting occurs only during two phases FIG. 19C & 19E of the full-stride walking cycle when there is flexing of the three sole sections 101, 102, 103, and when there is little, or no, body-weight pressure being concentrated heavily upon the particular sole section(s) involved. When any significant amount of body weight pressure is being applied to any of the three sole sections 101, 102, 103; FIGS. 19C & 19E, that weight locks the shoe into whatever position it is in, on that particular sole section, for the entire time that the weight is being applied.

Figure 13:
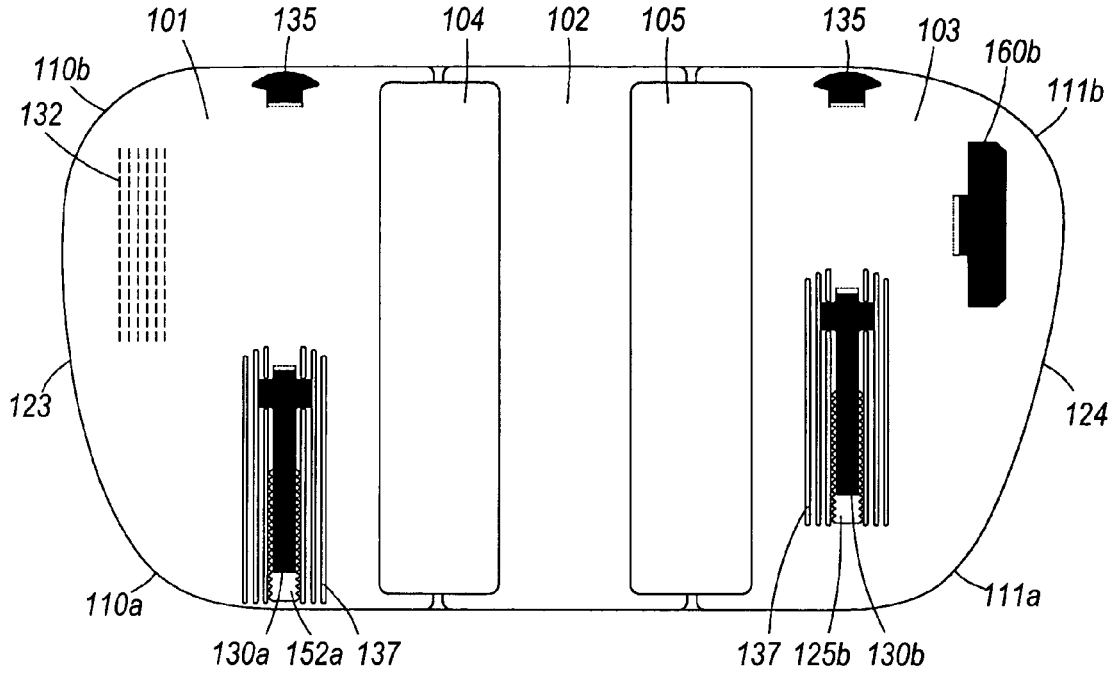
FIG. 13 is an overhead view of the sole of the left foot sandal sole facing to the left and showing no appendages or attachments, except for the two, flexible, rubber-like hinges.
Figure 14:
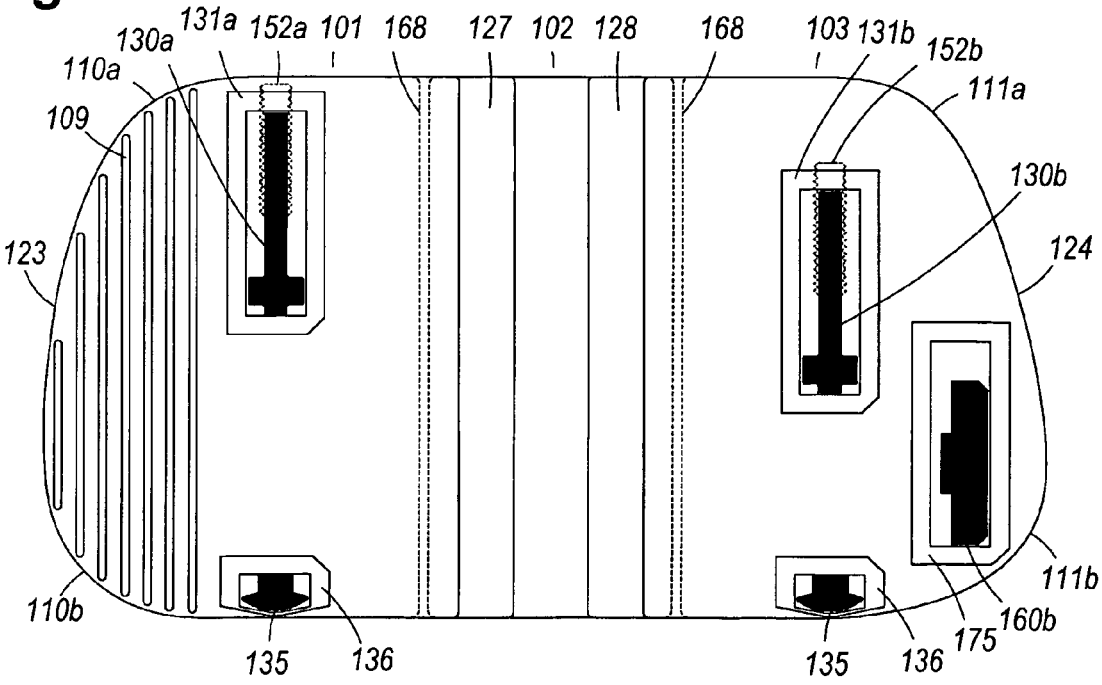
FIG. 14 is a bottom view of the sandal sole of the left foot sandal facing to the left and showing only a small portion of the tread, which will ultimately extend across the entire length of the sole.

The stationary foot-strap anchor 119*a*, 119*b*, of which there are two, is a mechanism with a hooked stud 121. One of the anchors is located on the forward sole section 101 and one on the rear sole section 103, and both are positioned flushly along the right side of the left sandal, and along the left side of the right sandal, both within 1/16 inch to 1/8 inch of the shoe's positioning. They are secured within the cavity 135, FIG. 13 provided in the forward sole section 101, and in the rear sole section 103 by a locking arm 134*c* which is part of the two anchors 119*a*, 119*b*. The two stationary foot-strap anchors 119*a*, 119*b* function in conjunction with the two adjustable foot-strap anchors 120*a*, 120*b* that are located on the left side of the left shoe, and on the right side of the right shoe to provide anchors for the two, foot-strap assemblies 107, 108. The stationary foot-strap anchors 119*a*, 119*b*, are designed to be thin and to ensure that the sandal-wearer's shoe is continually positioned within 1/16 to 1/8 inch of the two stationary foot-strap anchors 119*a*, 119*b*, to enable the sandal-wearer's two feet to operate just as closely together with the sandals as they do with conventional footwear alone.

Figure 15A:
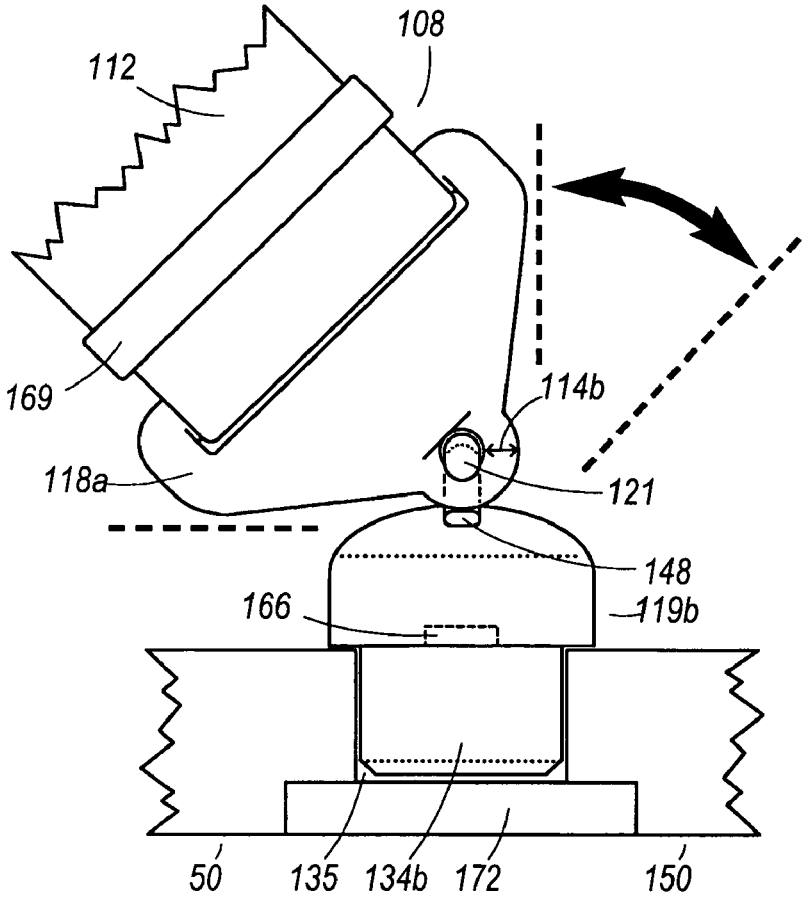
FIG. 15A is a side elevation view of the entire rear stationary foot-strap anchor.
Figure 15B:
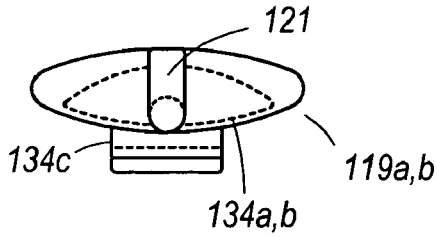
FIG. 15B is an overhead view of the forward stationary foot-strap anchor and the rear stationary foot-strap anchor with the anchoring tongue protrusion on the opposite side shown in dashed lines.
Figure 15C:
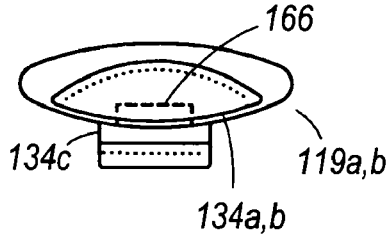
FIG. 15C is a bottom view of the forward stationary foot-strap anchor and the rear stationary foot-strap anchor.
Figure 15D:
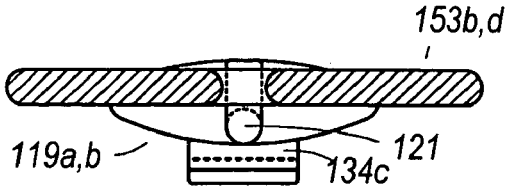
FIG. 15D is an overhead view of the forward stationary foot-strap anchor and the rear stationary foot-strap anchor with the forward and rear stud-mate attachment shown attached beneath the hooked stud.
Figure 15E:
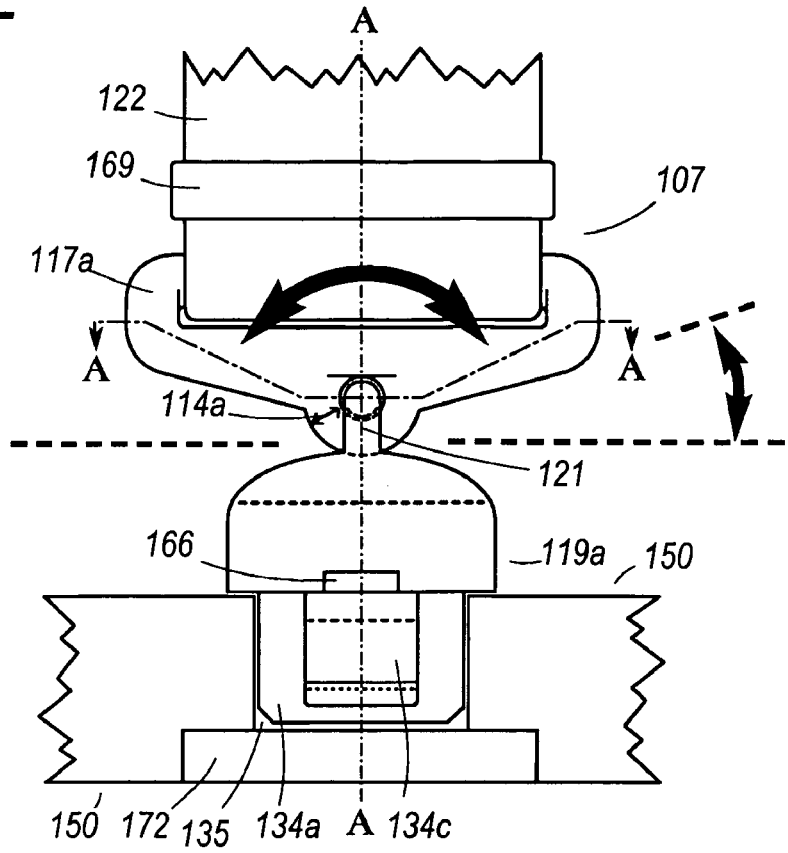
FIG. 15E is a side view elevation of the forward stationary foot-strap anchor shown with the forward stud-mate attachment that is affixed to the end of the truncated forward foot-strap assembly.
Figure 15F:
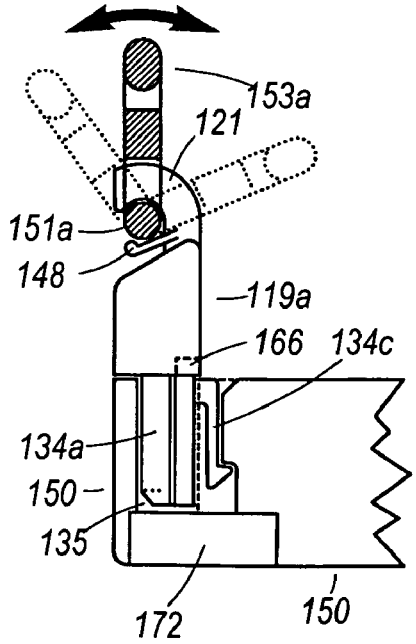
FIG. 15F is an end elevation view of the forward stationary foot-strap anchor shown with a cross-sectional side view of the forward stud-mate attachment shown attached beneath the hooked stud, as identified by line A-A of FIG. 15E.

With the present invention, the two sandals never come in contact with one another during the normal full-stride walking cycle, and the sandal-wearer never has to walk with his feet held further apart than is normal. A snap-lock flange 148, as shown in FIG. 15F, is pressure-activated, has been designed into the mechanism to ensure that both, the forward stud-mate attachment 117*a* and the rear stud-mate attachment 118*a* of the two foot-strap assemblies 107, 108, remain attached to the anchors, and do not accidentally disengage even when the foot-strap assembly is hanging loosely during times when the sandal is not attached to a foot. The snap-lock flange 148 as shown in FIG. 15F also allows the foot-strap assemblies to be easily snapped out and in when they become worn with time and need to be replaced due to excessive wear.

The adjustable foot-strap anchor 120*a*, 120*b*, of which there are two, is a mechanism with a hooked stud 122. It is located on both, the forward sole section 101 and on the rear sole section 3, and is positioned on the left side of the left shoe, and on the right side of the right foot, both within 1/16 inch to 1/8 inch of the shoe. The two adjustable foot-strap anchors 120*a*, 120*b*, that are located on the outer side of the shoe, function in conjunction with the two stationary foot-strap anchors 119*a*, 119*b* that are located on the inner side of the shoe. These anchors are designed to ensure that the sandal-wearer's shoe is continually positioned close enough to the inside edge of the sandal to allow the sandal-wearer's feet to operate as closely together as they normally do when wearing conventional footwear, to prevent the sandals from touching one another when walking or jogging.

The adjustable foot-strap anchors 120*a*, 120*b* are designed to be laterally adjustable to accommodate every shoe size width. Unless the sandals are later sold or given away, this adjustment will be made only once, when the sandal is initially fitted to the footwear of the sandal wearer at the time of purchase. The adjustable foot-strap anchors 120*a*, 120*b* are designed to enable the stud-mate attachments 117, 118, of both foot-strap assemblies 107,108, to be easily engaged and disengaged from beneath the hooked stud 122 of the adjustable foot-strap anchors 120*a*, 120*b* each time the sandal is attached or detached from the foot.

Figure 16A:
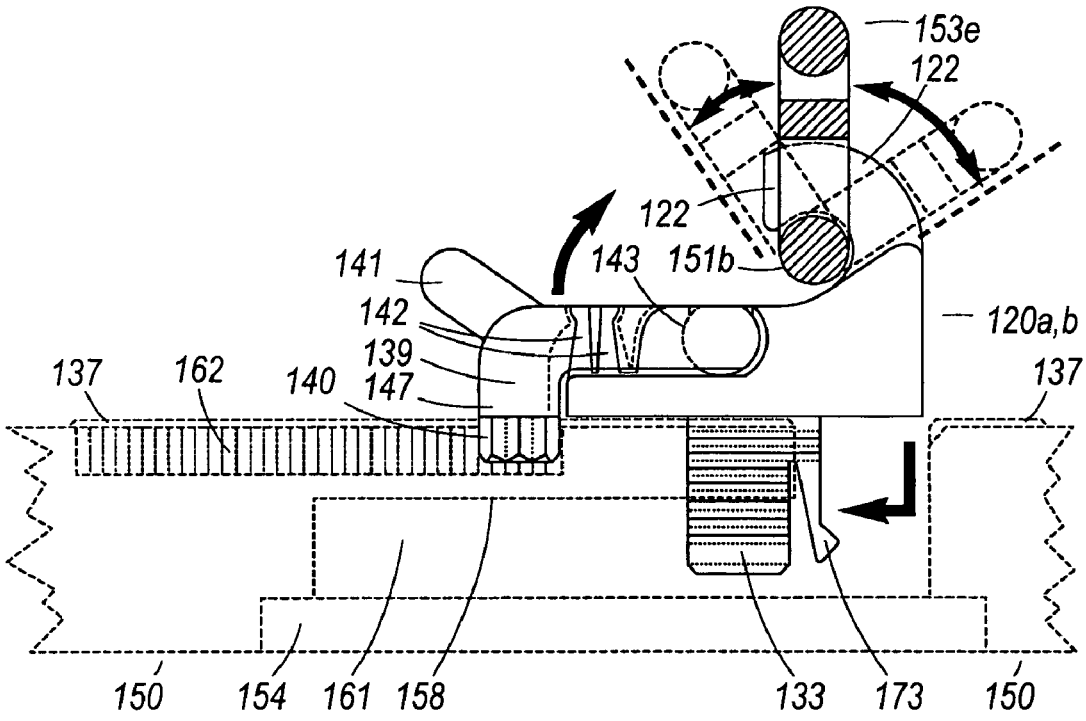
FIG. 16A is a cross-sectional side view of the forward adjustable foot-strap anchor and the rear adjustable foot-strap anchor, as identified by line B-B in FIG. 16B.
Figure 16B:
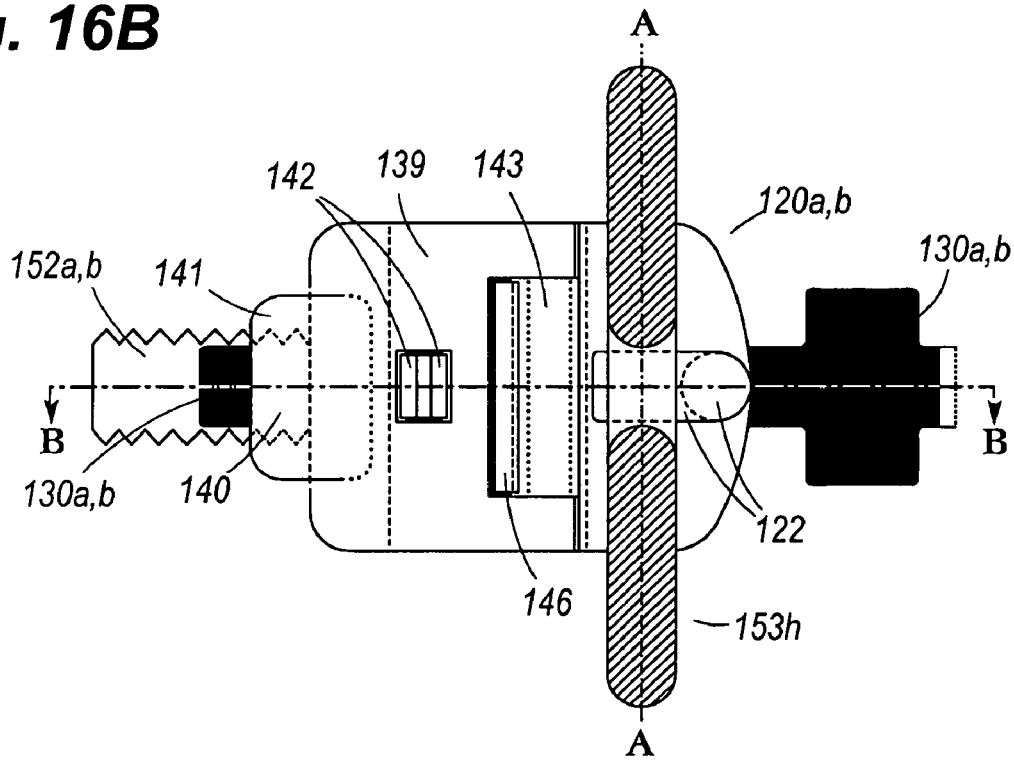
FIG. 16B is an overhead view of the surface features of the forward adjustable foot-strap anchor and the rear adjustable foot-strap anchor.
Figure 16C:
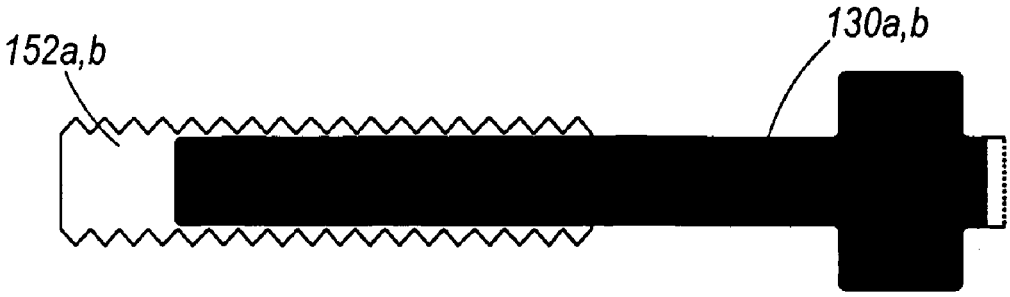
FIG. 16C is an overhead view of the two cavities that secure the forward adjustable foot-strap anchor, and the rear adjustable foot-strap anchor to the sandal sole.
Figure 16D:
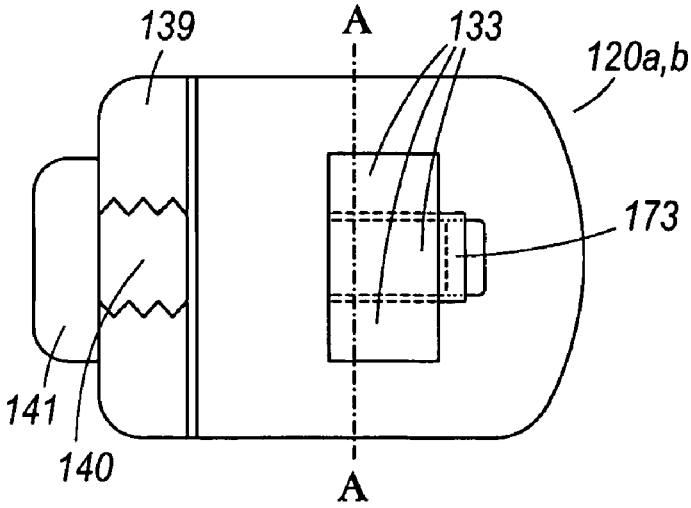
FIG. 16D is a bottom view of the surface elements of the forward adjustable foot-strap anchor, and the rear adjustable foot-strap anchor.
Figure 16E:
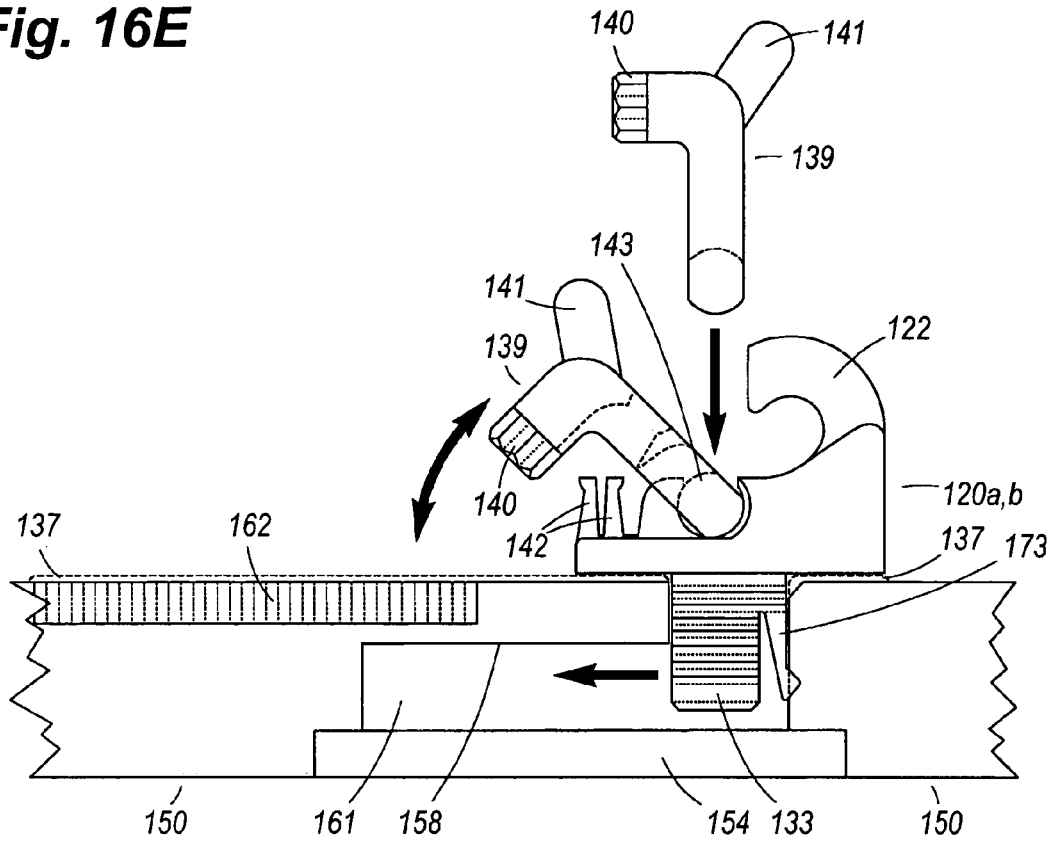
FIG. 16E is a side view of the forward adjustable foot-strap anchor and the rear adjustable foot-strap anchor with a locking arm shown in a vertical assembly view.
Figure 16F:
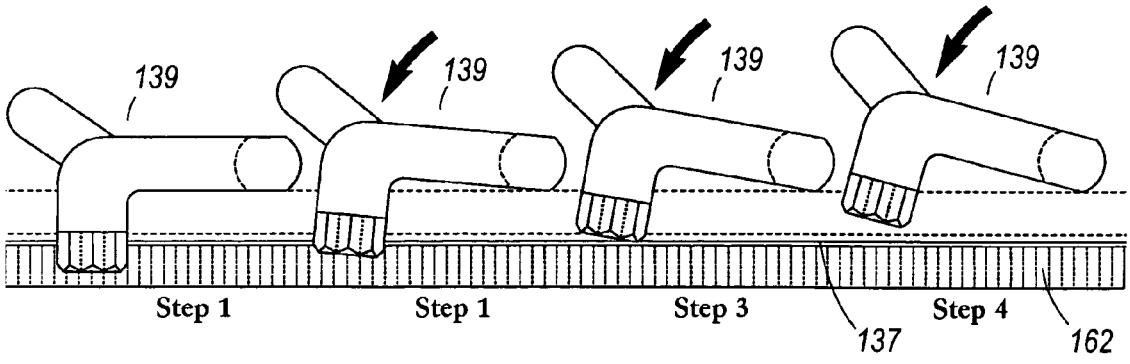
FIG. 16F is a side view of multiple, sequential images showing the locking-arm stud of the locking arm in various stages of being lifted up and out of its locked position.

The adjustable foot-strap anchors 120*a*, 120*b* are designed with an anchoring tongue and T-arm protrusion 133 that securely fits down into a cavity 130*a*, 130*b*, as shown in FIG. 13, and 161 as shown in FIGS. 16A, 16E, 16G, 16H provided in the forward sole section 101 and the rear sole section 102. Another cavity 152*a*, 152*b* is provided to accommodate the locking-arm stud 140, FIGS. 16A, 16B, 16D, 16E in one of many different laterally spaced positions to account for the many different shoe widths. The adjustable foot-strap anchors 120*a*, 120*b* are designed in such a way that their two plastic parts can be assembled by hand in one easy step, with no tools required. The locking-arm studs 140, FIGS. 16A, 16B, 16D, 16E of the adjustable foot-strap anchors 120*a*, 120*b* can easily be seated by hand into their respective cavities 152*a*, 152*b* when inserted vertically as shown in FIG. 16E.

Figure 20A:
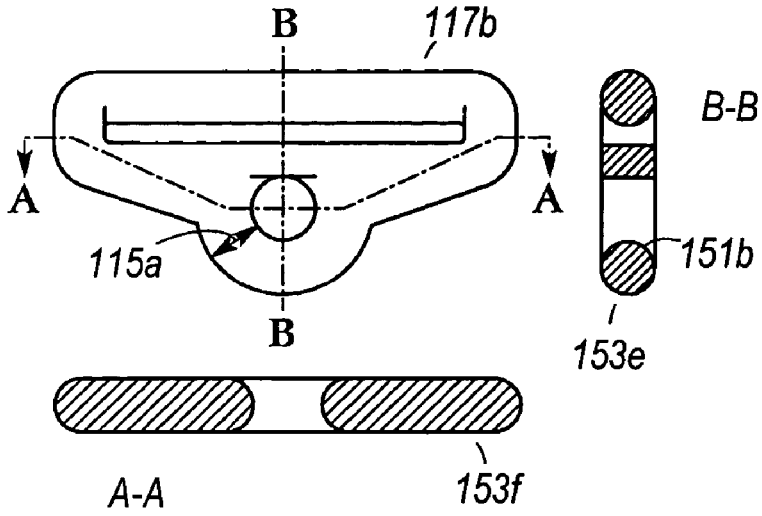
FIG. 20A shows a top view with two cross section views of a forward stud-mate attachment for attaching to the forward adjustable foot-strap anchor.

A forward foot-strap assembly 107 and rear foot-strap assembly 108, each consist of a wide elastic strap 112, roughly 1.5 inches wide, more or less, with a buckle 113*a* made of a very strong, rigid plastic, or other material with similar properties. This buckle 113*a* will allow the strap's 112 length to be adjusted to the desired degree of snugness, and to stay adjusted until a different length, or degree of snugness, is desired. The two foot-strap assemblies 107, 108 consist of a stud-mate attachment 117*a*, 117*b*, 118*a*, 118*b* at each of the four ends. Two ends 117*a*, as shown in FIG. 20C, and 117*b*, as shown in FIG. 20A, of which are made of a very strong, rigid plastic, or other suitable material with similar properties, and the other two ends of a metallic material that allows them to have approximately the same strength, but be much thinner than their plastic counterparts. The metallic versions are designed with a donut-shaped catch 114*a*, 114*b* on one end that loops beneath the hooked studs 121 of the two, stationary foot-strap anchors 119*a*, 119*b* on the inside edge of the sandal.

The plastic versions are designed with a donut-shaped catch 115*a*, 115*b* on one end that loops beneath the hooked studs 122 of the two, adjustable foot-strap anchors 120*a*, 120*b* on the outer side of the shoe. The two metallic, stud-mate attachments 117*a*, 118*a* of the two foot-strap assemblies 107, 108 attach beneath the hooked studs 121 of the two metallic, stationary foot-strap anchors on the inner side of the foot, then cross over the top of the foot to the opposite side where the stud-mate attachments 117*b*, 118*b* loop beneath the hooked studs 122 of the two adjustable foot-strap anchors 120*a*, 120*b* located on the outer side of the foot. Once the two foot-strap assemblies 107, 108 are secured across the top of the foot, they are tightened snugly, but not tightly, to enable the shoe's sole to shift forward and backward slightly, as needed, during the walking process as a result of the flexing of the soles against each other.

The moderate degree of snugness of the two, elastic, foot-strap assemblies 107, 108 is established utilizing the foot-strap buckle 113*a* designed for that purpose. When fully engaged and adjusted, the moderate snugness of the two foot-strap assemblies 107, 108 insures that the four stud-mate attachments shown in FIG. 9, 117*a*, 117*b*, 118*a*, 118*b* of the two, foot-strap assemblies 107, 108 remain securely engaged beneath the hooked studs 121, 122 while the sandal is being worn, and prevents their disengagement until the strap's elastic pressures are relieved by intentionally applied hand pressure not requiring the loosening of the buckle 113*a*. Once the buckle 113*a* is initially tightened to the desired degree snugness at time of purchase, it need not be adjusted again until after many hours of use. The hooked studs 122 of the two adjustable foot-strap anchors 120*a*, 120*b* allow for exceptionally quick and easy attachment and disengagement of the straps.

An additional part is a smooth, strong, loose-fitting, cloth sleeve, with elastic constrictions at each end to keep it securely positioned near each end of the stud-mate attachments 117*a*, 118*a*. Its function will be to encase and protect the entire foot-strap assembly 107, 108, except for the donut end portions 114*a*, 114*b*, 115*a*, 115*b* of each stud-mate attachment 117*a*, 118*a*, 117*b*, 118*b*, to reduce wear and tear on the elastic strap portion 112 of the foot-strap assembly 107, 108, caused by the small amount of rubbing that occurs during the movement of the foot beneath the foot-strap assemblies 107, 108 during the walking cycle. This sleeve is intended to extend the life of the elastic strap 112 of the foot-strap assemblies 107, 108, which are the weakest parts of the sandal. The sleeve is not engaged until the strap's tightness has been initially established at time of purchase. Thereafter, only one end of the sleeve need be pulled back in the event that an adjustment is needed with the elastic straps 112 and the buckle 113*a*.

A heel back stop 106 is located on the top, back portion of the rear sole section 3, directly behind the intended placement of the heel of the sandal-wearer's shoe. It is comprised of a foam rubber, heel cushion that extends laterally across the top, forward portion of the plastic, heel back stop 106, which rises approximately 1.125 inches above the surface of the rear sole section 3. The actual foam rubber contact point with the back end of the shoe's heel is at a level located roughly 0.65 inches above the sole's surface, to account for the large gap (that sometimes approaches ½ inch high) that often exists beneath the back edge of the heel of a badly worn shoe sole. The foam rubber heel cushion functions as a pivot point for the back end of the shoe to pivot against.

Below the soles surface, an anchoring tongue protrusion 157 fits into a cavity 160*a*, with a locking arm 159 to secure it snugly in position. Because of the extended width of the heel back stop 106 it can accommodate the full range of shoe widths. The snap-lock arm 159 is designed to pressure-snap into the cavity 160*a* provided, locking the heel back stop 106 into position upon the rear sole section 3. A small cavity 165 is provided in the main body portion 156 of the heel back stop 106 to accommodate a screwdriver to be used to pry out the mechanism for replacement, if needed. The rounded top edge is designed to be the pivot point between the shoe's heel and the heel back stop 106 and the adjoining rear sole section 3, which operate as a single unit, and function like a flat, inverted mechanical lever during the plop-down stage of the airborne stepping action of the full-stride walking cycle.

A description of how the present invention works during a full-stride walking cycle is described below in step-by-step detail, accompanied by drawings for visual clarity FIGS. 19A-19F.

Figure 19A:
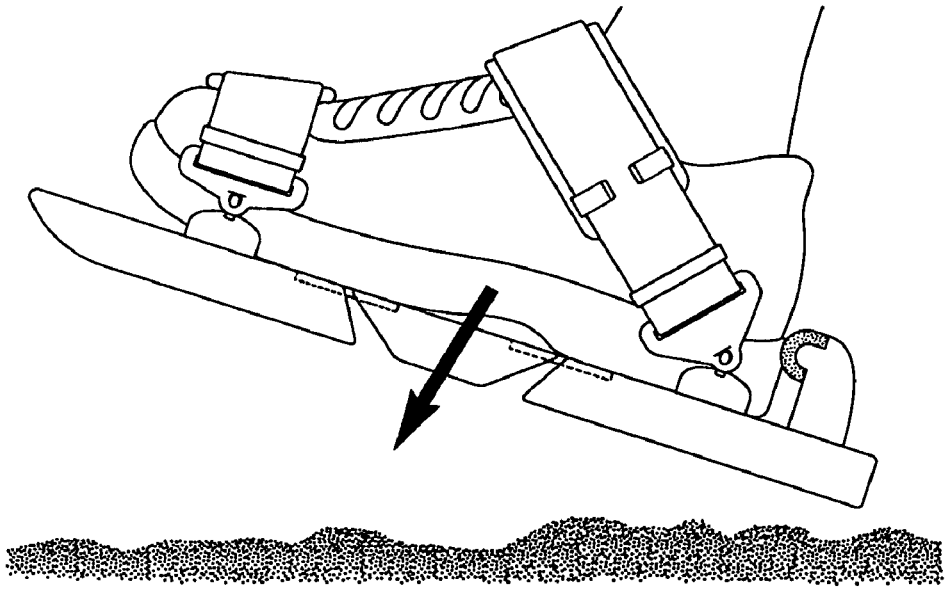
FIG. 19A is the first drawing of a 6-part sequence FIGS. 19A-19F depicting the various stages of a full-stride walking cycle as the sandal-wearer's upper body is moving forward. This drawing shows the configuration of the left foot sandal the moment before it strikes the surface of the soft sand after having been thrust in the air toward a full-stride step forward.
Figure 19B:
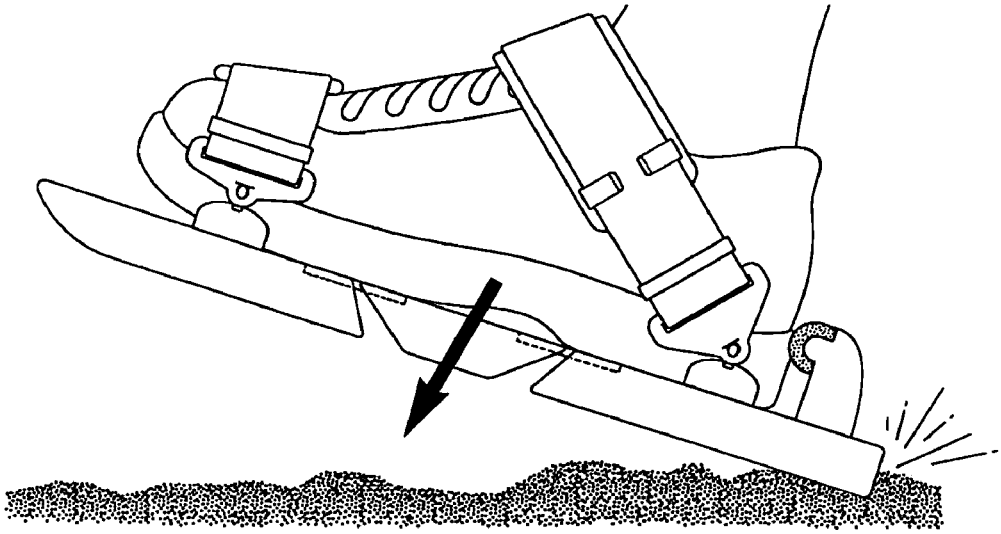
FIG. 19B is the second drawing of a 6-part sequence FIGS. 19A-19F depicting the various stages of a full-stride walking cycle as the sandal-wearer's upper body continues moving forward. This drawing shows the configuration of the left foot sandal the moment that it strikes the surface of the soft sand after having been thrust in the air toward a full-stride step forward.
Figure 19C:
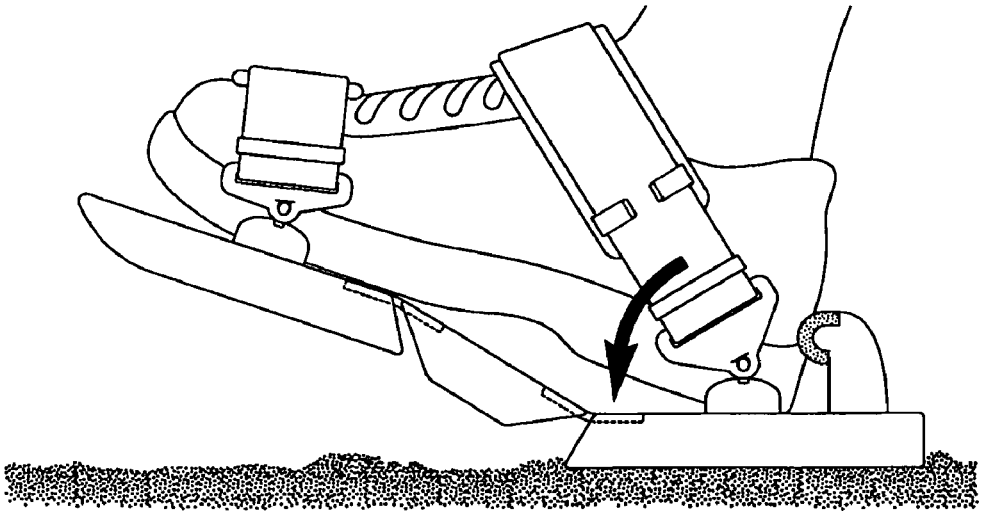
FIG. 19C is the third drawing of a 6-part sequence FIGS. 19A-19F depicting the various stages of a full-stride walking cycle as the sandal-wearer's upper body continues moving forward. This drawing shows the configuration of the left foot sandal a split second after the back end portion of the rear sole section strikes the surface of the soft sand.
Figure 19D:
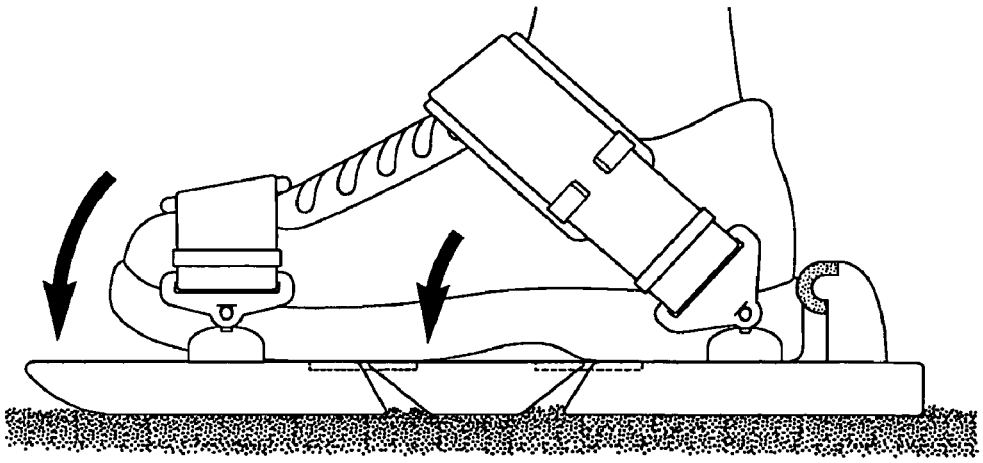
FIG. 19D is the fourth drawing of a 6-part sequence FIGS. 19A-19F depicting the various stages of a full-stride walking cycle. This drawing shows the configuration of the left foot sandal as the sandal-wearer's upper body continues moving forward during the walking cycle until it passes directly over the foot.
Figure 19E:
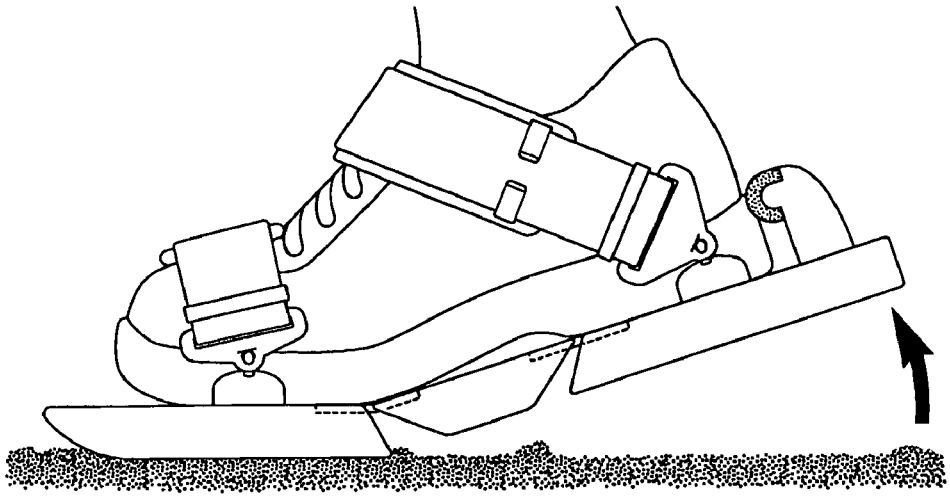
FIG. 19E is the fifth drawing of a 6-part sequence FIGS. 19A-19F depicting the various stages of a full-stride walking cycle. This drawing shows the configuration of the left foot sandal as the sandal-wearer's upper body continues moving forward, and the opposite foot begins its airborne thrust forward toward its next full-stride step.

FIG. 19A is the first drawing of a 6-part sequence FIGS. 19A-19F depicting the various stages of a full-stride walking cycle as the sandal-wearer's upper body continues its move forward. This drawing shows the configuration of the left foot sandal the moment before it strikes the surface of the soft sand after having been thrust in the air toward a full-stride step forward. The angle of the foot and shoe at this stage is roughly 15 to 25 degrees, in relationship to the surface of the soft sand, and is a direct result of the 15 to 25 degree angle of the outstretched leg of the sandal-wearer, forward of the vertical.

FIG. 19B is the second drawing of a 6-part sequence FIGS. 19A-19F depicting the various stages of a full-stride walking cycle as the sandal-wearer's upper body continues its move forward. This drawing shows the configuration of the left foot sandal the moment that it strikes the surface of the soft sand after having been thrust in the air toward a new full-stride step forward. The angle of the foot and shoe at this stage is approximately 15 to 25 degrees, in relationship to the surface of the soft sand, and is a direct result of the 15 to 25 degree angle of the outstretched leg, forward of vertical. A split second after the back edge of the rear sole section 103 strikes the surface of the soft sand, as the sandal-wearer's upper body continues its movement forward, it sinks into the soft sand only about 0.375 inch before enough surface resistance is created to trigger an inverted mechanical leverage action upon the flexibly-hinged, three-part sole 101, 102, 103, by the back edge of the shoe's heel to function as a weighted fulcrum, as explained more fully in the descriptive text for FIG. 19C in the next paragraph.

FIG. 19C is the third drawing of a 6-part sequence FIGS. 19A-19F depicting the various stages of a full-stride walking cycle as the sandal-wearer's upper body continues its move forward. The action occurs with the leading foot, when it is positioned far out ahead of the sandal-wearer's upper body, at the end of the outstretched leg. During this split-second sequence the back end portion of the rear sole section 103 strikes the surface of the soft sand, as seen in FIG. 19B, while positioned at an angle of 15 to 25 degrees, in its relationship to the surface of the soft sand. The back end of the sandal sinks down into the soft sand approximately 0.375 inch before an estimated one to two pounds of sand resistance triggers an inverted mechanical leverage action upon the flexibly-hinged, rear sole section 103. This action is triggered by the back edge of the shoe's heel, functioning as a weighted fulcrum, by applying downward pressure forward of the back edge of the rear sole section 103, and forcing the rear sole section 103 to almost instantly arc downward at an angle, away from the bottom, front portion of the shoe's heel, plopping the entire rear sole section 103 down flatly upon the soft sand.

As the split-second sequence is occurring the sandal-wearer's angled foot begins a much slower downward arc of its own, as the upper body continues its movement forward, as explained in the next sequence. The inverted mechanical leverage action that occurs is made possible, primarily, by the flexibly-hinged, three-part, sandal sole system 101, 102, 103, and the forward positioning of the shoe's heel on the extended rear sole section 103. The top, forward edge of the heel back stop mechanism 106 also plays an important roll in providing a stable pivot point for the arcing to occur.

Note in the drawing that when the rear sole section 103 arcs downward, away from the forward portion of the shoe's heel, the back side of the shoe maintains constant contact with the pivot point at the top, forward edge of the heel back stop mechanism 106, approximately 1.25 inches above the surface of the rear sole section 103. Also, the back edge of the shoe's heel maintains constant contact with the rear sole section 103 as it shifts forward roughly ⅜ inch, more or less. This phenomena occurs because of the 15 to 25 degree angular difference that is instantly created between the shoe's sole and the sandal's rear sole section 103 when the plop down occurs. The instant that the plop-down has concluded, the rear sole section's downward movement stops abruptly when the sandal-wearer's body weight becomes fully supported by the entire surface area of the now flatly-positioned rear sole section 103 and only minimal foot sinking results.

Immediately prior to the plop-down, the body's full weight, had been supported by the flatly-positioned forward sole section 101 of the trailing foot, which has a configuration identical to a mirror image of FIG. 19E. At the peak of the heel's arcing movement upward, the body's full-weight is shifted forward to the leading foot shown in FIG. 19C. The inverted mechanical leverage action being explained above is assisted by the front-to-back, downward angling, (45 degrees, more or less) of the rear foot-strap assembly 108, which reduces approximately in half, the restraining pressure being applied by the rear foot-strap assembly 108 to the heel back stop 106.

Also, the rear foot-strap assembly's 108 two points of attachment near the back end of the heel 119*b*, 120*b*, FIGS. 3 & 4 are one of the key ingredients to making the plop-down action successful, not only because its 45-degree angle reduces the retaining pressure by half, but also because it greatly increases the mechanical leverage ratio of the heel's downward pressure, when functioning as a weighted fulcrum upon the rear sole section 103. The retaining pressure being exerted by the rear foot-strap assembly 108 is estimated to be 103 pounds, more or less, which is sufficient to keep the rear sole section 103 sufficiently pulled up beneath the sole of the shoe, but weak enough to enable the weighted fulcrum action created by the back edge of the shoe's heel to easily force the rear sole section 103 to arc downward and away from the forward portion of the shoe's heel.

Note that the entire sequence of the rear sole section's plop-down, just described, occurs within a split-second while the sandal-wearer's foot and shoe remain positioned at their forward, upward angle orientation, of approximately 15 to 25 degrees, in relationship to the surface of the soft sand, until after the plop-down has occurred, and until after the body's full weight has been applied to the back edge of the shoe's heel and the soft sand below. The foot's arc downward from its angular orientation occurs at a much slower rate of speed than that of the almost instantaneous plop-down action.

FIG. 19D is the fourth drawing of a 6-part sequence FIGS. 19A-19F depicting the various stages of a full-stride walking cycle. This drawing shows the configuration of the left foot sandal as the sandal-wearer's upper body is continuing its move forward during the walking cycle until it is passing directly over the foot, which has arced downward, until it is positioned flatly in its relationship to the soft sand. This action occurs in the time frame between FIG. 19C and FIG. 19D. Immediately following the arced plop-down of the rear sole section 103 that occurs in FIG. 19C, the angled foot begins its arc downward at a much slower speed than the almost instant plop-down, from its 15 to 25 degree angle, until the body-weight pressure has forced the middle sole section 102 and then the forward sole section 101 to lie down flatly upon the soft sand, in succession, one after the other. It should be noted that during the walking cycle no significant amount of body-weight pressure is ever exerted upon any of the three sole sections 101, 102, 103 until they are positioned flatly upon the soft sand. This characteristic insures that the maximum number of square-inches of sole surface is in contact with the soft sand when the body weight is applied, and that the minimum possible amount of foot sinking occurs.

FIG. 19E is the fifth drawing of a 6-part sequence FIGS. 19A-19F depicting the various stages of a full-stride walking cycle. This drawing shows the configuration of the left foot sandal as the sandal-wearer's upper body continues its move forward, and the opposite foot (unseen in this drawing) begins its thrust forward in the air toward that foot's full-stride step. In response, the now-trailing leg begins lifting the heel of the now-trailing foot, shown in the drawing, up in the air above the soft sand in anticipation of its next stepping action forward. All the while, the foot's rear foot-strap assembly 108 continues performing its job of applying mild retaining pressure to the rear sole section 103, holding it up flatly against the bottom of the shoe's heel. As the foot's heel lifts upward, the sandal-wearer's body weight, which the moment before had been divided between the foot's heel and the ball joints of the toes, and with a small amount on the toes themselves, shifts totally to the ball joints of the toes, and a small amount to the toes themselves.

As the sandal-wearer's upper body continues moving forward, the outstretched leading leg and the outstretched trailing leg, each become even more outstretched as the full-stride stepping action is nearing completion, thereby causing the heel of the trailing foot to lift up even higher than shown in the drawing. And, because of the flexing that occurs between the three sole sections 101, 102, 103 and the shoe, the shoe's heel is forced to shift backwards on the surface of the rear sole section 3, reclaiming some, or all, of the space created by the pivoting action explained in the written descriptions of FIG. 19C above.

Note that the forward sole section 101 remains firmly and flatly positioned upon the soft sand during the entire time that it is supporting any significant amount of the sandal-wearer's body weight, which maximizes the square-inches of sand contact and minimizes foot sinking. The flexibly hinged, three-part, sole system 101, 102, 103 plays a crucial role in making this action sequence possible.

Figure 19F:
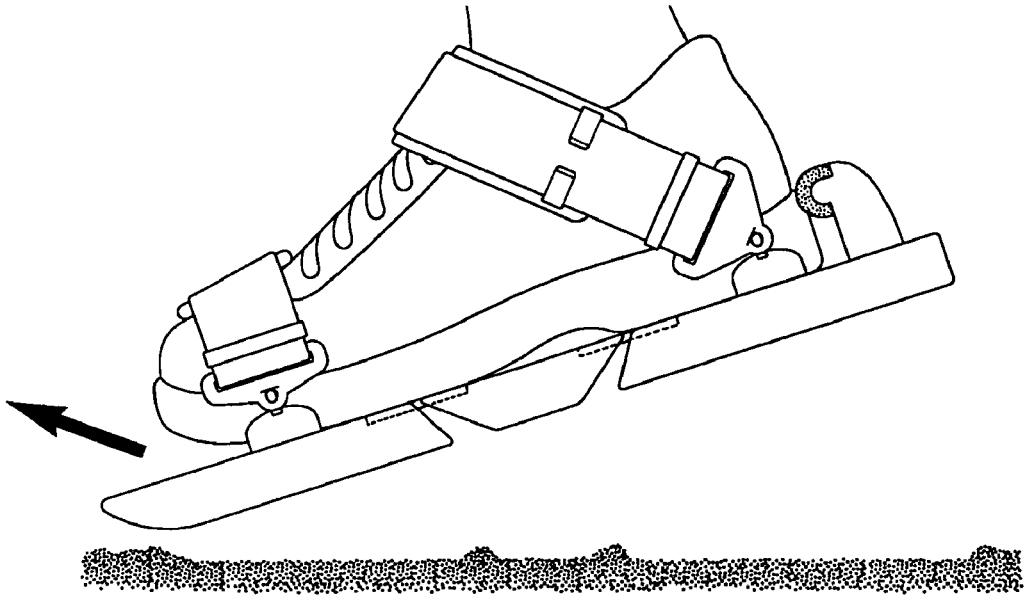
FIG. 19F is the final drawing of a 6-part sequence FIGS. 19A-19F depicting the various stages of a full-stride walking cycle. This drawing shows the configuration of the left foot sandal just after it has been lifted up in the air, off the soft sand, during its thrust forward toward its next full-stride step.

FIG. 19F is the sixth drawing of a 6-part sequence FIGS. 19A-19F depicting the various stages of a full-stride walking cycle. This drawing shows the configuration of the left foot sandal as the sandal-wearer's upper body continues its move forward, and just after the foot has been lifted up off the soft sand into the air during its thrust forward toward its next full-stride step. As soon as the body-weight pressure is instinctively shifted from the now-trailing foot (seen in this drawing) forward to the now-leading foot (not seen in this drawing), the snug retaining pressure being exerted by the sandal's rear foot-strap assembly 108, shifts the sandal-wearer's shoe back against the heel back stop 106 where it had been positioned at the beginning of the walking cycle, as shown in the drawings of FIGS. 19A & 19B.

FIG. 16A is a cross-sectional side view of the forward adjustable foot-strap anchor 120*a*, and the rear adjustable foot-strap anchor 120*b*, as identified by line B-B in FIG. 16B, shown with a cross-sectional side view 153*e* of the forward stud-mate attachment 117*b*, as identified by line B-B of FIG. 20A. This mechanism is designed to be made of plastic, or a material with similar properties.

Note that the arcing arrows and dashed lines indicate that the forward stud-mate attachment 117*b* is designed to enable an inward and outward, page-like, arcing motion of the forward stud-mate attachment 117*b* from its attachment point beneath the hooked stud 122—up to 60 degrees inward from the vertical and 40 degrees outward from the vertical. Also shown is a sub-surface side elevation view of the anchoring tongue protrusion 133 and locking arm 173 of the adjustable foot-strap anchors 120*a*, 120*b*, plus a cross-sectional side view of a truncated portion 150 of the forward sole section 101, as identified by line B-B of FIG. 16B.

Note that the cross-sectional thickness of the stud-mate attachment 153*e* of the forward foot-strap assembly 107 is seen in its locked position nestled up beneath, and pressing up against, the hooked stud 122. The dashed line to the left of the hooked stud 122 also indicates the required angle for the stud-mate attachments 117*b*, 118*b* to be positioned at during engagement and disengagement from underneath the hooked stud 122. The reason that the locked position beneath the hooked stud 122 is referred to as "locked" is that the stud-mate attachments 117*b*, 118*b* cannot accidentally slip out from beneath the hooked stud 122 while the sandal is being worn. It can only be removed "intentionally" by hand pressure relieving the tension on the foot-strap assemblies 107, 108 and by arcing the plane of the stud-mate attachments 117*b*, 118*b*, like the page of a book, approximately 40 degrees down from the vertical to enable it to be slid out from underneath its locked position beneath the hooked stud 122.

The anchoring tongue and T-arm protrusion 133 of the two adjustable foot-strap anchors 120*a*, 120*b* extends down into the specially-designed cavity 130*a*, 130*b* of the forward sole section 1, and the rear sole section 103 where the adjustable foot-strap anchors 120*a*, 120*b* and their anchoring tongue and T-arm protrusion 133 can be slid laterally into one of many different teeth-lock cavity positions 172*a*, 172*b*, made available for anchoring the adjustable foot-strap anchors 120*a*, 120*b* to fit multiple shoe widths.

During the initial fitting of the sandal to the purchaser's foot, when the right side of the left shoe, and the left side of the right shoe, are positioned up against the two stationary foot-strap anchors 119*a*, 119*b*, the two adjustable foot-strap anchors 120*a*, 120*b* are slid laterally into a position ⅛ inch, or less, away from the outer side of the sandal-wearer's shoe, to the nearest teeth-lock location within the cavity 172*a*, 172*b*. The locking-arms 139 and the locking-arm studs 140 of the two adjustable foot-strap anchors 120*a*, 120*b*, are then forced by hand pressure on the finger-grip flange 141, to arc downward and snap into one of many teeth-lock cavity 152*a*, 152*b*, 162 positions.

The actual snap-lock stud 142; FIG. 16B & 16C that the locking arm 139 snaps down onto when the locking-arm stud 140 is fully-seated in it's proper teeth-lock cavity 152*a*, 152*b*, 162, is located on the top of the adjustable foot-strap anchor 120*a*, 120*b*. The locking-arm stud shoulder 147; FIG. 1-6A of the locking arm 139, is designed to prevent damage to the locking arm 139 during this engagement process due to the possibility of excessive hand-manipulated force being applied. The locking-arm stud cavities 152*a*, 152*b*, 162 are designed to have greater depth than the length of the actual locking-arm stud 140, to accommodate excess sand that may accumulate, and to keep that sand from interfering with the functioning of the locking-arm stud 140. The locking arm 139 is attached to the main body of the adjustable foot-strap anchors 120*a*, 120*b* by a cylindrical pivot pin 143 that is a contiguous part of the locking arm 139, and is anchored into the cylindrical, partial-sleeve cavity 146 where the cylindrical pivot pin 143 and partial-cavity sleeve 146 function like a conventional door hinge, and the locking arm 139 functions in a manner similar to a conventional trap door that arcs upward from the floor.

The cylindrical pivot pin 143 is designed with the cylinder shape slightly flattened on the top and bottom, when the locking arm 139 is positioned in its locked state, enough to allow it to squeeze down into the open gap of the cylindrical, partial-sleeve cavity 146 when the locking arm 139 is positioned vertically. Once inserted into the cylindrical, partial-sleeve cavity 146 during manufacture, the locking arm 139 becomes locked into the cavity 146 when it is arced downward from its vertical position 5 degrees, or more, but is then free to arc up and down, up to 85 degrees when needed, to make shoe width adjustments, if needed. This feature is one of many designed into the component plastic parts to allow the standard injection molding process to be used for their formation and assembly without the use of tools.

Note that by making the two adjustable foot-strap anchors 120*a*, 120*b* adjustable for accommodating all shoe widths, the required number of different sandal sizes manufactured, and the total number of sandals needed to be kept in inventory, need only be ¼, or fewer, the number required had a different size sandal been necessary for each shoe size length and width. The functioning of the two adjustable foot-strap anchors 120*a*, 120*b* requires that it be capable of dealing with pressures from three different directions—(1) the occasional outward pressures exerted by the foot against the foot-strap anchors 119*a*, 119*b*, 120*a*, 120*b* when directional changes are being made while jogging; and (2) the upward and inward pressures exerted by the moderately-snug tightness of the foot-strap assemblies 107, 108.

The height of the adjustable foot-strap anchors 120*a*, 120*b*, and the stationary foot-strap anchors 119*a*, 119*b* was intentionally designed to be greater than it could have been designed, to ensure that it prevents the sandal-wearer's shoe, which often has a sole that curves slightly upward in the front portion, from sliding over the top of either the forward stationary foot-strap anchor 119*a* or the forward adjustable foot-strap anchor 120*a*, during a change in direction while jogging, when the sandal-wearer's shoe sometimes shifts up against the two foot-strap anchors 119*a*, 120*a*, located approximately 1/16 to ⅛ of an inch away from the shoe.

Figure 16G:
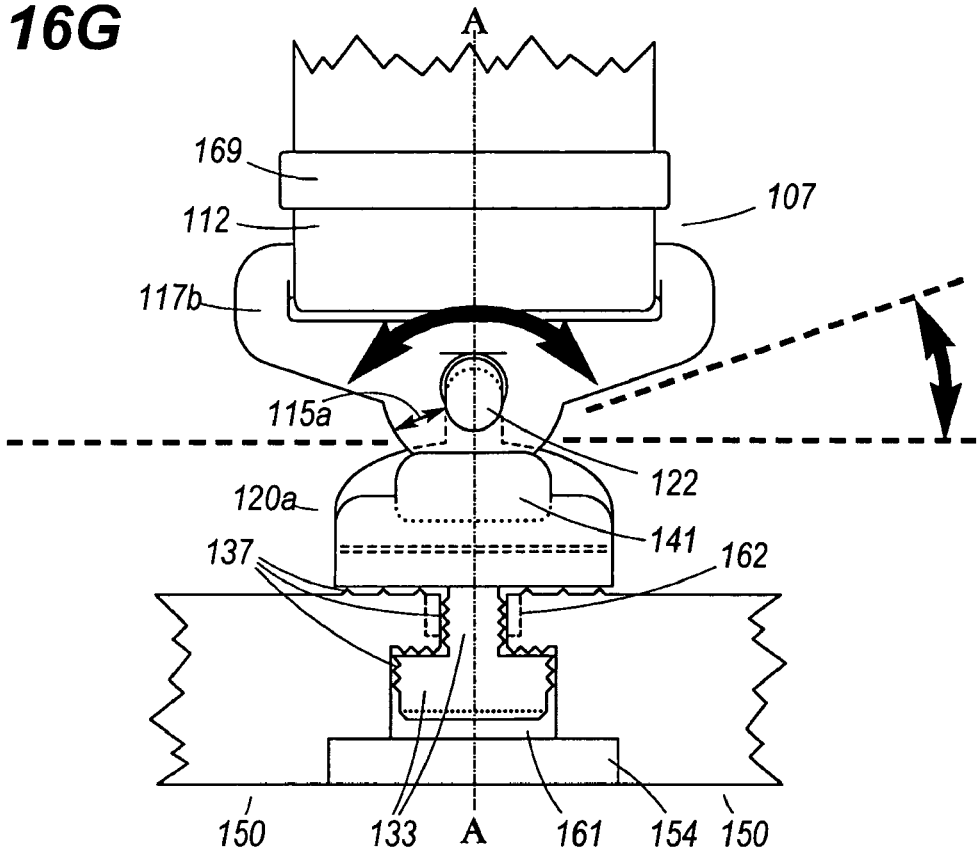
FIG. 16G is an elevation view of the outer end side of the forward adjustable foot-strap anchor attached to the forward stud-mate attachment which is a component part of the forward foot-strap assembly.
Figure 16H:
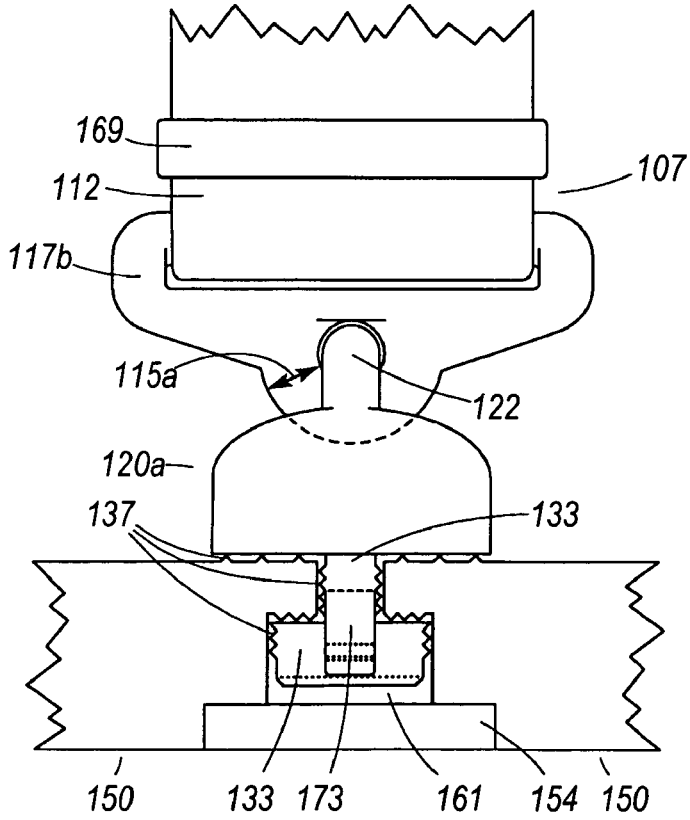
FIG. 16H is an elevation view of the inner end side of the forward adjustable foot-strap anchor attached to the forward stud-mate attachment which is a component part of the forward foot-strap assembly.

FIG. 16G is an end elevation view of the forward adjustable foot-strap anchor 120*a* connected to the forward stud-mate attachment 117*b*, which is the end portion of the truncated forward foot-strap assembly 107. The top ¾ portion of the mechanism shown in the drawing is an elevation of the external surfaces only, whereas the bottom ¼ portion is a cross-sectional side view, as identified by line B-B of FIG. 8B. Note that the small, donut-shape portion 114*a*, 151*a*, as shown in FIG. 20C of the stud-mate attachment 117*b* of the forward foot-strap assembly 107 is shown in its locked position directly beneath the hooked stud 122. See the "detailed description" above of FIG. 16A for an explanation regarding the "locked" position of the forward stud-mate attachment 117*b*, and the rear stud-mate attachment 118*b*.

Figure 20B:
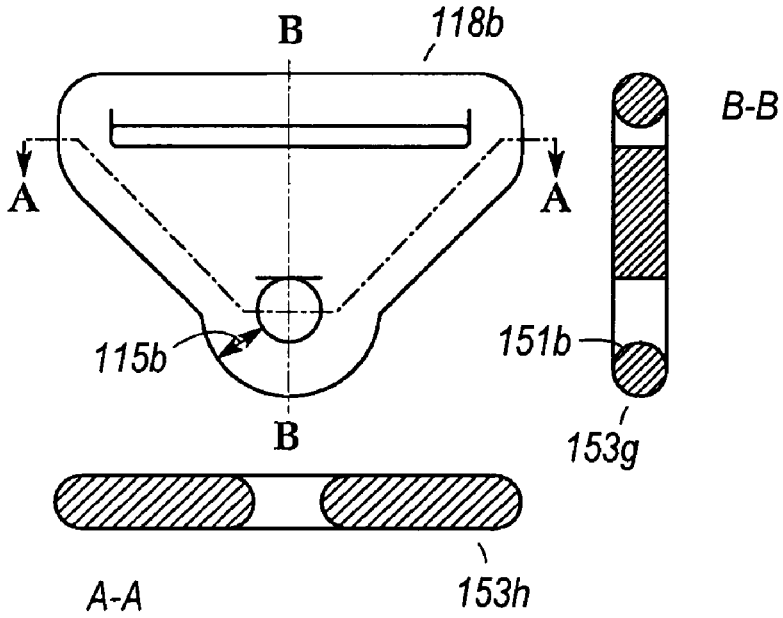
FIG. 20B shows a top view with two cross section views of a rear stud-mate attachment for attaching to the rear adjustable foot-strap anchor.
Figure 20C:
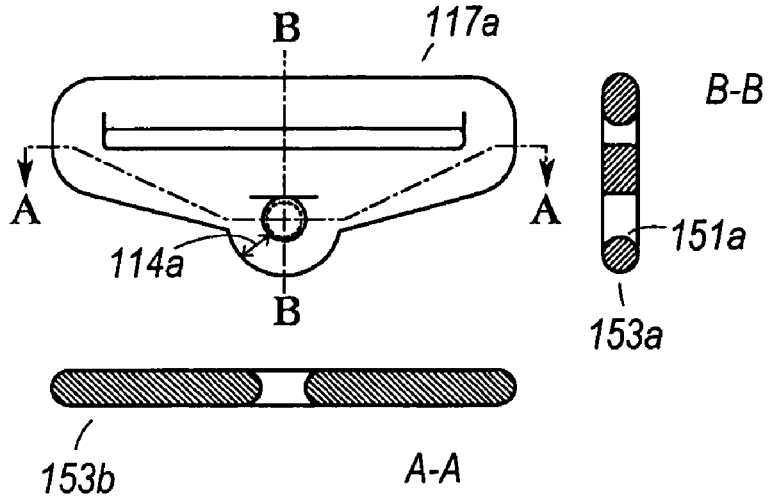
FIG. 20C shows a top view with two cross section views of a forward stud-mate attachment for attaching to the forward stationary foot-strap anchor.
Figure 20D:
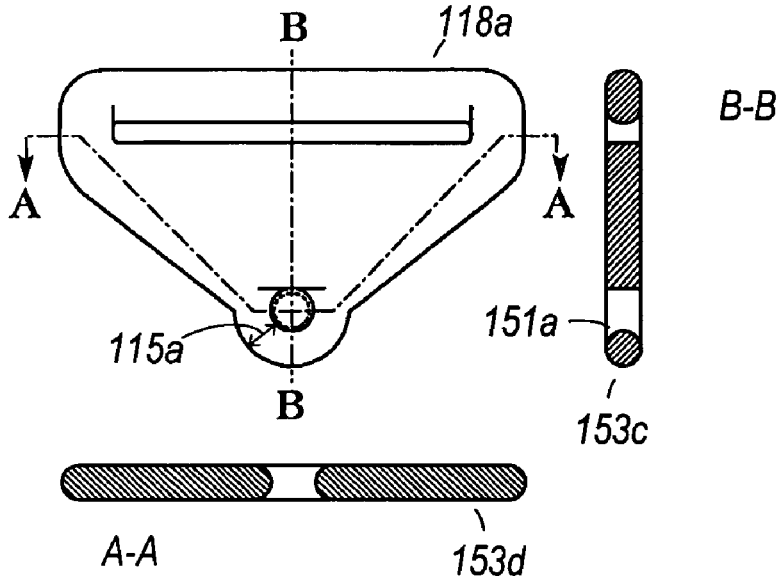
FIG. 20D shows a top view with two cross section views of a rear stud-mate attachment for attaching to the rear stationary foot-strap anchor.

The rear adjustable foot-strap anchor 120*b* looks identical to the forward adjustable foot-strap anchor 120*a* that is shown in this drawing, except the rear adjustable foot-strap anchor 120*b*, would have had the rear stud-mate attachment 118*b*, FIG. 20B (not shown in the drawing) instead of the forward stud-mate attachment 117*b*. Note also that the planes of contact between the cavity walls 130*a*, 130*b*, 175 and the anchoring tongue and T-arm protrusion 133 are grooved to minimize the points of contact in an effort to lessen the friction caused by the inevitable invasion of sand, explained elsewhere in this application.

Figure 17A:
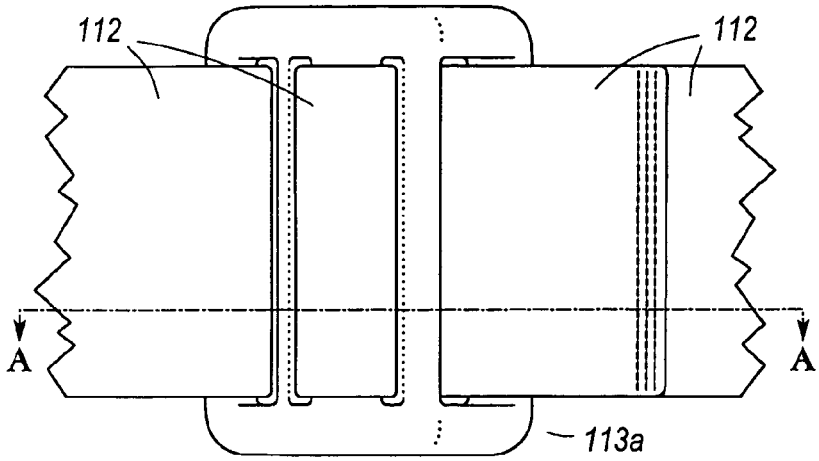
FIG. 17A is the first drawing of an 9-part series FIGS. 17A-17I, depicting the face of a buckle for adjusting the length of the elastic strap portion of the forward foot-strap assembly, and of the rear foot-strap assembly 8.
Figure 17B:
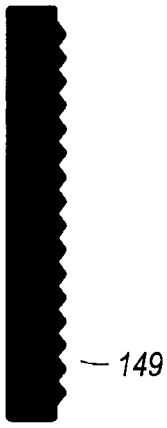
FIG. 17B is the second drawing of a 9-part series FIGS. 17A-17I, depicting the serrated edges of the buckle edges where the wide, elastic strap loops around within the buckle.
Figure 17C:
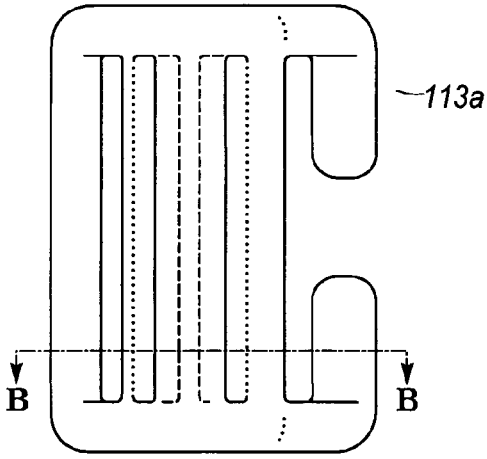
FIG. 17C is the third drawing of a 9-part series FIGS. 17A-17I, depicting an end view of the buckle for adjusting the length of the elastic strap portion of the forward foot-strap assembly, and of the rear foot-strap assembly.
Figure 17D:
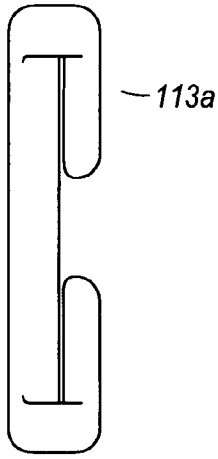
FIG. 17D is the fourth drawing of a 9-part series FIGS. 17A-17I, depicting an end view of the buckle for adjusting the length of the elastic strap portion of the forward foot-strap assembly, and of the rear foot-strap assembly.
Figure 17E:
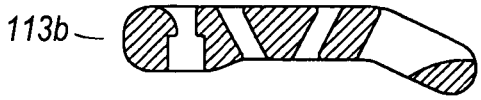
FIG. 17E is the fifth drawing of a 9-part series FIGS. 17A-17I, depicting a cross-sectional side view, as identified by line A-A of FIG. 17A, of the buckle for adjusting the length of the elastic strap portion of the forward foot-strap assembly, and of the rear foot-strap assembly.
Figure 17F:
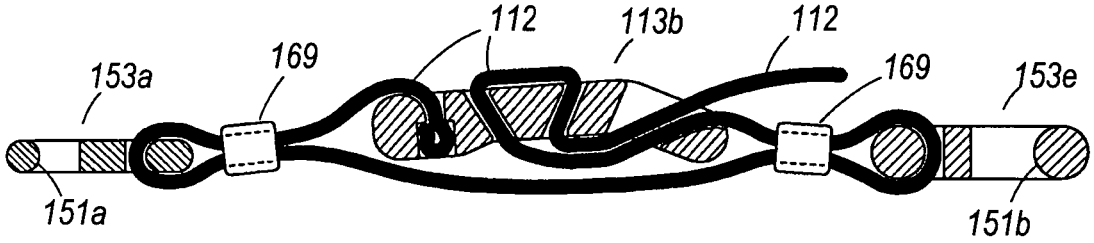
FIG. 17F is the sixth drawing of a 9-part series FIGS. 17A-17I, depicting a cross-sectional side view A, as identified by line A-A of FIG. 17A, of the buckle for adjusting the length of the elastic strap portion of the forward foot-strap assembly, and of the rear foot-strap assembly.
Figure 17G:
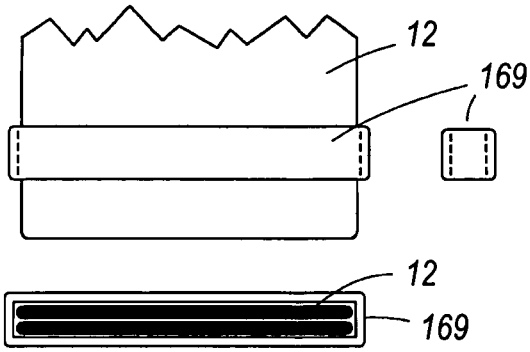
FIG. 17G is the seventh drawing of a 9-part series FIGS. 17A-17I, depicting a rectangular clasp for keeping the two sections of the elastic strap held together.
Figure 17H:
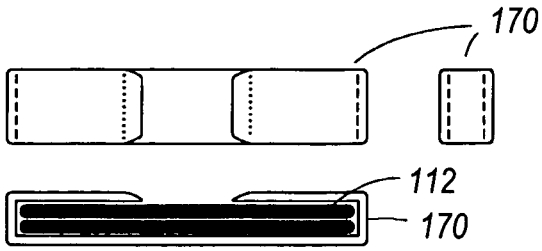
FIG. 17H is the eighth drawing of a 9-part series FIGS. 17A-17I, depicting a rectangular clasp for keeping the two sections of the elastic strap held together.
Figure 17I:
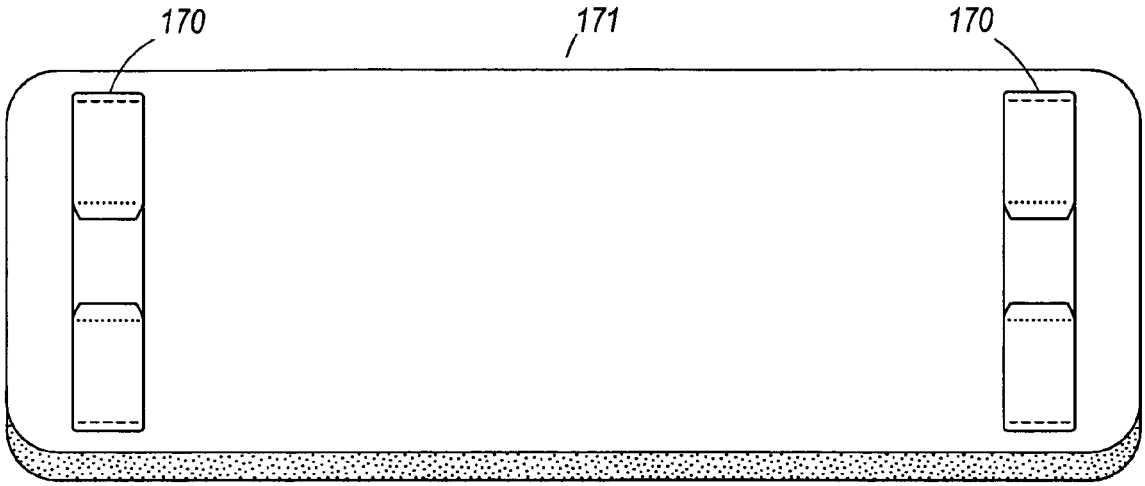
FIG. 17I is the final drawing of a 9-part series FIGS. 17A-17I, depicting a rectangular clasp for keeping the two sections of the elastic strap held together, and secured to a wide foam rubber cushion for comfort and to lessen wear and tear on the elastic strap.

FIG. 17F is the sixth drawing of a 9-part series FIGS. 17A-17F, depicting a cross-sectional side view, as identified by line A-A of FIG. 17A, of the buckle 113*a* for adjusting the length of the elastic strap portion 112 of the forward foot-strap assembly 107, and of the rear foot-strap assembly 108. The elastic strap 112 is shown engaged in the buckle 113*a*. The configuration of the elastic strap 112 show it correctly threaded through the buckle. Its route begins on the left end of the buckle 113*a*, where it is attached by sewing, and then extends out toward one end of the foot-strap assembly 107, 108 where it passes through the clasp 169 and attaches through the wide slot provided in the inner stud-mate attachment 117*a*, 118*a*. It then loops back under in the opposite direction and passes through the clasp 169 again and travels on beneath the buckle 113*a*, and extends all the way toward the opposite end of the foot-strap assembly 107, 108, where it passes through a second clasp 169 and attaches through the wide slot provided in the opposite side stud-mate attachment 117*b*, 118*b* and loops back in the opposite direction, where it again passes through the second clasp 169 and returns to the buckle 113*a* where it is threaded through, and ends up on the other side of the buckle 113*a*.

The reason for the continuous looping around of the elastic strap 112, instead of ending the straps at the two stud-mate attachments 117, 118 is to eliminate much of the sewing that would have been required of a non-looping strap. The looping straps show the addition of two very small and simple plastic, or plastic-like clasps 169 to hold the top portion of the elastic strap 112, and the bottom portion of the elastic strap 112, together near each end so that the top elastic strap 112 and the bottom elastic strap 112 are held together and function as a single strap. The two clasps 170 of the rear foot-strap assembly 108 are likely to be glued, or otherwise bonded, at opposite ends of a long and wide, ¼-inch thick strip of foam rubber. This strip will function as a cushion between the rear foot-strap assembly 108 and the top portion of the foot's instep, above the sometimes bulky knot of the shoelaces and above the top rim of the shoe.

There is an additional part, not shown in any of the drawings of this application, which may be added to help protect the elastic strap 112 of the two foot-strap assemblies 107, 108 from premature wear, and extend their lives. It is a tough, slick, cloth-like, sleeve, with a tautly stretched, elastic band sewn into each end. Notches will likely be designed into the stud-mate attachments 117*a*, 117*b*, 118*a*, 118*b* located at each end of the two foot-strap assemblies 107, 108. The elastic endings of the cloth sleeve would fit into the notches to retain the sleeve pulled over the entire elastic strap 112 and the buckle 113*a*.

Figure 18A:
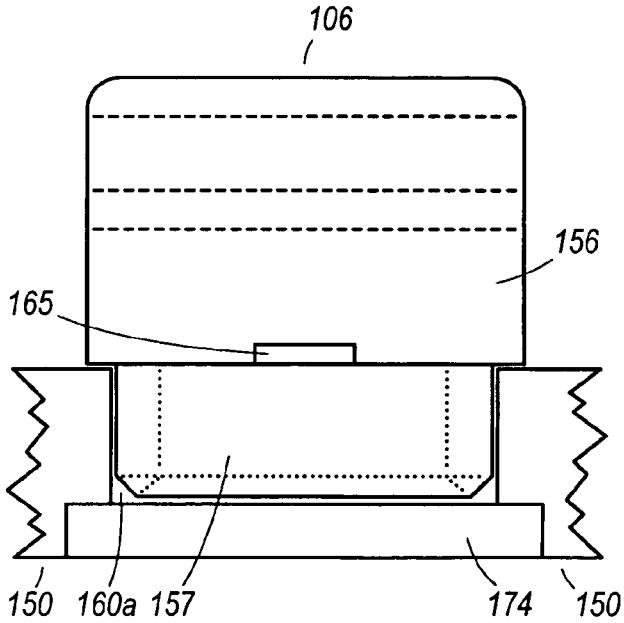
FIG. 18A is the first drawing of a 5-part series FIGS. 18A-18E depicting various drawings of the heel back stop mechanism. This drawing is a rear view elevation of the heel back stop showing all of the exterior surfaces and dashed-line indications of some opposite-surface portions, and includes a cross-sectional view of the truncated sandal sole that surrounds the anchoring tongue protrusion.

FIG. 18A is the first drawing of a 5-part series FIGS. 18A-18E depicting various drawings of the heel back stop mechanism 106. This drawing is a rear view elevation of the heel back stop 106 showing all of the exterior surfaces and dashed-line indications of some opposite-surface portions, and includes a cross-sectional view of the truncated sandal sole 150 that surrounds the anchoring tongue protrusion 157.

Figure 18B:
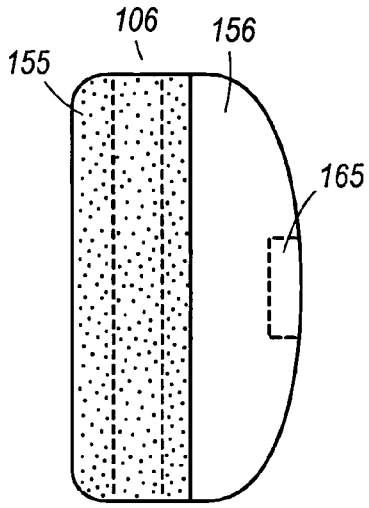
FIG. 18B is the second drawing of a 5-part series FIGS. 18A-18E depicting various drawings of the heel back stop mechanism. This drawing is an overhead view showing the exterior surfaces and dashed-line indications of some non-surface portions.
Figure 18C:
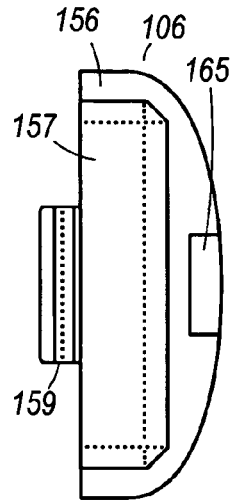
FIG. 18C is the third drawing of a 5-part series FIGS. 18A-18E depicting various drawings of the heel back stop mechanism. This drawing is a bottom view showing the exterior surfaces only, specifically including the anchoring tongue protrusion that fits down into the cavity provided in the rear sole section.

FIG. 18B is the second drawing of a 5-part series FIGS. 18A-18E depicting various drawings of the heel back stop mechanism 106. This drawing is an overhead view showing the exterior surfaces and dashed-line indications of some non-surface portions. The portion with lots of small dots represents the foam rubber padding 155 which acts as a cushion for the shoe's heel during the pivot action which occurs once during every step of the walking cycle when the top, forward edge of the heel back stop mechanism 106 functions as a pivot point against the back end of the shoe. The height of the mechanism is approximately 1.25 inches, more or less, above the surface of the rear sole section. The padding 155 is expected to be roughly ¼-inch thick, more or less;

FIG. 18C is the third drawing of a 5-part series FIGS. 18A-18E depicting various drawings of the heel back stop mechanism 106. This drawing is a bottom view showing the exterior surfaces only, specifically including the anchoring tongue protrusion 157 that fits down into the cavity 160*a* provided in the rear sole section 3.

Figure 18D:
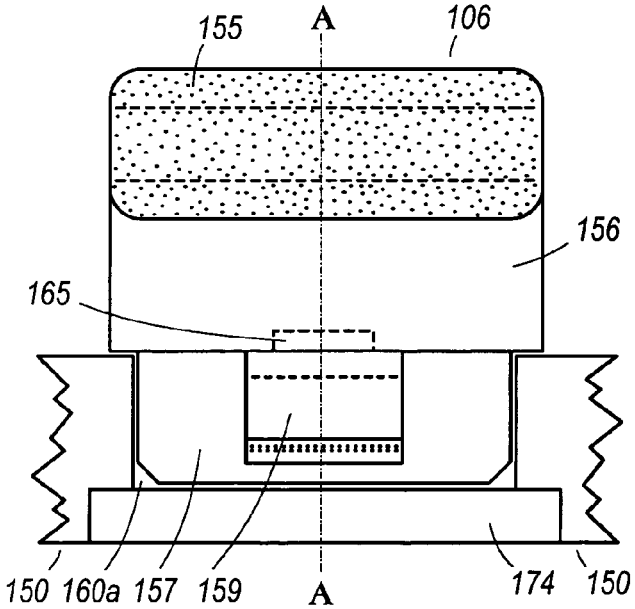
FIG. 18D is the fourth drawing of a 5-part series FIGS. 18A-18E depicting various drawings of the heel back stop mechanism. This drawing is a front view showing the exterior surfaces and dashed-line indications of some below the surface or opposite surface portions.
Figure 18E:
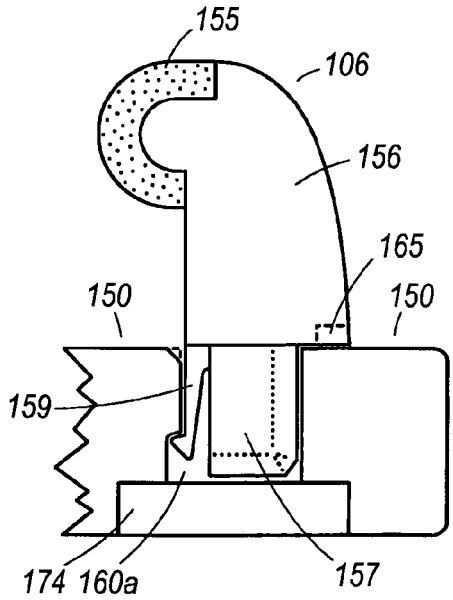
FIG. 18E is the final drawing of a 5-part series FIGS. 18A-18E depicting various drawings of the heel back stop mechanism. This drawing is a side view of the exterior surfaces and dashed-line indications of some non-surface portions. Included are the anchoring tongue protrusion and the locking arm that fit into the cavity provided in the rear sole section, which is represented by a cross-sectional, truncated view.

FIG. 18D is the fourth drawing of a 5-part series FIGS. 18A-18E depicting various drawings of the heel back stop mechanism 106. This drawing is a front view showing the exterior surfaces and dashed-line indications of some below the surface or opposite surface portions. Specifically included are the anchoring tongue protrusion 157 and the locking arm 159 that fit down into the cavity 160*a* provided in the rear sole section 3 which is represented by a cross-sectional, truncated side view 150;

FIG. 18E is the fifth drawing of a 5-part series FIGS. 18A-18E depicting various drawings of the heel back stop mechanism 106. This drawing is a side view of the exterior surfaces and dashed-line indications of some non-surface portions. Included are the anchoring tongue protrusion 157 and the locking arm 159 that fit into the cavity 160*a* provided in the rear sole section 3, which is represented by a cross-sectional, truncated view 150. The rounded, top, forward portion of the heel back stop mechanism 106 functions as a cushioned pivot point against the back side of the shoe's heel at a point located about ⅓ of the way down from the approximately 1.25 inch height of the mechanism 106. The thickness of the foam rubber padding 155 is expected to be roughly ¼ inch, more or less.

In this patent application the words sand and soft sand are meant to refer to very soft sand. It should be noted that the right foot sandal is a mirror image of the left foot sandal. All linear measures cited are based upon a sandal designed to fit a size 9D adult male foot.

It is to be understood that the present invention is not limited to the embodiments described above, but encompasses any and all embodiments within the scope of the following claims.

I claim:

1. A hinged sandal for normal, full-stride walking on very soft sand, the sandal being elongated and having a longitudinal axis, comprising:

a rigid forward sole section having a foot receiving portion disposed thereon, said forward sole section having an inside portion, an outside portion and a leading end intermediate the two portions of the forward sole section;

a rigid rearward sole section having a foot receiving portion disposed thereon, a rearward sole section length extension integrally projecting rearward from said foot receiving portion whereby the extension is dimensioned and contoured to extend rearward at least 0.75 inch beyond the heel of the user's foot, said rearward sole section and said sole extension having an inside portion substantially aligned with said inside portion of said forward sole section, an outside portion substantially aligned with said outside portion of said forward sole section, and a trailing end intermediate the inner and outside portions of the rearward sole and sole extension sections;

means for hinging the forward and rearward sole sections together, whereby each of the sole sections is allowed to angularly rotate about the hinge means independent of each other; and means for holding a user's foot to the sandal, said holding means including a first portion being asymmetrically mounted relative to the longitudinal axis on the foot receiving portion of the forward sole section for securing a user's toe portion to the sandal adjacent said inside portion of the forward sole section, said holding means further including a second portion secured asymmetrically to said rearward sole section, wherein the user's foot is secured to the sandal adjacent to said inside portion thereby forming unencumbered extended forward and rearward sole width portions;

whereby the hinge means permits angular rotation of the forward and rearward sole sections during normal full-stride walking on very soft sand thereby creating a mechanical advantage when the sole sections impact upon the soft sand and allow the heel pressure concentrated well-forward of the trailing end of the rearward sole extension, and the extended sole width portions to limit the amount of soft sand penetration by the sandal.

2. The hinged sandal of claim 1, wherein the forward and rear sole sections have cavities formed therein for reducing the weight of said forward and rearward sole sections.

3. The hinged sandal of claim 1, wherein:

said leading end of said forward sole section angles slightly rearward in a direction from said inside portion to said outside portion of said forward sole section; and said trailing end of said rearward sole section angles slightly forward in a direction from inside portion to said outside portion of said rearward sole section.

4. The hinged sandal of claim 1, wherein said leading end of said forward sole section tapers slightly rearward in a direction from an upper surface to a lower surface of said forward sole section.

5. The hinged sandal of claim 1, wherein said hinge means includes at least one inverted, downwardly open, transversely extending V-shaped notch defined between said forward and rearward sole sections.

6. The hinged sandal of claim 5, wherein a row of vertically disposed cutout notches is formed across said V-shape notch for preventing material from lodging between said forward and rearward sole sections.

7. The hinged sandal of claim 1, wherein said rearward sole length extension is about 1.125 to 1.5 inches in length.

8. The hinged sandal of claim 5, wherein said forward and rearward sole sections comprise:

a contiguous top sole layer overlying both said forward and rearward sole sections;

a middle sole layer; and a bottom sole layer, said middle sole layer being disposed between said top and bottom sole layers.

9. The hinged sandal of claim 1, further comprising a heel position indicator disposed at least at the juncture of the rearward extent of the foot receiving portion of said rearward sole section and the length extension for indicating the proper placement of the back of a heel in the foot receiving portion.

10. The hinged sandal of claim 8, wherein said vertex is located below a butting area that is adjacent to the lower surface of said top sole layer, said butting area thereby preventing said rear sole section from angularly rotating below the plane of said forward sole section.

* * * * *